US010908523B2

(12) United States Patent
Sugawara et al.

(10) Patent No.: US 10,908,523 B2
(45) Date of Patent: Feb. 2, 2021

(54) TONER AND TONER SET

(71) Applicant: FUJI XEROX CO., LTD., Tokyo (JP)

(72) Inventors: Atsushi Sugawara, Minamiashigara (JP); Satoshi Miura, Minamiashigara (JP); Akira Matsumoto, Minamiashigara (JP); Sakiko Hirai, Minamiashigara (JP); Yasuo Kadokura, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/988,574

(22) Filed: May 24, 2018

(65) Prior Publication Data

US 2019/0094728 A1 Mar. 28, 2019

(30) Foreign Application Priority Data

Sep. 27, 2017 (JP) ..... 2017-187226
Sep. 27, 2017 (JP) ..... 2017-187227
Sep. 27, 2017 (JP) ..... 2017-187228

(51) Int. Cl.
*G03G 9/08* (2006.01)

(52) U.S. Cl.
CPC ..... *G03G 9/0819* (2013.01); *G03G 9/0821* (2013.01); *G03G 9/0827* (2013.01)

(58) Field of Classification Search
CPC ... G03G 9/0819; G03G 9/0827; G03G 9/0821
See application file for complete search history.

(56) References Cited

U.S. PATENT DOCUMENTS 5,077,158 A * 12/1991 Nakano ..... G03G 9/08 430/103
5,723,245 A * 3/1998 Bertrand ..... G03G 9/08782 430/107.1
6,022,662 A 2/2000 Matsumura et al.
6,287,742 B1 * 9/2001 Yoon ..... G03G 9/0804 430/137.19
6,296,980 B1 * 10/2001 Oshiba ..... G03G 9/0819 430/110.3
6,528,224 B2 * 3/2003 Ohno ..... G03G 9/0819 430/108.1
6,531,255 B2 * 3/2003 Kim ..... G03G 9/081 428/402
7,704,665 B2 * 4/2010 Kmiecik-Lawrynowicz ..... G03G 9/0806 430/110.2
7,820,351 B2 * 10/2010 Suzuki ..... G03G 9/081 430/110.4
9,034,547 B2 * 5/2015 Joo ..... G03G 9/09342 430/108.6
2001/0033984 A1 10/2001 Matsumura et al.
2002/0192587 A1 12/2002 Matsumura et al.
2003/0003387 A1 * 1/2003 Xu ..... G03G 9/0804 430/137.14
2004/0053155 A1 * 3/2004 Emoto ..... G03G 9/0806 430/137.15
2004/0058267 A1 * 3/2004 Ishiyama ..... G03G 5/06 430/110.2
2005/0014079 A1 * 1/2005 Itakura ..... G03G 9/0821 430/45.4
2005/0106481 A1 * 5/2005 Ayaki ..... G03G 9/0821 430/45.5
2006/0105258 A1 * 5/2006 Ishiyama ..... G03G 9/0821 430/108.4
2007/0048643 A1 * 3/2007 Kmiecik-Lawrynowicz ..... G03G 9/0804 430/108.6
2014/0272702 A1 * 9/2014 Morales-Tirado ... G03G 9/0802 430/110.2

FOREIGN PATENT DOCUMENTS

JP H10-301323 A 11/1998
JP 2001-255703 A 9/2001
JP 3871766 B2 1/2007
JP 4141078 B2 8/2008

OTHER PUBLICATIONS

Diamond, A.S. (ed) Handook of Imaging Materials. New York: Marcel-Dekker, Inc. pp. 187-188. (Year: 2002).*
Diamond, A.S. (ed) Handook of Imaging Materials. New York: Marcel-Dekker, Inc. pp. 164-168. (Year: 2002).*

* cited by examiner

*Primary Examiner* — Christopher D Rodee
(74) *Attorney, Agent, or Firm* — Oliff PLC

(57) ABSTRACT

Provided is a toner including toner particles. The toner particles has a volume particle diameter distribution index on a side of the largest diameter (GSDv (90/50)) of 1.26 or less; a number particle diameter distribution index on a side of the smallest diameter (GSDp (50/10)) of 1.28 or less; GSDv (90/50)/GSDp (50/10) of from 0.96 to 1.01; and an average circularity of 0.95 or more and 1.00 or less.

5 Claims, 6 Drawing Sheets

TONER AND TONER SET

CROSS-REFERENCE TO RELATED APPLICATIONS

This application is based on and claims priorities under 35 USC 119 from Japanese Patent Application No. 2017-187226 filed on Sep. 27, 2017, Japanese Patent Application No. 2017-187227 filed on Sep. 27, 2017, and Japanese Patent Application No. 2017-187228 filed on Sep. 27, 2017.

BACKGROUND

Technical Field

The present invention relates to an electrostatic charge image developing toner, and a toner set.

Related Art

In recent years, due to development of equipment and reinforcement of communication networks in information society, an electrophotographic process has been widely used not only in copying machines, but also in office network printers, printers for a personal computer, printers for on-demand printing, and the like, and high image quality, high speed, high reliability, miniaturization, weight reduction, and energy saving performance are more strongly required therefor regardless of black-and-white printers or color printers.

In the electrophotographic process, a fixed image is usually formed through steps of electrically forming an electrostatic charge image on a photoreceptor (image holding member) utilizing a photoconductive substance by various units, developing the electrostatic charge image by using a developer containing a toner, transferring a toner image on the photoreceptor to a recording medium such as paper directly or via an intermediate transfer member, and then fixing the transferred image on the recording medium.

In a color toner image, secondary colors and tertiary colors, in which plural colors such as magenta, yellow, and cyan are superimposed, are generally used.

SUMMARY

According to an aspect of the present invention, there is provided an electrostatic charge image developing toner containing toner particles that have a volume particle diameter distribution index on a side of the largest diameter (GSDv (90/50)) of 1.26 or less; a number particle diameter distribution index on a side of the smallest diameter (GSDp (50/10)) of 1.28 or less; GSDv (90/50)/GSDp (50/10) of from 0.96 to 1.01; and an average circularity from 0.95 to 1.00.

BRIEF DESCRIPTION OF DRAWINGS

Exemplary embodiment(s) of the present invention will be described in detail based on the following figure(s), wherein.

DETAILED DESCRIPTION

Figure 1:
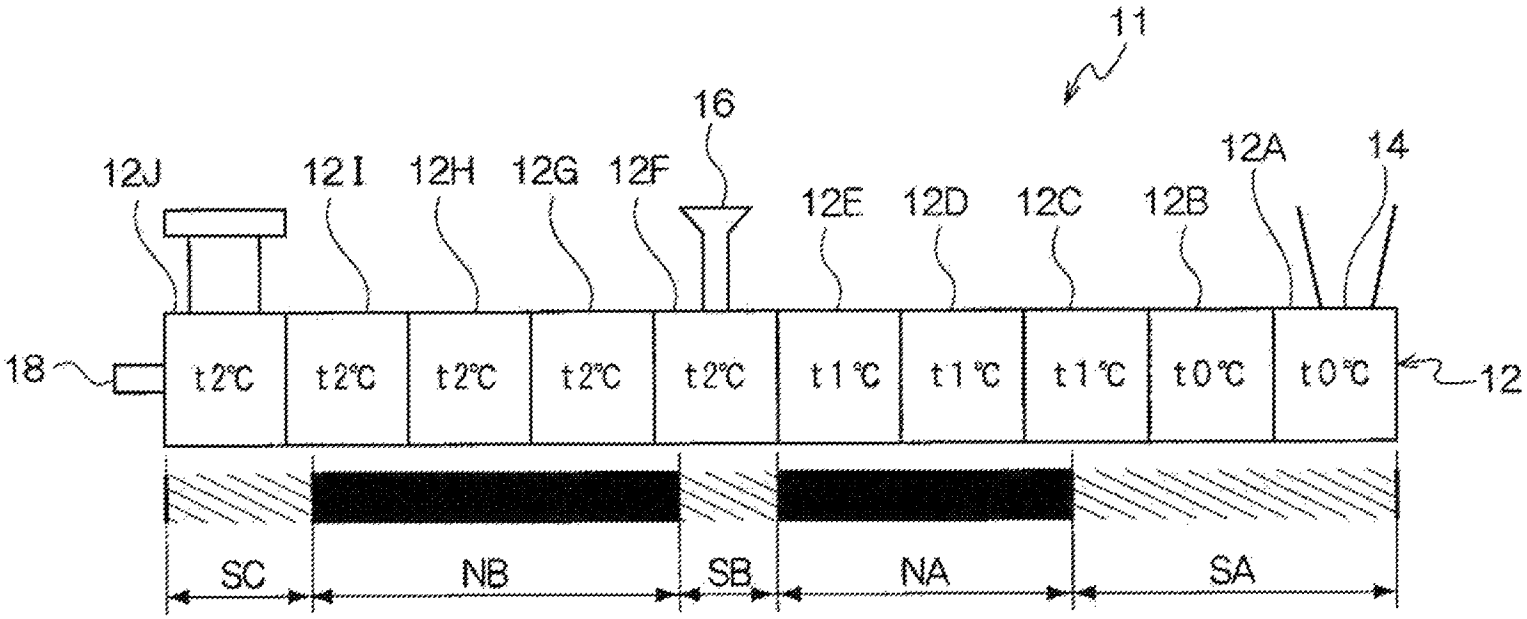
FIG. 1 is a diagram illustrating a state of a screw for an example of a screw extruder used for producing a toner according to the exemplary embodiment.

Hereinafter, exemplary embodiments of the electrostatic charge image developing toner, the toner set, the electrostatic charge image developer, the toner cartridge, the process cartridge, the image forming apparatus, and the image forming method of the present invention will be described in detail.

First Exemplary Embodiment

Hereinafter, an electrostatic charge image developing toner and a toner set according to the first exemplary embodiment will be described.

<Electrostatic Charge Image Developing Toner>

The electrostatic charge image developing toner according to the exemplary embodiment (hereinafter, simply referred to as a "toner" in some cases) contains toner particles having a volume particle diameter distribution index on a side of the largest diameter (GSDv (90/50)) of 1.26 or less, a number particle diameter distribution index on a side of the smallest diameter (GSDp (50/10)) of 1.28 or less, GSDv (90/50)/GSDp (50/10) of from 0.96 to 1.01, and an average circularity from 0.95 to 1.00.

In accordance with the electrostatic charge image developing toner according to the exemplary embodiment, an excellent gradation property is achieved in a case of forming a halftone image of multicolor. The reason is not clear, but it is presumed as follows.

In a configuration of the halftone image of multicolor, at least two colors of toner form a thin toner layer on a recording medium. In order to enhance a gradation property in the halftone image of multicolor, it is necessary to cause the at least two colors of toner to be evenly dispersed on the entire recording medium in a state close to each other, thereby forming a toner layer.

The toner according to the exemplary embodiment contains toner particles having GSDv (90/50) of 1.26 or less, GSDp (50/10) of 1.28 or less, GSDv (90/50)/GSDp (50/10) of from 0.96 to 1.01, and an average circularity from 0.95 to 1.00. Thus, a behavior of the toner particles easily becomes uniform as compared with toner particles of the related art. A toner containing such toner particles is particularly excellent in fluidity and charging characteristics. By improving the fluidity and the charging characteristics of the toner, it is easy to form a toner layer in which the toner is dispersed on an entire recording medium. As a result, it is presumed that a halftone image of multicolor having an excellent gradation property is formed.

Hereinafter, the toner according to the exemplary embodiment will be described in detail.

The toner according to the exemplary embodiment is formed by containing toner particles and, if necessary, an external additive.

(Toner Particles)

Toner particles are, for example, formed by containing a binder resin and, if necessary, a coloring agent, a release agent, and other additives.

—Binder Resin—

Examples of the binder resin include homopolymers of monomers such as styrenes (for example, styrene, parachlorostyrene, and α-methylstyrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, vinyl isopropenyl ketone, and the like), and olefins (for example, ethylene, propylene, and butadiene), or vinyl resins formed of copolymers obtained by combining two or more kinds of these monomers.

Examples of the binder resin include non-vinyl resins such as an epoxy resin, a polyester resin, a polyurethane resin, a polyamide resin, a cellulose resin, a polyether resin, and a modified rosin, a mixture thereof with the above-described vinyl resins, or a graft polymer obtained by polymerizing a vinyl monomer with the coexistence of such non-vinyl resins.

These binder resins may be used singly or in combination of two or more kinds thereof.

As the binder resin, a polyester resin is suitable.

Examples of the polyester resin include a known polyester resin.

Examples of the polyester resin include a condensed polymer of polyvalent carboxylic acid and polyhydric alcohol. Also, as the polyester resin, a commercially available product or a synthesized product may be used.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids may be used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more kinds thereof.

Examples of the polyhydric alcohol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are more preferably used as the polyhydric alcohol.

As the polyhydric alcohols, a tri- or higher-valent polyhydric alcohol employing a crosslinked structure or a branched structure may be used in combination together with diol. Examples of the tri- or higher-valent polyhydric alcohol include glycerin, trimethylolpropane, and pentaerythritol.

The polyhydric alcohol may be used singly or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-7121-1987 "testing methods for transition temperatures of plastics".

The weight average molecular weight (Mw) of the polyester resin is preferably from 5000 to 1000000, and is more preferably from 7000 to 500000.

The number average molecular weight (Mn) of the polyester resin is preferably from 2000 to 100000.

The molecular weight distribution Mw/Mn of the polyester resin is preferably from 1.5 to 100, and is more preferably from 2 to 60.

The weight average molecular weight and the number average molecular weight are measured by gel permeation chromatography (GPC). The molecular weight measurement by GPC is performed using GPC•HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the polyester resin. Specific examples thereof include a method of conducting a reaction at a polymerization temperature set to be from 180° C. to 230° C., if necessary, under reduced pressure in the reaction system, while removing water or an alcohol generated during condensation.

In a case where monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In a case where a monomer having poor compatibility is present in the copolymerization reaction, the monomer having poor compatibility and an acid or an alcohol to be polycondensed with the monomer may be previously condensed and then polycondensed with the major component.

The content of the binder resin is, for example, preferably from 40% by mass to 95% by mass, is more preferably from 50% by mass to 90% by mass, and is still more preferably from 60% by mass to 85% by mass with respect to the entire toner particles.

—Coloring Agent—

As the coloring agent, one known in the related art which corresponds to a color of toner can be used.

A gradation property in the halftone image of multicolor easily deteriorates due to toner that exhibits a color which is easily visually recognized, being localized on a recording medium. Therefore, the toner according to the exemplary embodiment may be a magenta toner exhibiting a magenta color or a cyan toner exhibiting a cyan color, which is easily visually recognized. By preventing localization of the magenta toner or the cyan toner on the recording medium, the gradation property in the halftone image of multicolor is easily enhanced.

As the cyan coloring agent, for example, C.I. Pigment Blue 1, 2, 3, 4, 5, 6, 7, 10, 11, 12, 13, 14, 15, 15:1, 15:2, 15:3, 15:4, 15:6, 16, 17, 23, 60, 65, 73, 83, or 180, C.I. Bat Cyan 1, 3, or 20, or the like, Prussian blue, cobalt blue, alkali blue lake, phthalocyanine blue, metal-free phthalocyanine blue, partially chlorinated phthalocyanine blue, fast sky blue, cyan pigment of indanthrene blue BC, a cyan dye such as C.I. Solvent Cyan 79 or 162, or the like can be used.

The cyan coloring agent may includes at least one selected from the group consisting of C.I. Pigment Blue 15:1 and C.I. Pigment Blue 15:3.

As the magenta coloring agent, for example, a magenta pigment such as C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 147, 150, 163, 176, 184, 185, 202, 206, 207, 209, 238, or 269, or the like, or Pigment Violet 19; a magenta dye such as C.I. Solvent Red 1, 3, 8, 23, 24, 25, 27, 30, 49, 81, 82, 83, 84, 100, 109, or 121, C.I. Disperse Red 9, C.I. Basic Red 1, 2, 9, 12, 13, 14, 15, 17, 18, 22, 23, 24, 27, 29, 32, 34, 35, 36, 37, 38, 39, or 40; Bengara, cadmium red, red lead, mercury sulfide, cadmium, Permanent Red 4R, lithol red, pyrazolone red, watching red, calcium salt, Lake Red D, Brilliant Carmine 6B, Eosin Lake, Rotomin Lake B, Alizarin Lake, Brilliant Carmine 3B, or the like may be used.

The magenta coloring agent may include at least one selected from the group consisting of C.I. Pigment Red 122, C.I. Pigment Red 185, and C.I. Pigment Red 238.

Further, as the yellow coloring agent, for example, a yellow pigment such as C.I. Pigment Yellow 2, 3, 15, 16, 17, 74, 97, 180, 185, or 139 may be used.

Further, other coloring agents include a black coloring agent such as carbon black (acetylene black, furnace black, thermal black, channel black, ketjen black), copper oxide, manganese dioxide, aniline black, titanium black, activated carbon, nonmagnetic ferrite, and magnetite; or a white coloring agent such as titanium oxide, barium sulfate, lead oxide, zinc oxide, lead titanate, potassium titanate, barium titanate, strontium titanate, zirconia, antimony trioxide, lead white, zinc sulfide, and barium carbonate.

The coloring agents may be used singly or in combination of two or more kinds thereof.

The coloring agent may use a surface-treated coloring agent, if necessary, or may be used in combination with a dispersant. Further, plural kinds of coloring agents may be used in combination.

The content of the coloring agent is, for example, is preferably from 1% by mass to 30% by mass, and is more preferably from 3% by mass to 15% by mass with respect to the entire toner particles.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is more preferably from 60° C. to 100° C.

Note that, the melting temperature is obtained from a DSC curve obtained by differential scanning calorimetry (DSC), using "melting peak temperature" described in the method of obtaining a melting temperature in JIS K-7121:1987 "testing methods for transition temperatures of plastics".

The content of the release agent is, for example, preferably from 1% by mass to 20% by mass, and is more preferably from 5% by mass to 15% by mass with respect to the entire toner particles.

—Other Additives—

Examples of other additives include well-known additives such as a magnetic material, a charge-controlling agent, and an inorganic powder. These additives are contained in the toner particle as internal additives.

—Properties of Toner Particles—

The toner particles may be toner particles having a single-layer structure, or toner particles having a so-called core • shell structure composed of a core (core particle) and a coating layer (shell layer) coated on the core.

Here, the toner particles having a core-shell structure may be configured to include a core formed of a binder resin and if necessary, other additives such as a coloring agent and a release agent, and a coating layer formed of a binder resin.

The volume average particle diameter (D50v) of the toner particles is preferably from 2 μm to 10 μm, and is more preferably from 4 μm to 8 μm.

In the exemplary embodiment, GSDv (90/50) of the toner particles is 1.26 or less, preferably equal to or less than 1.25, and more preferably equal to or less than 1.24. In addition, GSDv (90/50) of the toner particles may be equal to or more than 1.15. In a case where GSDv (90/50) of the toner particles exceeds 1.26, due to presence of low-charged coarse toner particles, transfer to a paper may become non-uniform, and thus a gradation property in a thin-layer halftone of multicolor may be decreased.

In the exemplary embodiment, GSDp (50/10) of the toner particles is 1.28 or less, preferably equal to or less than 1.27, and more preferably equal to or less than 1.25. In addition, GSDp (50/10) of the toner particles may be equal to or more than 1.16. In a case where GSDp (50/10) of the toner particles exceeds 1.28, due to presence of highly-charged fine toner particles, transfer to a paper may become non-uniform, and thus a gradation property in a thin-layer halftone of multicolor is decreased.

In the exemplary embodiment, GSDv (90/50)/GSDp (50/10) of the toner particles is of from 0.96 to 1.01, preferably from 0.97 to 1.01, and more preferably from 0.98 to 1.00. In a case where GSDv (90/50)/GSDp (50/10) of the toner particles is less than 0.96, due to presence of highly-charged toner particles, transfer to a paper may become non-uniform, and thus a gradation property in a thin-layer halftone of multicolor is decreased. In a case where GSDv (90/50)/GSDp (50/10) of the toner particles exceeds 1.01, due to presence of low-charged coarse toner particles, transfer to a paper may become non-uniform, and thus a gradation property in a thin-layer halftone of multicolor is decreased.

Various average particle diameters and various particle diameter distribution indices (GSDv (90/50) and GSDp (50/10)) of the toner particles are measured using a Coulter Multisizer II (manufactured by Beckman Coulter, Inc.) and ISOTON-II (manufactured by Beckman Coulter, Inc.) as an electrolytic solution.

In the measurement, a measurement sample from 0.5 mg to 50 mg is added to 2 ml of a 5% aqueous solution of surfactant (such as sodium alkylbenzene sulfonate) as a dispersant. The obtained material is added to the electrolytic solution from 100 ml to 150 ml.

The electrolytic solution in which the sample is suspended is subjected to a dispersion treatment using an ultrasonic dispersing machine for 1 minute, and a particle diameter distribution of particles having a particle diameter of from 2 μm to 60 μm is measured by a Coulter Multisizer II using an aperture having an aperture diameter of 100 μm. 50000 particles are sampled.

Cumulative distributions by volume and by number are drawn from a side of the smallest diameter, respectively, with respect to particle diameter ranges (channels) divided based on the measured particle diameter distribution. The particle diameter when the cumulative percentage becomes 10% is defined as a volume particle diameter D10v or a number particle diameter D10p. The particle diameter when the cumulative percentage becomes 50% is defined as a volume average particle diameter D50v or a number average particle diameter D50p. The particle diameter when the cumulative percentage becomes 90% is defined as a volume particle diameter D90v or a number particle diameter D90p.

Using these values, a volume particle diameter distribution index on a side of the largest diameter (GSDv (90/50)) is calculated as (D90v/D50v), and a number particle diameter distribution index (GSDp (50/10)) on a side of the smallest diameter (GSDp (50/10)) is calculated as (D50p/D10p).

In the exemplary embodiment, in a case of calculating the volume particle diameter distribution index on a side of the largest diameter, due to the following factors, D90v is used instead of D84v (particle diameter when the cumulative percentage becomes 84%) which is used for calculation of a volume particle diameter distribution index (GSDv (84/16)).

A gradation property in a halftone of multicolor to toner is affected even by a very small amount of coarse particles. Therefore, in order to more sensitively reflect the amount of coarse particles (toner particles with large particle diameter) contained in the toner particles to a value of volume particle diameter distribution index on a side of the largest diameter, a detailed check is made on D90v and a gradation property in the halftone of multicolor. As a result, there is a strong correlation between D90v and the halftone of multicolor.

Further, in the exemplary embodiment, in a case of calculating the number particle diameter distribution index on a side of the smallest diameter, for the following reason, D10p is used instead of D16p (particle diameter when the cumulative percentage becomes 16%) which is used for calculation of a number particle diameter distribution index (GSDp (84/16). A gradation property in a halftone of multicolor is affected even by a small amount of fine particles. Thus, the amount of fine particles (toner particles with small particle diameter) contained in the toner particles to a value of number particle diameter distribution index on a side of the smallest diameter is sensitively reflected. A detailed check is made on D10p and a gradation property in the halftone of multicolor. As a result, there is a strong correlation between DiOp and the halftone of multicolor.

The average circularity of the toner particles is from 0.95 to 1.00, and preferably from 0.95 to 0.98 and more preferably from 0.95 to 0.97 from the viewpoint of enhancing a cleaning property. In a case where the average circularity of the toner particles is less than 0.95, it is good from the viewpoint of the cleaning property. However, due to presence of unusual toner particles, the transferability to a paper may be non-uniform, and a gradation property in an image such as a halftone of multicolor may be decreased.

The average circularity of the toner particles is calculated by (circle equivalent circumference length)/(circumference length) [(circumference length of circle having the same area as the projection area of particle image)/(circumference length of the projected image of the particle)]. Specifically, the aforementioned value is measured by using the following method.

The average circularity of the toner particles is calculated by using a flow particle image analyzer (FPIA-3000 manufactured by Sysmex Corporation) which first, suctions and collects the toner particles to be measured so as to form flattened flow, then captures a particle image as a static image by instantaneously emitting strobe light, and then performs image analysis of the obtained particle image. 3,500 particles are sampled at the time of calculating the average circularity.

In a case where the toner has external additives, the toner (developer) to be measured is dispersed in water containing a surfactant, and then an ultrasonic treatment is performed so as to obtain toner particles from which external additives have been removed.

(External Additives)

Examples of the external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

A hydrophobizing treat may be performed on surfaces of the inorganic particles as an external additive. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by mass to 10 parts by mass with respect to 100 parts by mass of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

The amount of the external additive is, for example, preferably from 0.01% by mass to 5% by mass, and is more preferably from 0.01% by mass to 2.0% by mass with respect to the toner particles.

(Preparing Method of Toner)

Next, the preparing method of the toner of the exemplary embodiment will be described.

The toner of the exemplary embodiment is obtained by externally adding the external additive to the toner particles after preparing the toner particles.

The toner particles may be produced by using any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained by using the aggregation and coalescence method.

For example, the dissolution suspension method is a method of dispersing a solution, that has been prepared by dissolving or dispersing raw materials (binder resin, coloring agent, and the like) constituting the toner particles in an organic solvent capable of dissolving the binder resin, in an aqueous solvent containing a particle dispersant, and then removing the organic solvent to granulate the toner particles.

Further, the aggregation and coalescence method is a method of obtaining toner particles through an aggregation step of forming aggregates of raw materials (resin particles, coloring agents, and the like) constituting the toner particles, and a coalescence step of coalescing the aggregates.

Among these, toner particles containing a urea-modified polyester resin as a binder resin may be obtained by the dissolution suspension method as described below. In the following description of the dissolution suspension method, a method of obtaining toner particles containing an unmodified polyester resin and a urea-modified polyester resin as a binder resin is shown. However, the toner particles may contain only a urea-modified polyester resin as a binder resin.

[Oil Phase Solution Preparing Step]

An oil phase solution is prepared by dissolving or dispersing materials for toner particles, which include an unmodified polyester resin, a polyester prepolymer having an isocyanate group, an amine compound, a coloring agent, and a release agent, in an organic solvent (oil phase solution preparing step). This oil phase solution preparing step is a step of dissolving or dispersing the materials for toner particles in the organic solvent to obtain a mixed solution of toner materials.

Examples of the preparing method of oil phase solution include: 1) a method of dissolving or dispersing the toner materials in an organic solvent at once; 2) a method of kneading the toner materials in advance and then dissolving or dispersing the kneaded product in an organic solvent; 3) a method of dissolving an unmodified polyester resin, a polyester prepolymer having an isocyanate group, and an amine compound in an organic solvent and then dispersing a coloring agent and a release agent in the organic solvent; 4) a method of dispersing a coloring agent and a release agent in an organic solvent and then dissolving an unmodified polyester resin, a polyester prepolymer having an isocyanate group, and an amine compound in the organic solvent; (5) a method of dissolving or dispersing materials for toner particles (unmodified polyester resin, coloring agent, and release agent) other than a polyester prepolymer having an isocyanate group and an amine compound in an organic solvent and then dissolving the polyester prepolymer having an isocyanate group and the amine compound in the organic solvent; and (6) a method of dissolving or dispersing materials for toner particles (unmodified polyester resin, coloring agent, and release agent) other than a polyester prepolymer having an isocyanate group or an amine compound in an organic solvent and then dissolving the polyester prepolymer having an isocyanate group or the amine compound in the organic solvent. The method of preparing the oil phase solution is not limited thereto.

Examples of the organic solvent of the oil phase solution include an ester solvent such as methyl acetate and ethyl acetate; a ketone solvent such as methyl ethyl ketone and methyl isopropyl ketone; an aliphatic hydrocarbon solvent such as hexane and cyclohexane; and a halogenated hydrocarbon solvent such as dichloromethane, chloroform, and trichloroethylene. These organic solvents may dissolve the binder resin and have a ratio of being dissolved in water of about 0% by mass to 30% by mass, and may have a boiling point is equal to or lower than 100° C. Among these organic solvents, ethyl acetate is preferable.

[Suspension Preparing Step]

Next, the obtained oil phase solution is dispersed in an aqueous phase solution to prepare a suspension (suspension preparing step).

Together with preparing of the suspension, a reaction between the polyester prepolymer having an isocyanate group and the amine compound is carried out. By this reaction, a urea-modified polyester resin is generated. This reaction is accompanied by at least one of a crosslinking reaction and an elongation reaction of molecular chains. The reaction between the polyester prepolymer having an isocyanate group and the amine compound may be carried out together with a solvent removing step as described later.

Here, the reaction condition is selected depending on a reactivity of the isocyanate group structure of the polyester prepolymer with the amine compound. As an example, the reaction time is preferably from 10 minutes to 40 hours, and more preferably from 2 hours to 24 hours. The reaction temperature is preferably from 0° C. to 150° C., and more preferably from 40° C. to 98° C. A known catalyst (dibutyltin laurate, dioctyltin laurate, or the like) may be used if necessary for generating the urea-modified polyester resin. That is, a catalyst may be added to the oil phase solution or suspension.

Examples of the aqueous phase solution includes an aqueous phase solution obtained by dispersing a particle dispersant such as an organic particle dispersant and an inorganic particle dispersant in an aqueous solvent. In addition, examples of the aqueous phase solution may include an aqueous phase solution obtained by dispersing a particle dispersant in an aqueous solvent and dissolving a polymer dispersant in the aqueous solvent. A well-known additive such as a surfactant may be added to the aqueous phase solution.

The aqueous solvent includes water (for example, usually, ion exchange water, distilled water, or pure water). The aqueous solvent may be a solvent containing, together with water, an organic solvent such as alcohol (methanol, isopropyl alcohol, ethylene glycol, or the like), dimethylformamide, tetrahydrofuran, cellosolve (methyl cellosolve, or the like), lower ketones (acetone, methyl ethyl ketone, or the like).

Examples of the organic particle dispersant includes a hydrophilic organic particle dispersant. Examples of the organic particle dispersant include particles of poly(meth) acrylic alkyl ester resin (for example, polymethyl methacrylate resin), polystyrene resin, poly(styrene-acrylonitrile) resin, and the like. Examples of the organic particle dispersant also includes particles of styrene acrylic resin and the like.

Examples of the inorganic particle dispersant includes a hydrophilic inorganic particle dispersant. Specific examples of the inorganic particle dispersant include particles of silica, alumina, titania, calcium carbonate, magnesium carbonate, tricalcium phosphate, clay, diatomaceous earth, bentonite, and the like, and the particles of calcium carbonate are preferable. The inorganic particle dispersants may be used singly or in combination of two or more kinds thereof.

A surface of the particle dispersant may be surface-treated with a polymer having a carboxyl group.

Examples of the polymer having a carboxyl group includes a copolymer of at least one selected from salts (alkali metal salt, alkaline earth metal salt, ammonium salt, amine salt, and the like) obtained by neutralizing an α,β-monoethylenically unsaturated carboxylic acid or a carboxyl group of the α,β-monoethylenically unsaturated carboxylic acid with any one of an alkali metal, an alkaline earth metal, ammonia, amine, and the like, and an α,β-monoethylenically unsaturated carboxylic acid ester. The polymer having a carboxyl group also includes salts (alkali metal salt, alkaline earth metal salt, ammonium salt, amine salt, and the like) obtained by neutralizing a carboxyl group of a copolymer of the α,β-monoethylenically unsaturated carboxylic acid and the α,β-monoethylenically unsaturated carboxylic acid ester with any one of an alkali metal, an alkaline earth metal, ammonia, amine, and the like. The polymers having a carboxyl group may be used singly or in combination of two or more kinds thereof.

Typical examples of the α,β-monoethylenically unsaturated carboxylic acid include an α,β-unsaturated monocarboxylic acid (acrylic acid, methacrylic acid, crotonic acid, or the like), and an α,β-unsaturated dicarboxylic acid (maleic acid, fumaric acid, itaconic acid, or the like). In addition, typical examples of the α,β-monoethylenically unsaturated carboxylic acid ester include alkyl esters of (meth)acrylic acid, (meth)acrylates having an alkoxy group, (meth)acrylates having a cyclohexyl group, (meth)acrylates having a hydroxy group, and polyalkylene glycol mono(meth)acrylate.

Examples of the polymer dispersant includes a hydrophilic polymer dispersant. Examples of the polymer dispersant specifically includes a polymer dispersant which has a carboxyl group and does not have a lipophilic group (hydroxypropoxy group, methoxy group, or the like). For example, water soluble cellulose ether such as carboxymethyl cellulose and carboxyethyl cellulose are included.

In a case where the polymer dispersant is added at an increased addition rate, the polymer dispersant is locally present at a high concentration, and fine particles are easily generated. Therefore, by adding the polymer dispersant at a low concentration and at a decreased addition rate, generation of fine particles and coarse particles can be prevented.

[Solvent Removing Step]

Next, the organic solvent is removed from the obtained suspension to obtain a toner particle dispersion (solvent removing step). This solvent removing step is a step of removing the organic solvent which is contained in aqueous phase solution droplets dispersed in the suspension, to generate toner particles. Removal of the organic solvent from the suspension may be carried out immediately after the suspension preparing step or may be carried out after one minute or more has elapsed since completion of the suspension preparing step.

In the solvent removing step, by cooling or heating the obtained suspension to, for example, a range of 0° C. to 100° C., the organic solvent may be removed from the suspension.

Specific methods of organic solvent removal include the following methods. (1) A method of spraying an air stream to the suspension so that a gas phase on a surface of the suspension is forcibly renewed. In this case, gas may be blown into the suspension. (2) A method of reducing a pressure. In this case, the gas phase on the surface of the suspension may be forcibly renewed by gas filling, and gas may be further blown into the suspension.

In the organic solvent removal, it is preferable to blow gas into the suspension from the viewpoint that promotion of solvent removal and homogenization are achieved. In particular, multi sites at which gas is blown may be provided.

The toner particles are obtained through the foregoing steps.

Here, after completion of the solvent removing step, the toner particles formed in the toner particle dispersion are subjected to a washing step, a solid-liquid separation step, and a drying step, that are well known, to obtain toner particles in a dried state.

In the washing step, displacement washing with ion exchange water may be sufficiently performed from the viewpoint of chargeability.

Further, the solid-liquid separation step is not particularly limited, and suction filtration, pressure filtration, or the like may be performed from the viewpoint of productivity. In addition, there is also no particular limitation on the drying step with regard to a method therefor, and freeze drying, air stream drying, fluidized drying, vibration-type fluidized drying, or the like may be performed from the viewpoint of productivity.

Then, the toner according to the exemplary embodiment is produced, for example, by adding an external additive to the obtained toner particles in a dried state and mixing them.

The mixing may be carried out, for example, by a V-type blender, a Henschel mixer, a Loedige mixer, or the like.

Furthermore, if necessary, coarse particles of the toner may be removed by using a vibration classifier, a wind classifier, or the like.

The kneading and pulverizing method includes: mixing the respective materials such as a coloring agent; then molten kneading the materials using a kneader, an extruder, or the like; coarsely pulverizing the obtained molten-kneaded product; then pulverizing the resulting product with a jet mill or the like; and obtaining toner particles having a targeted particle diameter by using an air classifier.

More specifically, the kneading and pulverizing method is divided into a kneading step of kneading toner-forming materials containing a coloring agent and a binder resin and a pulverizing step of pulverizing the kneaded product. If necessary, other steps such as a cooling step of cooling the kneaded product formed by the kneading step may be included.

The respective steps related to the kneading and pulverizing method will be described in detail.

—Kneading Step—

In the kneading step, toner-forming materials containing a coloring agent and a binder resin are kneaded.

In the kneading step, it is preferable to add an aqueous medium (for example, water such as distilled water and ion exchange water, alcohols, or the like) in an amount from 0.5 parts by mass to 5 parts by mass with respect to 100 parts by mass of the toner-forming materials.

Examples of a kneader used in the kneading step include a single screw extruder and a twin screw extruder. Hereinafter, as an example of the kneader, a kneader having a feed screw portion and two kneading portions will be described with reference to the drawings, but the present invention is not limited thereto.

FIG. 1 is a diagram illustrating a state of a screw for an example of a screw extruder used for the kneading step in a preparing method of the toner according to the exemplary embodiment.

A screw extruder 11 includes a barrel 12 having a screw (not shown), an injection port 14 for injecting toner-forming materials as a raw material of toner into the barrel 12, a liquid addition port 16 for adding an aqueous medium to the toner-forming materials in the barrel 12, and a discharge port 18 for discharging the kneaded product formed by kneading the toner-forming materials in the barrel 12.

The barrel 12 is divided into, in order from a side closer to the injection port 14, a feed screw portion SA for transporting the toner-forming materials injected from the injection port 14 to a kneading portion NA; the kneading portion NA for molten kneading the toner-forming materials in a first kneading step; a feed screw portion SB for transporting the toner-forming materials melt-kneaded in the kneading portion NA to a kneading portion NB; the kneading portion NB for molten kneading the toner-forming materials in a second kneading step to form a kneaded product; and a feed screw portion SC for transporting the formed kneaded product to the discharge port 18.

Further, inside the barrel 12, different temperature control unit (not shown) are provided for the respective blocks. That is, a configuration in which blocks 12A to 12J may be controlled, respectively, with different temperatures is adopted. FIG. 1 shows a state in which the temperature of blocks 12A and 12B is controlled to t0° C., the temperature of blocks 12C to 12E is controlled to t1° C., and a temperature of blocks 12F to 12J is controlled to t2° C., respectively. Therefore, the toner-forming materials in the kneading portion NA are heated to t1° C., and the toner-forming materials in the kneading portion NB is heated to t2° C.

As described above, the temperature t1° C. in the kneading portion NA is of Ta−10° C. to Ta+10° C., and the temperature t2° C. in the kneading portion NB is of Tm−10° C. to Tm+20° C. In addition, the temperature of an endothermic peak in a case where the toner is measured by DSC is Ta, and the melting temperature in a case where the toner is similarly measured by DSC is Tm.

In a case where the toner-forming materials containing a binder resin, a coloring agent, and, if necessary, a release agent and the like are supplied to the barrel 12 from the injection port 14, the toner-forming materials are sent to the kneading portion NA by the feed screw portion SA. At this time, since the temperature of the block 12C is set to t1° C., the toner-forming materials are fed to the kneading portion NA in a state of being changed into a molten state by heating. The temperature of the blocks 12D and 12E is also set to t1° C. Thus, the toner-forming materials are melt-kneaded at the temperature of t1° C. in the kneading portion NA. The binder resin and the release agent become a molten state in the kneading portion NA and are sheared by a screw.

Next, the toner-forming materials kneaded in the kneading portion NA are sent to the kneading portion NB by the feed screw portion SB.

Then, in the feed screw portion SB, an aqueous medium is added to the toner-forming materials by injecting the aqueous medium into the barrel 12 from the liquid addition port 16. In addition, FIG. 1 shows an exemplary embodiment in which the aqueous medium is injected into the feed screw portion SB. However, the exemplary embodiment is not limited thereto, and the aqueous medium may be injected into the kneading portion NB, or the aqueous medium may be injected into both the feed screw portion SB and the kneading portion NB. That is, the position where the aqueous medium is injected and the number of injection sites are selected appropriately.

As described above, by injecting the aqueous medium into the barrel 12 from the liquid addition port 16, the toner-forming materials and the aqueous medium are mixed in the barrel 12, the toner-forming materials are cooled by latent heat of vaporization of the aqueous medium, and the temperature of the toner-forming materials is maintained.

Finally, the kneaded product formed by molten kneading in the kneading portion NB is transported to the discharge port 18 by the feed screw part SC and discharged from the discharge port 18.

In the manner described above, the kneading step using the screw extruder 11 and shown in FIG. 1 is carried out.

—Cooling Step—

The cooling step is a step of cooling the kneaded product formed in the kneading step. In the cooling step, the kneaded product may be cooled from the temperature at completion of the kneading step to equal to or lower than 40° C. at an average temperature lowering rate of equal to or more than 4° C./sec. In a case where a cooling rate of the kneaded product is slow, the additives (mixture of a coloring agent and, if necessary, an internal additive such as a release agent internally added to the toner particles) finely dispersed in the binder resin in the kneading step may be recrystallized to result in an increased dispersion diameter. On the other hand, in a case of being cooled rapidly at the average temperature lowering rate, a dispersed state immediately after completion of the kneading step is kept intact, which is preferable. The average temperature lowering rate is an average value of rates at which the kneaded product is cooled from the temperature at completion of the kneading step (for example, t2° C. in a case of using the screw extruder 11 in FIG. 1) to 40° C.

Specific examples of a cooling method in the cooling step include a method of using a rolling roll in which a cold water or brine is circulated, a sandwich type cooling belt, or the like. In a case where the cooling is performed by the above method, a cooling rate thereof is determined by a speed of the rolling roll, a flow rate of the brine, a supply amount of the kneaded product, a slab thickness at the time of rolling the kneaded product, and the like. The slab thickness may be as thin as a range from 1 mm to 3 mm.

—Pulverizing Step—

The kneaded product cooled by the cooling step is pulverized by a pulverizing step to form particles. In the pulverizing step, for example, a mechanical pulverizer, a jet type pulverizer, or the like is used. In addition, if necessary, the particles may be heat-treated with hot air or the like for spheroidizing.

—Classifying Step—

The particles obtained by the pulverizing step may be, if necessary, classified by a classifying step in order to obtain toner particles having a particle diameter distribution within a targeted range. In the classifying step, a centrifugal classifier, an inertial classifier, or the like used in the related art is used and fine particles (particles having a smaller particle diameter than the targeted range) and coarse particles (particles having a larger particle diameter than the targeted range) are removed.

—External Adding Step—

To the obtained toner particles, inorganic particles represented by silica, titania, and aluminum oxide may be added and attached, for the purpose of charge adjustment, provision of fluidity, provision of charge exchange property, and the like. These may be carried out, for example, by using a V-type blender, a Henschel mixer, a Loedige mixer, or the like, and attachment may be carried out in a stepwise manner.

—Sieving Step—

After the external adding step, a sieving step may be provided, if necessary. Specific examples of a sieving method include a gyro shifter, a vibration classifier, a wind classifier, and the like. By sieving, coarse particles and the like of the external additive are removed, and generation of streaks on a photoreceptor, blot contamination in an apparatus, and the like are prevented.

In the exemplary embodiment, an aggregation and coalescence method, in which a shape of toner particles and a particle diameter of the toner particles are easily controlled and a control range for a toner particle structure such as a core-shell structure is also wide, may be used.

Hereinafter, a preparing method of toner particles by the aggregation and coalescence method will be described in detail.

Specifically, for example, in a case where the toner particles are produced by the aggregation and coalescence method, the toner particles are produced through: a step of preparing a resin particle dispersion in which resin particles serving as a binder resin are dispersed (resin particle dispersion preparing step); a step of aggregating the resin particles (and other particles, if necessary) in the resin particle dispersion (in a dispersion after mixing with other particle dispersions, if necessary) to form aggregated particles (aggregated particle forming step); and a step of heating the aggregated particle dispersion in which the aggregated particles are dispersed and coalescing the aggregated particles to form toner particles (coalescing step).

Hereinafter, the respective steps will be described in detail.

In the following description, a method of obtaining toner particles including the coloring agent and the release agent will be described. The coloring agent and the release agent are optionally used. Other additives other than the coloring agent and the release agent may also be used.

—Resin Particle Dispersion Preparing Step—

First, together with a resin particle dispersion in which resin particles serving as a binder resin are dispersed, for example, a coloring agent particle dispersion in which coloring agent particles are dispersed and a release agent particle dispersion in which release agent particles are dispersed are prepared.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water; alcohols; and the like. The medium may be used singly or in combination of two or more kinds thereof.

Examples of the surfactant include anionic surfactants such as sulfuric ester salt, sulfonate, phosphoric ester, and soap anionic surfactants; cationic surfactants such as amine salt and quaternary ammonium salt cationic surfactants; and nonionic surfactants such as polyethylene glycol-based surfactants, alkyl phenol ethylene oxide adduct, and polyhydric alcohol. Among them, anionic surfactants and cationic surfactants are particularly preferable. Nonionic surfactants may be used in combination with anionic surfactants or cationic surfactants.

The surfactants may be used singly or in combination of two or more kinds thereof.

As a method of dispersing the resin particles in the dispersion medium of the resin particle dispersion, a common dispersing method by using, for example, a rotary shearing-type homogenizer, a ball mill having media, a sand mill, or a Dyno mill is exemplified. In addition, depending on a type of the resin particles, the resin particles may be dispersed in the resin particle dispersion using, for example, a phase inversion emulsification method.

The phase inversion emulsification method is a method of dispersing a resin in a particle form by dissolving a resin to be dispersed in a hydrophobic organic solvent in which the resin is soluble, conducting neutralization by adding a base to an organic continuous phase (O phase), and performing the conversion from W/O to O/W (so-called phase inversion) by adding an aqueous medium (W phase), to form discontinuous phases and dispersing the resin in the water medium in the form of particles.

The volume average particle diameter of the resin particles dispersed in the resin particle dispersion is, for example, preferably from 0.01 μm to 1 μm, is more preferably from 0.08 μm to 0.8 μm, and is still more preferably from 0.1 μm to 0.6 μm.

The volume average particle diameter of the resin particles is measured by drawing a cumulative distribution from the side of the smallest diameter for volume with respect to particle diameter ranges (channels) divided using the particle diameter distribution obtained by the measurement of a laser diffraction-type particle diameter distribution measuring device (for example, LA-700, manufactured by Horiba, Ltd.), and setting a particle diameter when the cumulative percentage becomes 50% with respect to the entire particles as a volume average particle diameter D50v. Note that, the volume average particle diameter of the particles in other dispersions is also measured in the same manner.

A particle diameter difference of the resin particles dispersed in the resin particle dispersion is preferably equal to or less than 80 nm, more preferably equal to or less than 70 nm, and still more preferably equal to or less than 60 nm. In a case where the particle diameter difference of the resin particles is equal to or less than 80 nm, a cohesive force of the resin particles becomes more uniform in the aggregated particle forming step. Thus, the particle diameter of the toner particles is made uniform, and GSDv (90/50) easily tends to be 1.26 or less, and GSDp (50/10) easily tends to be 1.28 or less.

Here, the particle diameter difference of the resin particles indicates a particle diameter difference between a 10% particle diameter and a 90% particle diameter in a case where the resin particle dispersion is measured by using Microtrack (Microtrac UPA 9340, manufactured by Nikkiso Co., Ltd.). In addition, in a case where a plurality of resin particle dispersions are mixed, the particle diameter difference indicates a particle diameter difference between a 10% particle diameter and a 90% particle diameter in a case where the mixed resin particle dispersion is measured by using Microtrack.

The content of the resin particles contained in the resin particle dispersion is, for example, preferably from 5% by mass to 50% by mass, and is more preferably of 10% by mass to 40% by mass.

The coloring agent particle dispersion and the release agent particle dispersion are also prepared, for example, in the same manner as in the case of the resin particle dispersion. That is, with regard to the volume average particle diameter of the particles, the dispersion medium, the dispersion method, and the content of the particles in the resin particle dispersion, the same applies to coloring agent particles dispersed in the coloring agent particle dispersion and release agent particles dispersed in the release agent particle dispersion.

The particle diameter of each of particles dispersed in the coloring agent particle dispersion or the release agent particle dispersion may exhibit a smaller particle diameter difference in a case of being mixed with the resin particle dispersion. The particle diameter difference between a 10% particle diameter and a 90% particle diameter is preferably equal to or less than 80 nm, more preferably equal to or less than 70 nm, and still more preferably equal to or less than 60 nm.

—Aggregated Particle Forming Step—

Next, the coloring agent particle dispersion and the release agent particle dispersion are mixed with the resin particle dispersion.

Then, in the mixed dispersion, the resin particles, the coloring agent particles, and the release agent particles are heteroaggregated to form aggregated particles having a diameter close to a target diameter of the toner particles and containing the resin particles, the coloring agent particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated to a temperature of a glass transition temperature (specifically, for example, from the glass transition temperature of the resin particles—30° C. to the glass transition temperature thereof—10° C.) of the resin particles to aggregate the particles dispersed in the mixed dispersion, thereby forming the aggregated particles.

In the aggregated particle forming step, for example, the aggregating agent may be added at room temperature (for example, 25° C. to 30° C.) while stirring of the mixed dispersion using a rotary shearing-type homogenizer, the pH of the mixed dispersion may be adjusted to be acidic (for example, the pH is from 2 to 5), the dispersion stabilizer may be added if necessary, and then the heating may be performed.

Further, before the heating is carried out, the pressure in a system may be reduced to a range from 60 kPa (abs) to 95 kPa (abs) to degass the inside of the system while stirring the system from 0.5 hrs to 2 hrs to reduce bubbles in the system. According to findings of the present inventors, presence of bubbles in the system may result in agglomerated particles larger than a central particle diameter due to aggregation caused by bubbles. In addition, although the cause is unclear, agglomerated particles smaller than the central particle diameter may be generated due to aggregation caused by bubbles. Therefore, it may be difficult to narrow a particle diameter distribution of the toner particles. By reducing bubbles in the system, the particle diameter distribution of the toner particles is easily narrowed.

Examples of the aggregating agent include a surfactant having an opposite polarity to the polarity of the surfactant used as the dispersant to be added to the mixed dispersion, an inorganic metal salt, and a divalent or more metal complex. In particular, in a case where a metal complex is used as the aggregating agent, the amount of the surfactant used is reduced and charging characteristics are enhanced.

An additive that forms a complex or a similar bond with a metal ion of the aggregating agent may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate; and an inorganic metal salt polymer such as poly aluminum chloride, poly aluminum hydroxide, and calcium polysulfide.

As the chelating agent, a water-soluble chelating agent may be used. Examples of the chelating agent include oxycarboxylic acid such as tartaric acid, citric acid, and gluconic acid; iminodiacid (IDA); nitrilotriacetic acid (NTA); and ethylenediaminetetraacetic acid (EDTA).

The additive amount of the chelating agent is, for example, preferably from 0.01 parts by mass to 5.0 parts by mass, and is more preferably equal to or greater than 0.1 parts by mass and less than 3.0 parts by mass, with respect to 100 parts by mass of resin particle.

—Coalescing Step—

Next, the aggregated particle dispersion in which the aggregated particles are dispersed is heated at, for example, a temperature that is equal to or higher than the glass transition temperature of the resin particle (for example, a temperature that is higher than the glass transition temperature of the resin particle by 10° C. to 30° C.) to coalesce the aggregated particle and form toner particles.

The toner particles are obtained through the foregoing steps.

Note that, the toner particles may be prepared through: a step of forming second aggregated particles in such a manner that an aggregated particle dispersion in which the aggregated particles are dispersed is obtained, then the aggregated particle dispersion and a resin particle dispersion in which the resin particles are dispersed are further mixed with each other, and aggregated such that the resin particles are further adhered on the surface of the aggregated particle; and a step of forming the toner particles having a core-shell structure by heating a second aggregated particle dispersion in which the second aggregated particles are dispersed, and coalescing the second aggregated particles.

In a case of forming the second aggregated particles, a rate of adding the resin particle dispersion may be increased. The rate of adding the resin particle dispersion in the case of forming the second aggregated particles is preferably from 80 parts by mass/minute to 500 parts by mass/minute, and more preferably from 100 parts by mass/minute to 300 parts by mass/minute, with respect to 500 parts by mass of the aggregated particle dispersion. In a case where the rate of adding the resin particle dispersion is from 80 parts by mass/minute to 500 parts by mass/minute, the resin particles are uniformly dispersed in the system. As a result, a particle diameter of the aggregated particles is made uniform, and a particle diameter distribution of the toner particles is easily narrowed.

Here, after the coalescing step, the toner particles formed in the solution are subjected to a washing step, a solid-liquid separation step, and a drying step, that are well known, and thus dry toner particles are obtained.

In the washing step, displacement washing with ion exchange water is sufficiently performed from the viewpoint of chargeability. Further, the solid-liquid separation step is not particularly limited, and suction filtration, pressure filtration, or the like may be performed from the viewpoint of productivity. In addition, there is also no particular limitation on the drying step with regard to a method therefor, and freeze drying, air stream drying, fluidized drying, vibration-type fluidized drying, or the like may be performed from the viewpoint of productivity.

Then, the toner according to the exemplary embodiment is produced, for example, by adding an external additive to the obtained toner particles in a dried state and mixing them. The mixing may be carried out, for example, by a V-type blender, a Henschel mixer, a Loedige mixer, or the like. Furthermore, if necessary, coarse particles of the toner may be removed by using a vibration classifier, a wind classifier, or the like.

—Aeration Fluidity Energy—

In the toner of the exemplary embodiment, an aeration fluidity energy measured at a first measurement by using a powder rheometer under a condition that a tip speed of a rotary blade is 100 mm/sec, an entrance angle of the rotary blade is −5°, and an aeration flow rate is 5 ml/min is preferably from 100 mJ to 300 mJ, more preferably from 100 mJ to 250 mJ, and still more preferably from 100 mJ to 200 mJ. In a case where the aeration fluidity energy is from 100 mJ to 300 mJ, a minute transfer becomes possible because the fluidity of the toner is further enhanced. As a result, a gradation property in a halftone image of multicolor becomes better.

In the toner of the exemplary embodiment, a ratio of the aeration fluidity energy at an aeration flow rate of 5 ml/min to the aeration fluidity energy at an aeration flow rate of 80 ml/min ((the aeration fluidity energy at an aeration flow rate of 5 ml/min)/(the aeration fluidity energy at an aeration flow rate of 80 ml/min)) is preferably from 3 to 8, more preferably from 3 to 7, and still more preferably from 3 to 6. In a case where the ratio ((the aeration fluidity energy at an aeration flow rate of 5 ml/min)/(the aeration fluidity energy at an aeration flow rate of 80 ml/min)) is from 3 to 8, the gradation property is further enhanced when a halftone image of multicolor is formed after forming a toner image with a high image density.

Next, a method for measuring fluidity by using a powder rheometer will be described.

The powder rheometer is a fluidity measuring device for simultaneously measuring a rotational torque and a vertical load obtained by spiral rotation of a rotary blade in filled particles, thereby directly obtaining a fluidity. By measuring both the rotational torque and the vertical load, a fluidity including characteristics of powders themselves and an influence of an external environment is detected with high sensitivity. In addition, measurement is carried out with a filling state of particles being kept constant. Thus, data with good reproducibility are obtained.

Measurement is carried out by using FT4 manufactured by Freeman Technology Ltd. as a powder rheometer. In order to eliminate an influence of temperature and humidity before the measurement, a developer (or toner) is kept for equal to or more than 8 hours at a temperature of 25° C. and a humidity of 45% RH and used.

First, a split vessel having an inner diameter of 25 mm (25 mL vessel having a height of 61 mm with a cylinder having a height of 22 mm being placed thereon so that they can be vertically separated) is filled with a developer (or toner) in an amount exceeding 61 mm in height.

After filling the developer (or toner), the filled developer (or toner) is gently stirred to perform an operation of homogenizing a sample. This operation is referred to as conditioning below.

In the conditioning, the rotary blade is gently stirred in a rotation direction which does not receive a resistance from the toner so as not to give stress to the developer (or toner) in a filled state, and most of excessive air and partial stress are removed to make the sample homogeneous. Specifically, the conditioning is performed to stir an inside of the vessel from a height of 70 mm from the bottom to a height of 2 mm from the bottom, at a tip speed of a rotary blade of 40 mm/sec and at an entrance angle of 5°.

At this time, a propeller-type rotary blade also moves downward at the same time of rotation. Thus, the tip draws a spiral, and the angle of a spiral path drawn by the tip of the propeller at this time is called an entrance angle.

After repeating the conditioning operation four times, a vessel upper end of the split vessel is gently moved, and the developer (or toner) inside the vessel is torn off at a height of 61 mm to obtain a toner filling the 25 mL vessel. The reason why the conditioning operation is carried out is that in order to stably obtain the amount of fluidity energy, it is important to always obtain stable powders with constant volume.

Furthermore, after performing the conditioning operation once, the rotational torque and the vertical load are measured in a case where the entrance angle is moved to −5° while rotating the rotary blade at a tip speed of 100 mm/sec in the inside of the vessel from a height of 55 mm from the bottom to a height of 2 mm from the bottom. A rotational direction of the propeller at this time is opposite to the conditioning (clockwise as viewed from above).

Figure 2A:
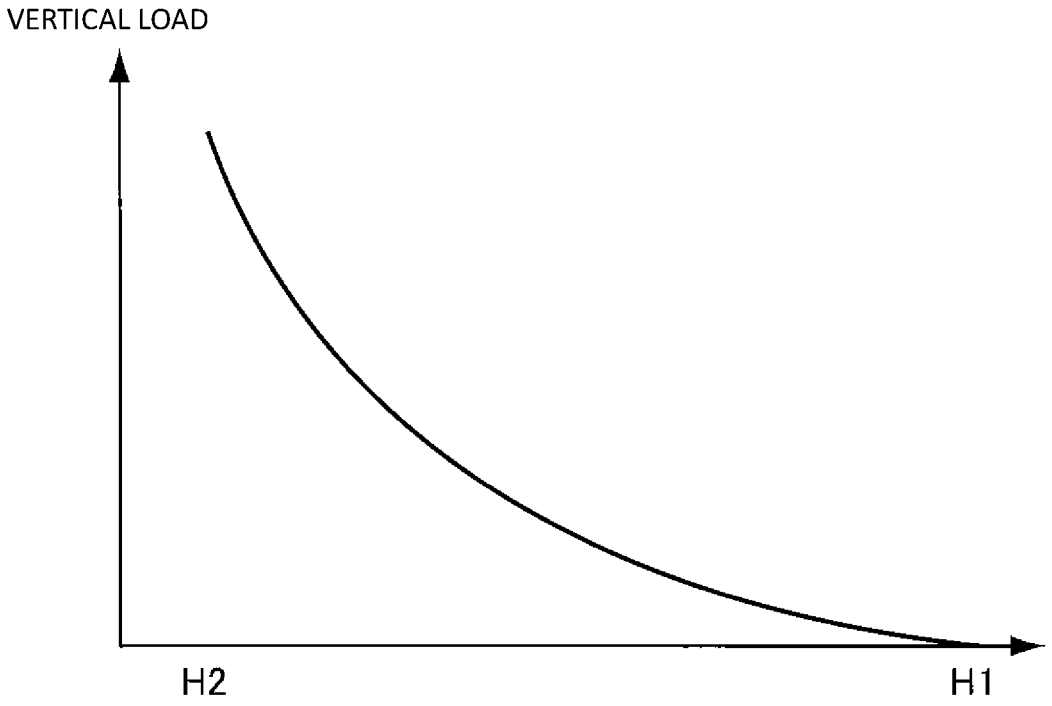
FIGS. 2A and 2B show graphs for illustrating a method for measuring the amount of fluidity energy by using a powder rheometer.
Figure 2B:
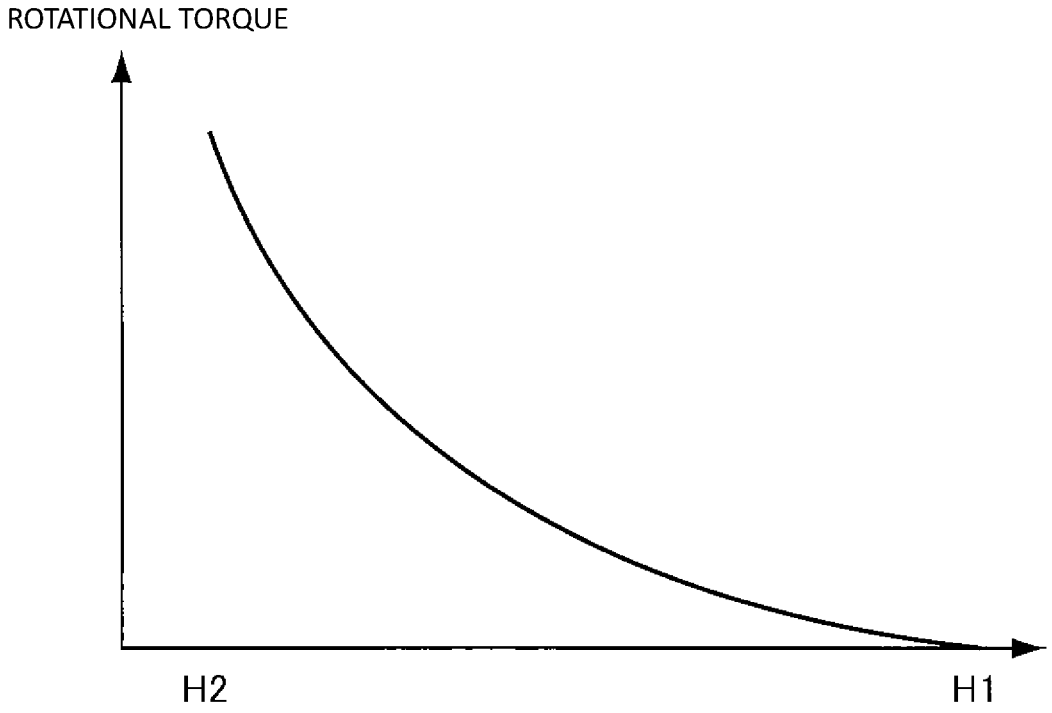
Figure 3:
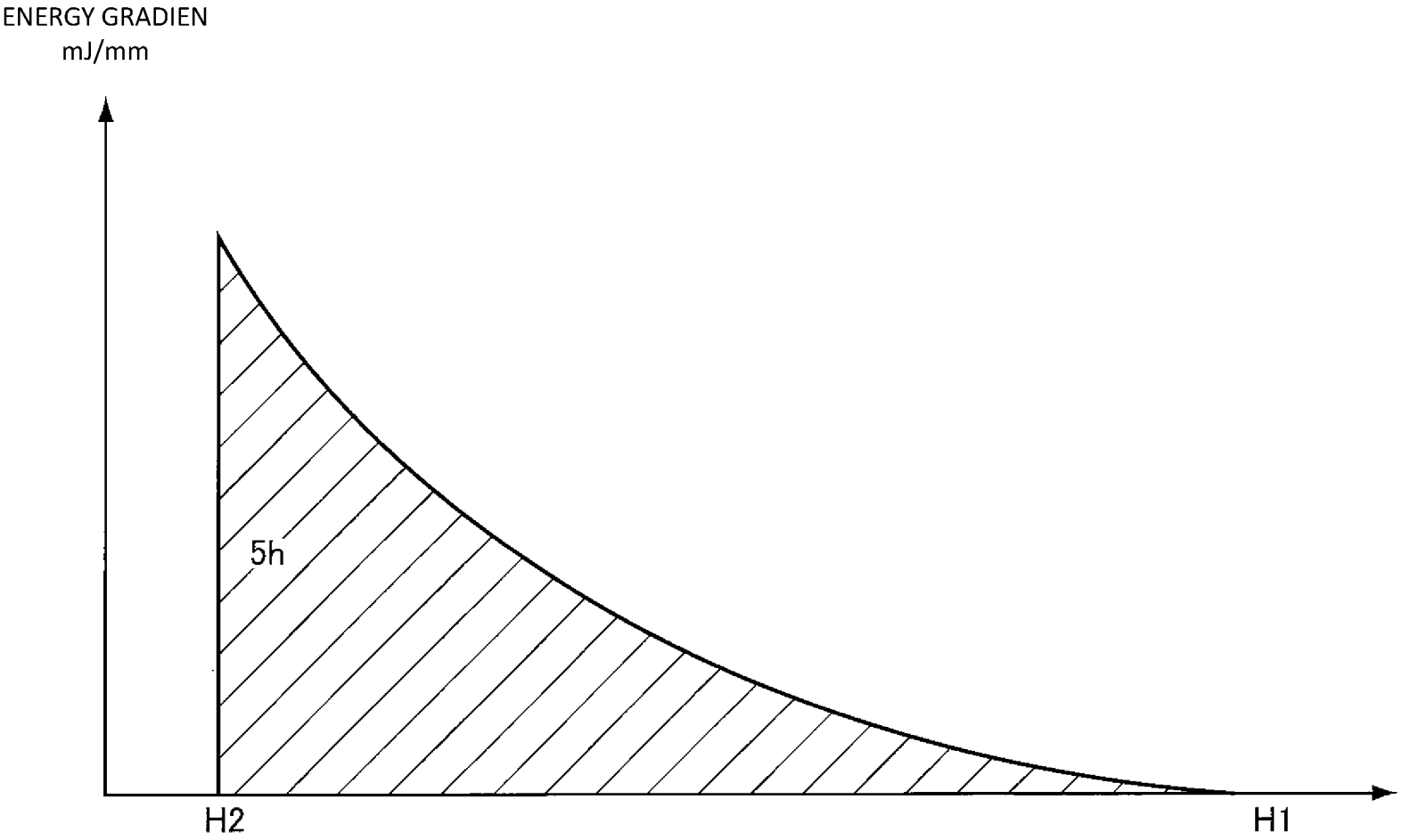
FIG. 3 is a graph showing a relationship between a vertical load and an energy gradient, obtained by using a powder rheometer.

FIGS. 2A and 2B show a relationship between the rotational torque and the vertical load with respect to a height H from the bottom. FIG. 3 shows an energy gradient (mJ/mm) obtained from the rotational torque and the vertical load with respect to the height H. An area (hatched area in FIG. 3) obtained by integrating the energy gradient in FIG. 3 is a fluidity energy amount (mJ). The amount of fluidity energy is calculated by integrating a section from a height of 2 mm from the bottom to a height of 55 mm from the bottom.

In addition, in order to reduce an influence due to errors, this cycle of conditioning and energy measurement operation is performed five times and an average value of the amounts of fluidity energy measured is taken as the fluidity energy amount (mJ).

Figure 4:
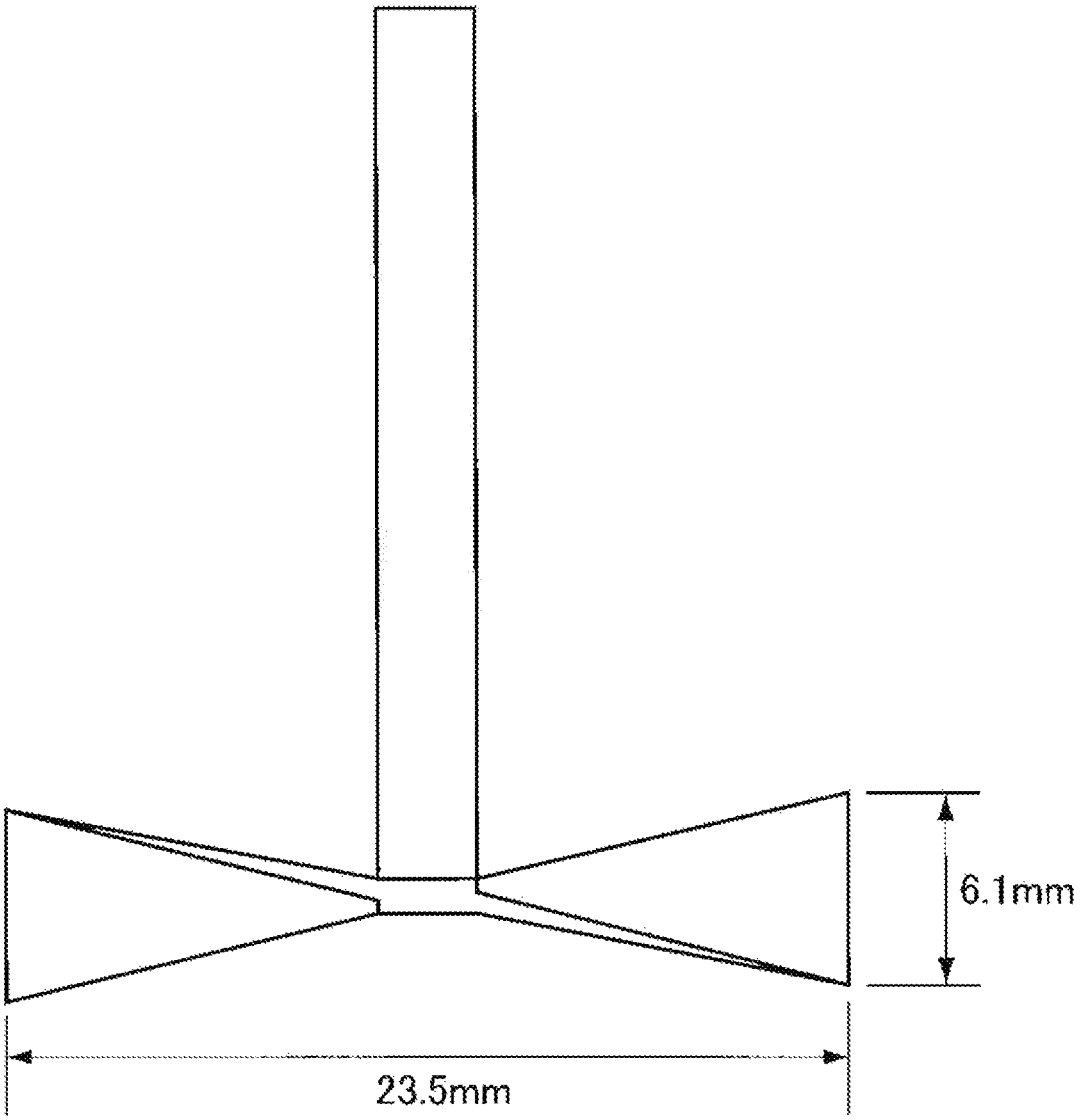
FIG. 4 is a schematic view for illustrating a shape of a rotary blade used in a powder rheometer.

The rotary blade is a two-blade propeller type of φ23.5 mm diameter shown in FIG. 4, manufactured by Freeman Technology Ltd.

In a case of measuring the rotational torque and the vertical load of the rotary blade, the amount of fluidity energy measured while flowing air at a targeted aeration flow rate (ml/min) from the bottom of the vessel is the "amount of aeration fluidity energy", and the amount of fluidity energy measured without aeration from the bottom of the vessel, that is, measured at an aeration flow rate of 0 ml/min is the "amount of basic fluidity energy". In FT 4 manufactured by freeman technology Co., the inflow state of the aeration amount is controlled.

<Toner Set>

The toner set according to the exemplary embodiment includes n kinds (n is an integer of equal to or more than 2) of electrostatic charge image developing toners which exhibit different colors from each other, in which at least one kind of the electrostatic charge image developing toners contains toner particles having a volume particle diameter distribution index on a side of the largest diameter (GSDv (90/50)) of 1.26 or less, a number particle diameter distribution index on a side of the smallest diameter (GSDp (50/10)) of 1.28 or less, GSDv (90/50)/GSDp (50/10) of from 0.96 to 1.01, and an average circularity from 0.95 to 1.00. That is, the toner set according to the exemplary embodiment includes n kinds (n is an integer of equal to or more than 2) of electrostatic charge image developing toners which exhibit different colors from each other, in which at least one of the electrostatic charge image developing toners is the toner according to the exemplary embodiment.

In the toner set according to the exemplary embodiment, it is preferable that all of the electrostatic charge image developing toners are the toner according to the exemplary embodiment.

In the toner set according to the exemplary embodiment, in a case where all of the electrostatic charge image developing toners are the toner according to the exemplary embodiment, a difference between the maximum value and the minimum value of the aeration fluidity energy at an aeration flow rate of 5 ml/min for each electrostatic charge image developing toner (that is, an absolute value of a difference between an aeration fluidity energy for the toner having the highest value of the aeration fluidity energy and an aeration fluidity energy for the toner having the lowest value of the aeration fluidity energy), measured by using a powder rheometer under a condition that a tip speed of a rotary blade is 100 mm/sec, an entrance angle of the rotary blade is −5°, and an aeration flow rate is 5 ml/min, is preferably equal to or less than 80 mJ, more preferably equal to or less than 60 mJ, and still more preferably equal to or less than 50 mJ. In a case where the difference between the maximum value and the minimum value of the aeration fluidity energy is equal to or less than 80 mJ, a gradation property in the halftone image of multicolor becomes better.

Second Exemplary Embodiment

Hereinafter, an electrostatic charge image developing toner and a toner set according to a second exemplary embodiment will be described. A description of the same configuration as the first exemplary embodiment will be omitted.

<Electrostatic Charge Image Developing Toner>

The electrostatic charge image developing toner according to the exemplary embodiment contains toner particles having a volume particle diameter distribution index on a side of the largest diameter (GSDv (90/50)) of equal to or more than 1.26, a number particle diameter distribution index on a side of the smallest diameter (GSDp (50/10)) of 1.28 or less, an average circularity from 0.95 to 1.00, and a circularity distribution index on a side of the irregular shape (GSD (50/10)) of equal to or less than 1.03.

According to the electrostatic charge image developing toner of the exemplary embodiment, an image unevenness in the halftone image of multicolor is prevented.

In the present invention, "image unevenness in a halftone image of multicolor" is determined by a magnitude of color difference ΔE in a halftone region of multicolor of a toner image (halftone image of multicolor) at least part of which has the halftone region of multicolor. The image unevenness is determined to be large for a halftone image of multicolor of which a variation in the color difference ΔE is relatively large. The image unevenness is determined to be small for a halftone image of multicolor of which a variation in the color difference ΔE is relatively small. The reason is not clear, but it is presumed as follows.

In a configuration of the halftone image of multicolor, at least two colors of toner form a thin toner layer on a recording medium. In order to prevent variations in the halftone image of multicolor, it is necessary to uniformly distribute toners of at least two colors on the entire recording medium to form a toner layer.

The toner according to the exemplary embodiment contains toner particles having GSDv (90/50) of equal to or more than 1.26, GSDp (50/10) of 1.28 or less, an average circularity from 0.95 to 1.00, and GSD (50/10) of equal to or less than 1.03. Thus, such toner exhibits a particle diameter distribution in which a distribution of the toner particles on a side of the largest diameter is broader than a volume average particle diameter (D50v), as compared with toner particles of the related art. In addition, a distribution of a circularity of the toner particles on a side of the irregular shape is narrow as compared with toner particles of the related art. Such toner particles have a high fluidity in a developing device, and particularly have an excellent fluidity after forming a toner image with a high image density under a high temperature and high humidity environment. In a case where the toner particles have a high fluidity in the developing device, a toner layer in which the toner is uniformly dispersed on the entire recording medium is easily formed. As a result, it is presumed that an image unevenness in the halftone image of multicolor is prevented. The toner according to the exemplary embodiment is excellent in preventing an image unevenness in a toner image in a case where a halftone image of multicolor is formed after forming the toner image with a high image density, particularly under a high temperature and high humidity environment.

Similarly to the toner according to the first exemplary embodiment, the toner according to the second exemplary embodiment is configured to include toner particles and, if necessary, an external additive.

In the second exemplary embodiment, GSDv (90/50) of the toner particles is equal to or more than 1.26, preferably equal to or more than 1.28, and more preferably equal to or more than 1.30. In a case where GSDv (90/50) of the toner particles is less than 1.26, a fluidity of the toner particles may deteriorate and an image unevenness in the halftone image of multicolor may occur. GSDv (90/50) of the toner particles may be 1.45 or less.

In the second exemplary embodiment, GSDp (50/10) of the toner particles is 1.28 or less, preferably 1.26 or less, and more preferably equal to or less than 1.24. In a case where GSDp (50/10) of the toner particles exceeds 1.28, a fluidity of the toner particles may deteriorate and an image unevenness in the halftone image of multicolor may occur. GSDp (50/10) of the toner particles may be equal to or more than 1.10.

An average circularity of the toner particles is from 0.95 to 1.00, preferably from 0.95 to 0.985, more preferably from 0.955 to 0.985, and still more preferably from 0.955 to 0.980, from the viewpoint of enhancing a cleaning property. In a case where the average circularity of the toner particles is less than 0.95, a fluidity of the toner particles may deteriorate and an image unevenness in the halftone image of multicolor may occur.

In the exemplary embodiment, the circularity distribution index on a side of the irregular shape (GSD (50/10)) is a value calculated as follows by drawing a cumulative distribution from a side of the small circularity based on the circularity of each of toner particles measured by a method as described later.

In the cumulative distribution from the side of the small circularity of each of the toner particles, a circularity when the cumulative percentage becomes 10% is defined as D10, and a circularity when the cumulative percentage becomes 50% is defined as D50. Using these, the circularity distribution index on the side of irregular shape (GSD (50/10)) is calculated as D50/D10.

GSD (50/10) of the toner particles is equal to or less than 1.03, preferably equal to or less than 1.025, and more preferably equal to or less than 1.02. In a case where GSD (50/10) exceeds 1.03, a fluidity of the toner particles may deteriorate and an image unevenness in the halftone image of multicolor may occur. GSD (50/10) of the toner particles may be equal to or more than 1.00.

The toner particles of the exemplary embodiment may have a volume particle diameter distribution index on a side of the largest diameter (GSDv (90/50)) of equal to or more than 1.28, a number particle diameter distribution index on a side of the smallest diameter (GSDp (50/10)) of 1.28 or less, an average circularity from 0.955 to 0.985, and a circularity distribution index on a side of the irregular shape (GSD (50/10)) of equal to or less than 1.03.

As described above, the toner particles according to the exemplary embodiment exhibit a particle diameter distribution in which a distribution of the toner particles on a side of the largest diameter is broader than a volume average particle diameter (D50v), as compared with toner particles of the related art. In addition, a distribution of a circularity of the toner particles on a side of the irregular shape is narrow as compared with toner particles of the related art. It may be difficult to form toner particles exhibiting such physical properties in one aggregated particle forming step. In a case of producing the toner particles according to the exemplary embodiment, a plural kinds of aggregated particles may be formed through at least two aggregated particle forming steps which are different in an stirring speed of a mixed dispersion, a temperature rise rate (° C./min) upon heating the mixed dispersion, and the like, and mixed, and subjected to a coalescing step as described later.

For example, by increasing the stirring speed of the mixed dispersion, a circularity of the aggregated particles is easily increased. By decreasing the stirring speed of the mixed dispersion, the circularity of the aggregated particles is easily decreased. By increasing the rate of temperature rise upon heating the mixed dispersion, the circularity of the aggregated particles is easily decreased. By decreasing the temperature rise rate upon heating the mixed dispersion, the circularity of the aggregated particles is easily increased. Therefore, by controlling the stirring speed of the mixed dispersion or the temperature rise rate upon heating the mixed dispersion, and the particle diameter of the aggregated particles, it is possible to obtain a toner having a desired particle diameter distribution and circularity.

—Aeration Fluidity Energy—

In the toner of the exemplary embodiment, a basic fluidity energy measured by using a powder rheometer under a condition that a tip speed of a rotary blade is 100 mm/sec, an entrance angle of the rotary blade is −5°, and an aeration flow rate is 0 ml/min is preferably from 100 mJ to 250 mJ, more preferably from 110 mJ to 230 mJ, and still more preferably from 120 mJ to 210 mJ. In a case where the aeration fluidity energy is from 100 mJ to 250 mJ, a minute transfer becomes possible because a fluidity of the toner is further enhanced. As a result, an image unevenness in the halftone image of multicolor is further prevented.

In the toner of the exemplary embodiment, the aeration fluidity energy measured by using a powder rheometer under a condition that the tip speed of the rotary blade is 100 mm/sec, the entrance angle of the rotary blade is −5° and the aeration flow rate is 80 ml/min is preferably equal to or less than 40 mJ, more preferably equal to or less than 35 mJ, and still more preferably equal to or less than 30 mJ. In a case where the aeration fluidity energy is equal to or less than 40 mJ, an image unevenness in the halftone image of multicolor is further prevented in a case of forming the halftone image of multicolor after forming a toner image with a high image density.

<Toner Set>

The toner set according to the exemplary embodiment has n kinds (n is an integer of equal to or more than 2) of electrostatic charge image developing toners which exhibit different colors from each other, in which at least one of the electrostatic charge image developing toners contains toner particles having a volume particle diameter distribution index on a side of the largest diameter (GSDv (90/50)) of 1.26 or less, a number particle diameter distribution index on a side of the smallest diameter (GSDp (50/10)) of 1.28 or less, an average circularity from 0.95 to 1.00, and a circularity distribution index on a side of the irregular shape (GSD (50/10)) of equal to or less than 1.03. That is, the toner set according to the exemplary embodiment includes n kinds (n is an integer of equal to or more than 2) of electrostatic charge image developing toners which exhibit different colors from each other, in which at least one of the electrostatic charge image developing toners is the toner according to the exemplary embodiment.

In the toner set according to the exemplary embodiment, it is preferable that all of the electrostatic charge image developing toners are the toner according to the exemplary embodiment.

In the toner set according to the exemplary embodiment, in a case where all of the electrostatic charge image developing toners are the toner according to the exemplary embodiment, a difference between the maximum value and the minimum value of the basic fluidity energy for each electrostatic charge image developing toner (that is, an absolute value of a difference between a basic fluidity energy for the toner having the highest value of the basic fluidity energy and a basic fluidity energy for the toner having the lowest value of the basic fluidity energy), measured by using a powder rheometer under a condition that a tip speed of a rotary blade is 100 mm/sec, an entrance angle of the rotary blade is −5°, and an aeration flow rate is 0 ml/min, is preferably equal to or less than 50 mJ, more preferably equal to or less than 40 mJ, and still more preferably equal to or less than 30 mJ. In a case where the difference between the maximum value and the minimum value of the basic fluidity energy is equal to or less than 50 mJ, an image unevenness in the halftone image of multicolor is further prevented.

Third Exemplary Embodiment

Hereinafter, an electrostatic charge image developing toner and a toner set according to the third exemplary embodiment will be described. A description of the same configuration as the first exemplary embodiment will be omitted.

<Electrostatic Charge Image Developing Toner>

The electrostatic charge image developing toner according to the third exemplary embodiment (hereinafter, simply referred to as a "toner" in some cases) contains toner particles having a volume particle diameter distribution index on a side of the largest diameter (GSDv (90/50)) from 1.20 to 1.40, a number particle diameter distribution index on a side of the smallest diameter (GSDp (50/10)) of equal to or more than 1.30, GSDv (90/50)/GSDp (50/10) of equal to or less than 0.93, and an average circularity from 0.94 to 1.00.

The electrostatic charge image developing toner according to the third exemplary embodiment scarcely scatters. The reason is not clear, but it is presumed as follows.

In a case where an image is output under a stress state of high temperature/high humidity/high speed, as described above, a fluidity of the toner deteriorates and stirring in a developing device becomes insufficient. Thus, a low-charged toner may be generated in a case of outputting the image. In the present invention, the stress status of high temperature/high humidity/high speed means that an image forming environment is at equal to or higher than 28° C. and a relative humidity of equal to or higher than 80%, and an image forming speed (process speed) of equal to or more than 400 mm/sec.

The toner according to the third exemplary embodiment contains toner particles having GSDv (90/50) from 1.20 to 1.40, GSDp (50/10) of equal to or more than 1.30, GSDv (90/50)/GSDp (50/10) of equal to or less than 0.93, and an average circularity from 0.94 to 1.00. Thus, such toner exhibits a particle diameter distribution in which a distribution of the toner particles on a side of the smallest diameter is broader than a volume average particle diameter (D50v), as compared with toner particles of the related art. In such toner particles, a ratio of fine toner particles which occupy the entire toner particles is relatively high. The fine toner particles exert a function as a spacer in the same manner as an external additive externally added to the toner particles. Therefore, in the toner according to the third exemplary embodiment, even in a case where the image is output under a stress state of high temperature/high humidity/high speed, a fluidity of the toner hardly deteriorates and stirring in a developing device hardly becomes insufficient. As the toner is stirred in the developing device, low-charged toner is hardly generated. As a result, it is presumed that the toner scarcely scatters.

Similarly to the toner according to the first exemplary embodiment, the toner according to the third exemplary embodiment is configured to include toner particles and, if necessary, an external additive.

(Toner Particles)

Similarly to the first exemplary embodiment, the toner particles are, for example, configured to include a binder resin, and, if necessary, a coloring agent, a release agent, and other additives.

As the binder resin, a resin having an acid value from 8.0 mg KOH/g to 18.0 mg KOH/g is preferable. The acid value of the resin is more preferably from 9.0 mg KOH/g to 17.0 mg KOH/g, and still more preferably from 10.0 mg KOH/g to 16.0 mg KOH/g.

The toner particles contain a release agent as described later and a resin having an acid value from 8.0 mg KOH/g to 18.0 mg KOH/g as a binder resin. Thus, due to the reason of compatibility with the release agent, a proportion of the release agent occupying a surface of fine toner particles is increased and a proportion of the resin is easily decreased. By increasing the ratio of the release agent occupying the surface of the toner particles, moisture absorption on the surface of the toner particles is prevented. Therefore, it is thought that fluidity of fine toner particles that can exhibit a function as a spacer is easily ensured, and a fluidity of the toner at high temperature and high humidity is enhanced. As the fluidity of the toner is enhanced, the toner is easily stirred in the developing device, and as a result, it is presumed that scattering of the toner is further prevented.

The acid value of the resin is measured according to JIS K-0070:1992.

As the resin having an acid value from 8.0 mg KOH/g to 18.0 mg KOH/g, a polyester resin is suitable. As the polyester resin, the same polyester resin as in the first exemplary embodiment can be used.

—Coloring Agent—

As the coloring agent, similarly to the first exemplary embodiment, one known in the related art which corresponds to a color of toner can be used.

Scattering of toner, which is thought to be caused by deteriorated fluidity, is noticeable with a toner exhibiting a color which is easily visually recognized. Therefore, as the toner according to the third exemplary embodiment, it is preferable that the toner is a magenta toner exhibiting a magenta color or a cyan toner exhibiting a cyan color, which is easily visually recognized.

Further, by preventing the scattering of the magenta toner exhibiting a magenta color or the cyan toner exhibiting a cyan color, which is easily visually recognized, reproducibility of single color halftone is enhanced.

The cyan coloring agent may include at least one selected from the group consisting of Pigment Blue, Phthalocyanine Blue, and Solvent Cyan.

The magenta coloring agent may include at least one selected from the group consisting of Pigment Red, Pigment Violet, and Basic Red.

In the third exemplary embodiment, GSDv (90/50) of the toner particles is from 1.20 to 1.40, preferably from 1.25 to 1.38, and more preferably from 1.30 to 1.35. In a case where GSDv (90/50) of the toner particles is less than 1.20, a fluidity may be deteriorated due to lack of voids between the toners. In addition, in a case where GSDv (90/50) of the toner particles exceeds 1.40, a poor transfer may occur due to variations in charge distribution per toner particle caused by coarse particles.

In the third exemplary embodiment, GSDp (50/10) of the toner particles is equal to or more than 1.30, preferably equal to or more than 1.35, and more preferably equal to or more than 1.38. In addition, GSDp (50/10) of the toner particles may be equal to or less than 1.50. In a case where GSDp (50/10) of the toner particles is less than 1.30, a fluidity may be deteriorated due to lack of voids between the toners.

In the third exemplary embodiment, GSDv (90/50)/GSDp (50/10) of the toner particles is equal to or less than 0.93, preferably equal to or less than 0.92, and more preferably equal to or less than 0.90. In addition, GSDv (90/50)/GSDp (50/10) of the toner particles may be equal to or more than 0.85. In a case where GSDv (90/50)/GSDp (50/10) of the toner particles exceeds 0.93, a poor transfer may be occur due to variations in charge distribution per toner particle caused by coarse particles.

In the third exemplary embodiment, in a case of calculating the volume particle diameter distribution index on a side of the largest diameter, the reason why D90v is used instead of D84v (particle diameter when the cumulative percentage becomes 84%) which is used for calculation of a volume particle diameter distribution index (GSDv (84/16) is to more sensitively reflect the amount of coarse particles (toner particles with large particle diameter) contained in the toner particles to a value of volume particle diameter distribution index on a side of the largest diameter.

Further, in the third exemplary embodiment, in a case of calculating the number particle diameter distribution index on a side of the smallest diameter, the reason why D10p is used instead of D16p (particle diameter when the cumulative percentage becomes 16%) which is used for calculation of a number particle diameter distribution index (GSDp (84/16) is to more sensitively reflect the amount of coarse particles (toner particles with large particle diameter) contained in the toner particles to a value of number particle diameter distribution index on a side of the smallest diameter.

The average circularity of the toner particles is from 0.94 to 1.00, preferably from 0.95 to 1.00, and more preferably from 0.96 to 1.00, from the viewpoint of enhancing a cleaning property. In a case where the average circularity of the toner particles is less than 0.94, stress on a cleaning blade is large and a blade failure may occur.

The average circularity for toner particles having a particle diameter of 0.1 to 0.5 times a volume average particle diameter (D50v) of the toner particles is preferably from 0.96 to 1.00, more preferably from 0.97 to 1.00, and still more preferably from 0.98 to 1.00. The toner particles having a particle diameter of 0.1 to 0.5 times a volume average particle diameter (D50v) of the toner particles correspond to so-called fine toner particles. The fact that the average circularity for the fine toner particles is from 0.96 to 1.00 indicates that a shape of the fine toner particles is substantially spherical. In a case where the shape of the fine toner particles is substantially spherical, a function as a spacer is easily exerted. As a result, it is presumed that a fluidity of the toner is enhanced and scattering of the toner is further prevented.

The average circularity of toner particles having a particle diameter of 0.1 to 0.5 times the volume average particle diameter (D50v) of the toner particles is measured in the same manner as the average circularity as described above.

In the toner particle of the third exemplary embodiment, it is preferable that the volume particle diameter distribution index on a side of the largest diameter (GSDv (90/50)) is from 1.25 to 1.38, the number particle diameter distribution index on a side of the smallest diameter (GSDp (50/10)) is equal to or more than 1.35, GSDv (90/50)/GSDp (50/10) is equal to or less than 0.92, and the average circularity is from 0.95 to 1.00, and it is more preferable that the volume particle diameter distribution index on a side of the largest diameter (GSDv (90/50)) is from 1.30 to 1.35, the number particle diameter distribution index on a side of the smallest diameter (GSDp (50/10)) is equal to or more than 1.38, GSDv (90/50)/GSDp (50/10) is equal to or less than 0.90, and the average circularity is from 0.96 to 1.00.

As described above, the toner particle according to the exemplary embodiment exhibits a particle diameter distribution in which a distribution of the toner particles on a side of the smallest diameter is broader than a volume average particle diameter (D50v), as compared with toner particles of the related art. It may be difficult to form toner particles exhibiting such physical properties in a single step. In a case of producing the toner particles according to the exemplary embodiment, a particle diameter distribution of the toner particles may be adjusted by performing a centrifugation treatment or the like.

For example, the toner particles dispersed in a solvent such as water are subjected to a centrifugation treatment, and the toner particles collected from, for example, 30% by volume of a supernatant with respect to the entire toner dispersion are added to ordinary toner particles which have not been subjected to the centrifugation treatment so that a distribution of toner particles on a side of the smallest particle diameter can be made broader than the volume average particle diameter (D50v).

In a case of producing toner particles by a dry method such as a kneading and pulverizing method, a centrifugation treatment or the like may be carried out after dispersing the obtained toner particles in a solvent such as water. In a case where toner particles are produced by a wet method, a centrifugation treatment or the like may be carried out on a dispersion of the toner particles.

In this case, by heating the toner particles collected from the supernatant, the shape of the toner particles on a side of the smallest particle diameter may become more spherical.

—Aeration Fluidity Energy—

In the toner of the exemplary embodiment, a basic fluidity energy measured by using a powder rheometer under a condition that a tip speed of a rotary blade is 100 mm/sec, an entrance angle of the rotary blade is −5°, and an aeration flow rate is 0 ml/min is preferably from 150 mJ to 500 mJ, more preferably from 150 mJ to 400 mJ, and still more preferably from 180 mJ to 300 mJ. In a case where the aeration fluidity energy is 150 mJ to 500 mJ, scattering of toner which is considered to be caused by deteriorated fluidity of the toner is further prevented.

In the toner of the exemplary embodiment, the aeration index (basic fluidity energy/aeration fluidity energy) based on an aeration fluidity energy measured by using a powder rheometer under a condition that a tip speed of a rotary blade is 100 mm/sec, an entrance angle of the rotary blade is −5°, and an aeration flow rate is 10 ml/min, and the basic fluidity energy as described above is preferably from 25 to 80, more preferably from 25 to 70, and still more preferably from 30 to 60. In a case where the aeration index is from 25 to 80, scattering of toner which is considered to be caused by deteriorated fluidity of the toner is further prevented. In particular, scattering of toner under a high stress environment is easily prevented.

<Electrostatic Charge Image Developer>

The electrostatic charge image developer according to the exemplary embodiment includes at least one of the toners according to the first to third exemplary embodiments.

The electrostatic charge image developer according to the exemplary embodiment may be a one-component developer which includes only the toner according to the exemplary embodiment, or may be a two-component developer in which the toner and a carrier are mixed with each other.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particles are dispersed and distributed in the matrix resin; and a resin impregnated-type carrier in which a resin is impregnated into the porous magnetic particle.

Note that, the magnetic particle dispersion-type carrier and the resin impregnated-type carrier may be a carrier in which the forming particle of the aforementioned carrier is set as a core and the core is coated with the coating resin.

Examples of the magnetic particle include a magnetic metal such as iron, nickel and cobalt; and a magnetic oxide such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin containing an organosiloxane bond, or the modified products thereof, a fluorine resin, polyester, polycarbonate, a phenol resin, and an epoxy resin.

Note that, other additives such as the conductive particles may be contained in the coating resin and the matrix resin.

Examples of the conductive particle include particles of metal such as gold, silver and copper; carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin, and various external additives if necessary are dissolved in a proper solvent is used. The solvent is not particularly limited, and may be selected in consideration of the coating resin to be used, coating suitability, and the like.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the flowing air, and a kneader coating method of mixing the core of the carrier with the coating layer forming solution and removing a solvent in the kneader coater.

The mixing ratio (mass ratio) of the toner to the carrier in the two-component developer is preferably from toner: carrier=1:100 to 30:100, and is more preferably from 3:100 to 20:100.

<Image Forming Apparatus/Image Forming Method>

An image forming apparatus and an image forming method according to the exemplary embodiment will be described below.

The image forming apparatus according to the exemplary embodiment includes an image holding member, charging unit that charges a surface of the image holding member, electrostatic charge image forming unit that forms an electrostatic charge image on the charged surface of the image holding member, developing unit that accommodates an electrostatic charge image developer, and develops the electrostatic charge image formed on the surface of the image holding member as a toner image with the electrostatic charge image developer, transfer unit that transfers the toner image formed on the surface of the image holding member to the surface of a recording medium, and fixing unit that fixes the toner image transferred to the surface of the recording medium. In addition, as an electrostatic charge image developer, the electrostatic charge image developer according to the exemplary embodiment is applied.

In the image forming apparatus according to the exemplary embodiment, an image forming method (the image forming method according to the exemplary embodiment) which includes: a charging step of charging a surface of the image holding member; an electrostatic charge image forming step of forming an electrostatic charge image on the charged surface of the image holding member; a developing step of developing an electrostatic charge image formed on the surface of the image holding member as a toner image with an electrostatic charge image developer according to the exemplary embodiment; a transfer step of transferring the toner image formed on the surface of the image holding member to a surface of a recording medium; and a fixing step of fixing the toner image transferred to the surface of the recording medium.

As the image forming apparatus according to the exemplary embodiment, well-known image forming apparatuses such as: an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; an apparatus including cleaning unit that cleans the surface of the image holding member before being charged and after transferring the toner image; and an apparatus including erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, primary transfer unit that primarily transfers the toner image formed on the surface of the image holding member to the surface of the intermediate transfer member, and secondary transfer unit that the toner image transferred to the surface of the intermediate transfer member is secondarily transferred to the surface of the recording medium.

In the image forming apparatus according to the exemplary embodiment, for example, a part including the developing unit may be a cartridge structure (process cartridge) detachable attached to the image forming apparatus. As a process cartridge, for example, a process cartridge including the developing unit accommodating the electrostatic charge image developer in the exemplary embodiment may be used.

Hereinafter, an example of the image forming apparatus of the exemplary embodiment will be described; however, the present invention is not limited thereto. Note that, in the drawing, major portions will be described, and others will not be described.

Figure 5:
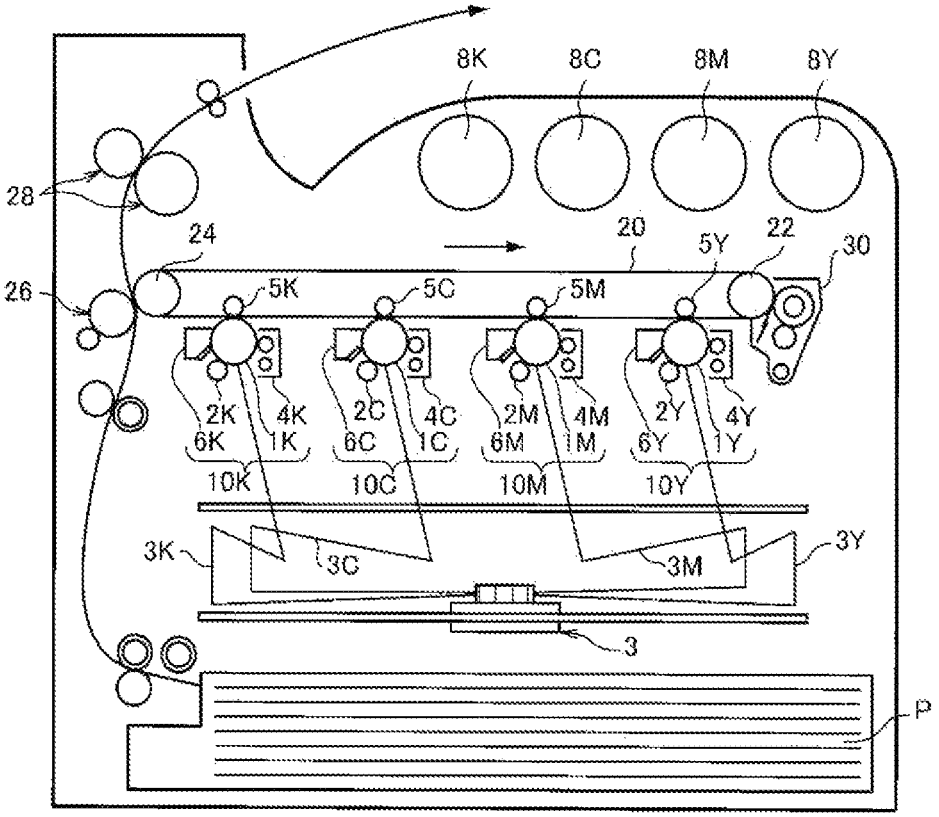
FIG. 5 is a schematic configuration diagram showing an example of an image forming apparatus according to the exemplary embodiment.

FIG. 5 is a configuration diagram illustrating an image forming apparatus according to the exemplary embodiment.

The image forming apparatus as illustrated in FIG. 5 is provided with electrophotographic type first to fourth image forming units 10Y, 10M, 10C, and 10K (image forming unit) that output an image for each color of yellow (Y), magenta (M), cyan (C), and black (K) based on color separated image data. These image forming units 10Y, 10M, 10C, and 10K (hereinafter, simply referred to as a "unit" in some cases) are arranged apart from each other by a predetermined distance in the horizontal direction. Note that, the units 10Y, 10M, 10C, and 10K may be the process cartridge which is detachable with respect to the image forming apparatus.

As an intermediate transfer member, an intermediate transfer belt 20 passing through the units is extended upward in the drawing of the respective units 10Y, 10M, 10C, and 10K. The intermediate transfer belt 20 is provided to be wound by a support roller 24 coming in contact with a driving roller 22 and the inner surface of an intermediate transfer belt 20 which are disposed apart from each other in the horizontal direction in the drawing, and travels to the direction from the first unit 10Y to the fourth unit 10K. In addition, a force is applied to the support roller 24 in the direction apart from the driving roller 22 by a spring (not shown) or the like, and thus a tension is applied to the intermediate transfer belt 20 which is wound by both. Further, an intermediate transfer member cleaning device 30 is provided on the side surface of the image holding member of the intermediate transfer belt 20 so as to face the driving roller 22.

In addition, a toner containing four colors toner of yellow, magenta, cyan, and black stored in toner cartridges 8Y, 8M, 8C, and 8K are correspondingly supplied to each of the developing devices (developing units) 4Y, 4M, 4C, and 4K of each of the units 10Y, 10M, 10C, and 10K.

The first to fourth units 10Y, 10M, 10C, and 10K have the same configuration as each other, and thus the first unit 10Y for forming a yellow image disposed on the upstream side the travel direction of the intermediate transfer belt will be representatively described. Note that, the description for the second to fourth units 10M, 10C, and 10K will be omitted by denoting reference numeral with magenta (M), cyan (C), and black (K) instead of yellow (Y) to the same part as that of the first unit 10Y.

The first unit 10Y includes a photoreceptor 1Y serving as an image holding member. In the vicinity of the photoreceptor 1Y, a charging roller (an example of the charging unit) 2Y which charges the surface of the photoreceptor 1Y with a predetermined potential, an exposure device (an example of the electrostatic charge image forming unit) 3 which exposes the charged surface by using a laser beam 3Y based on color separated image signal so as to form an electrostatic charge image, a developing device (an example of the developing unit) 4Y which supplies the charged toner to the electrostatic charge image and develops the electrostatic charge image, a primary transfer roller 5Y (an example of the primary transfer unit) which transfers the developed toner image onto the intermediate transfer belt 20, and a photoreceptor cleaning device (an example of the cleaning unit) 6Y which removes the toner remaining on the surface of the photoreceptor 1Y after primary transfer are sequentially disposed.

Note that, the primary transfer roller 5Y is disposed inside the intermediate transfer belt 20, and is provided at a position facing the photoreceptor 1Y. Further, a bias power supply (not shown) which is applied to the primary transfer bias is connected to each of the primary transfer rollers 5Y, 5M, 5C, and 5K. The bias power supply is changed to the transfer bias which is applied to applying to the primary transfer roller by control of a control unit (not shown).

Hereinafter, an operation of forming a yellow image in the first unit 10Y will be described.

First, before starting the operation, the surface of the photoreceptor 1Y is charged with the potential from −600 V to −800 V by the charging roller 2Y.

The photoreceptor 1Y is formed by stacking the photosensitive layers on the conductive substrate (for example, volume resistivity of equal to or less than $1\times10^{-6}$ Ωcm at 20° C.). The photosensitive layer typically has high resistance (the resistance of the typical resin), but when being irradiated with a laser beam 3Y, it has the property of changing the resistivity of a portion which is irradiated with the laser beam. In this regard, on the surface of the charged photoreceptor 1Y, the laser beam 3Y is output via the exposure device 3 in accordance with image data for yellow transmitted from the control unit (not shown). The surface of the photoreceptor 1Y is irradiated with the laser beam 3Y, and with this, the electrostatic charge image of a yellow image pattern is formed on the surface of the photoreceptor 1Y.

The electrostatic charge image means an image formed on the surface of the photoreceptor 1Y by charging, and is a so-called negative latent image formed in such a manner that the resistivity of a portion of the photosensitive layer to be irradiated with the laser beam 3Y is decreased, and the charges for charging the surface of the photoreceptor 1Y flow, and the charges of a portion which is not irradiated with the laser beam 3Y remain.

The electrostatic charge image formed on the photoreceptor 1Y is rotated to the predetermined developing position in accordance with the traveling of the photoreceptor 1Y. Further, the electrostatic charge image on the photoreceptor 1Y is visualized (developed) in the developing position as a toner image by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is charged on the photoreceptor 1Y, and is thus held on the developer roller (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is supplied to a predetermined primary transfer position.

When the yellow toner image on the photoreceptor 1Y is supplied to the primary transfer, a primary transfer bias is applied to the primary transfer roller 5Y and an electrostatic force toward the primary transfer roller 5Y from the photoreceptor 1Y acts on the toner image, and thereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the control unit (not shown).

On the other hand, the toner remaining on the photoreceptor 1Y is removed and collected by a photoreceptor cleaning device 6Y.

The primary transfer biases that are applied to the primary transfer rollers 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially conveyed through the second to fourth units 10M, 10C, and 10K and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roller 24 contacting the inner surface of the intermediate transfer belt, and a secondary transfer roller (an example of the secondary transfer unit) 26 disposed on the image holding surface side of the intermediate transfer belt 20. In addition, a recording sheet (an example of the recording medium) P is supplied to a gap between the secondary transfer roller 26 and the intermediate transfer belt 20, that are brought into contact with each other, via a supply mechanism at a predetermined timing, and a secondary transfer bias is applied to the support roller 24. The transfer bias applied at this time has the same polarity (−) as the toner polarity (−), and an electrostatic force toward the recording sheet P from the intermediate transfer belt 20 acts on the toner image, and thereby the toner image on the intermediate transfer belt 20 is transferred onto the recording sheet P. In this case, the secondary transfer bias is determined depending on the resistance detected by resistance detecting unit (not shown) that detects the resistance of the secondary transfer part, and is voltage-controlled.

Thereafter, the recording sheet P is supplied to a nip portion of a pair of fixing roller in a fixing device (an example of the fixing unit) 28 so that the toner image is fixed to the recording sheet P, and thereby a fixed image is formed.

Examples of the recording sheet P for transferring the toner image include plain paper used in electrophotographic copying machines, printers, and the like. In addition to the recording sheet P, examples of the recording medium also include an OHP sheet.

In order to further enhance the smoothness of the image surface after fixing, the surface of the recording sheet P may be also smooth. For example, coated paper obtained by coating the surface of plain paper with a resin or the like, and art paper for printing are suitably used.

The recording sheet P on which the fixing of the color image is completed is discharged toward a discharge part, and a series of the color image forming operations end.

<Process Cartridge and Toner Cartridge>

The process cartridge according to the exemplary embodiment will be described.

The process cartridge according to the exemplary embodiment is a process cartridge which is provided developing unit that accommodates the electrostatic charge image developer according to the exemplary embodiment, and develops electrostatic charge image formed on the surface of the image holding member as a toner image with the electrostatic charge image developer, and is detachably attached to the image forming apparatus.

The process cartridge according to the exemplary embodiment is not limited to the above-described configuration, and may be configured to include a developing device, and as necessary, at least one selected from other unit such as an image holding member, charging unit, electrostatic charge image forming unit, and transfer unit.

Hereinafter, an example of the process cartridge according to this exemplary embodiment will be shown. However, the process cartridge is not limited thereto. Note that, major portions in the drawing will be described, and descriptions for others will be omitted.

Figure 6:
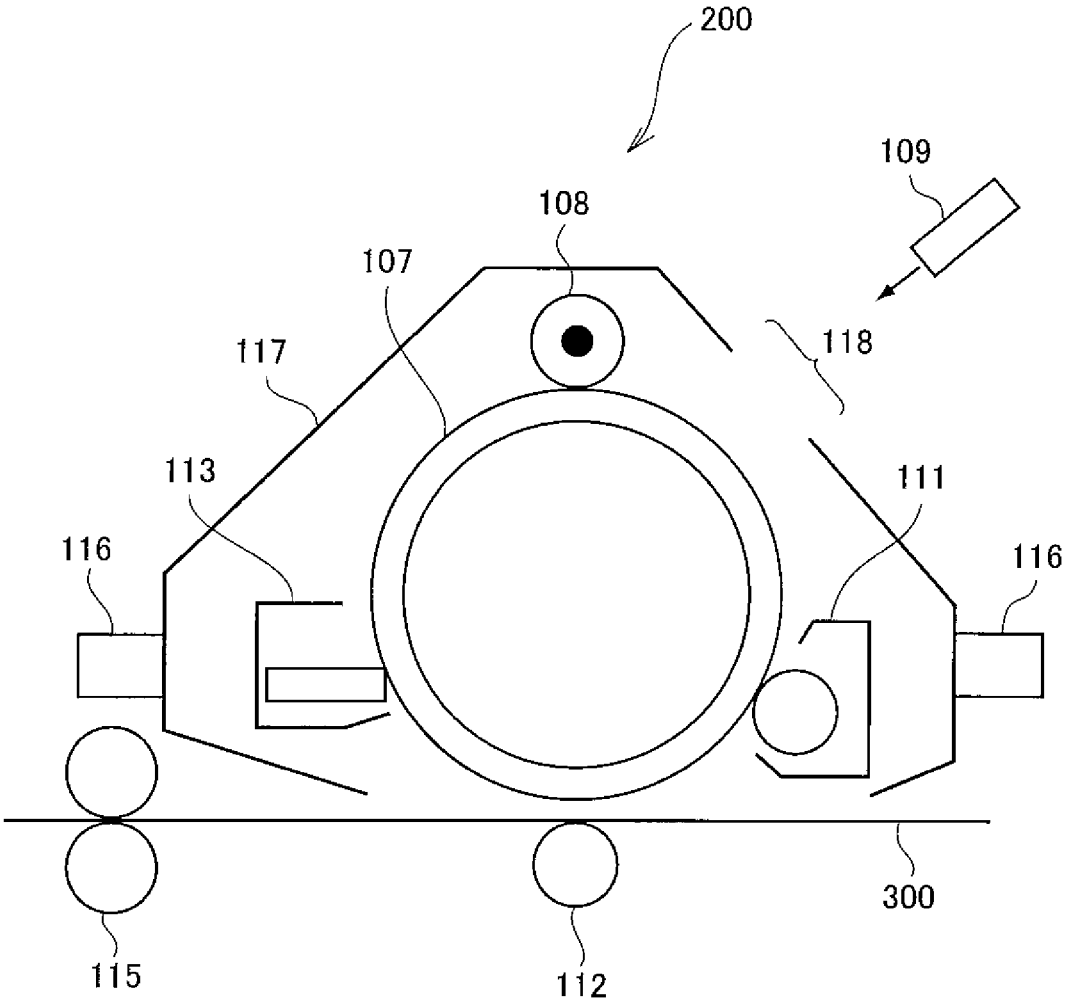
FIG. 6 is a schematic configuration diagram showing an example of a process cartridge according to the exemplary embodiment.

FIG. 6 is a configuration diagram illustrating the process cartridge according to the exemplary embodiment.

A process cartridge 200 illustrated FIG. 6 is configured such that a photoreceptor (an example of the image holding member) 107, and a charging roller (an example of the charging unit) 108, a developing device (an example of the developing unit) 111, and a photoreceptor cleaning device (an example of the cleaning unit) 113 which are provided in the circumference of the photoreceptor 107 are integrally combined and held by a housing 117 provided with a mounting rail 116 and an opening 118 for exposure, and is made into a cartridge.

In addition, in FIG. 6, a reference numeral 109 represents an exposure device (an example of the electrostatic charge image forming unit), a reference numeral 112 represents a transfer device (an example of the transfer unit), a reference numeral 115 represents a fixing device (an example of the fixing unit), and a reference numeral 300 represents a recording sheet (an example of the recording medium).

Next, the toner cartridge according to the exemplary embodiment will be described.

The toner cartridge according to the exemplary embodiment is a toner cartridge that accommodates the toner according to the exemplary embodiment and is detachably attached to the image forming apparatus. The toner cartridge is to accommodate a toner for replenishment which is supplied to the developing unit provided in the image forming apparatus.

Note that, the image forming apparatus as illustrated in FIG. 5 is an image forming apparatus having a configuration in which toner cartridges 8Y, 8M, 8C, and 8K are detachably attached, and each of developing devices 4Y, 4M, 4C, and 4K is connected to the toner cartridge corresponding to each developing device (each color) through a toner supply tube (not shown). In addition, in a case where the amount of the toners accommodated in the toner cartridge is decreased, the toner cartridge is replaced.

EXAMPLES

Hereinafter, the exemplary embodiment will be described in detail using Examples and Comparative Examples. However, the exemplary embodiment is not limited to the following examples. Unless specifically noted, "parts" and "%" are based on the mass.

Example of First Exemplary Embodiment (Preparing of Resin Particle Dispersion (1))

Terephthalic acid: 30 parts by mol
Fumaric acid: 70 parts by mol
Bisphenol A ethylene oxide adduct: 5 parts by mol
Bisphenol A propylene oxide adduct: 95 parts by mol The above materials are put into a flask having a capacity of 5 liters and equipped with a stirrer, a nitrogen introduction tube, a temperature sensor, and a rectifying column, a temperature is raised to 220° C. over 1 hour, and 1 part of titanium tetraethoxide is added with respect to 100 parts of the above materials. The temperature is raised to 230° C. over 0.5 hours while removing generated water, a dehydration condensation reaction is continued for 1 hour at that temperature, and then the reaction product is cooled. In this manner, a polyester resin having a weight average molecular weight of 18,000, an acid value of 15 mg KOH/g, and a glass transition temperature of 60° C. is synthesized.

40 parts of ethyl acetate and 25 parts of 2-butanol are put into a vessel equipped with temperature controlling unit and nitrogen replacing unit to prepare a mixed solvent, then 100 parts of the polyester resin is slowly added and dissolved, and 2% ammonia aqueous solution (in an amount equivalent in a molar ratio to 3 times the acid value of the resin) is added thereto and stirred for 30 minutes.

Next, the interior of the vessel is replaced with dry nitrogen, the temperature is kept at 45° C., 400 parts of ion exchange water is added dropwise at a rate of 4 parts/minute while stirring the mixture, and emulsification is carried out. After completion of the dropwise addition, the emulsion is returned to room temperature (20° C. to 25° C.) to obtain a resin particle dispersion in which resin particles having a volume average particle diameter of 200 nm are dispersed. Ion exchange water is added to the resin particle dispersion, and the solid content is adjusted to 30% to obtain resin particle dispersion (1). A particle diameter difference of the resin particles is 55 nm.

(Preparing of Resin Particle Dispersion (2))

In the preparing of the resin particle dispersion (1), a concentration of the ammonia aqueous solution to be added is changed to a 4% ammonia aqueous solution instead of the 2% ammonia aqueous solution, and a change is also made such that the ion exchange water is added dropwise at a rate of 3 parts/min instead of being added dropwise at a rate of 4 parts/min. In this manner, a resin particle dispersion is obtained. Ion exchange water is added to the resin particle dispersion, and the solid content is adjusted to 30% to obtain resin particle dispersion (2). A particle diameter difference of the resin particles is 75 nm.

(Preparing of Resin Particle Dispersion (3))

In the preparing of the resin particle dispersion (1), a concentration of the ammonia aqueous solution to be added is changed to a 10% ammonia aqueous solution instead of the 2% ammonia aqueous solution, and a change is also made such that the ion exchange water is added dropwise at a rate of 2 parts/min instead of being added dropwise at a rate of 4 parts/min. In this manner, a resin particle dispersion is obtained. Ion exchange water is added to the resin particle dispersion, and the solid content is adjusted to 30% to obtain resin particle dispersion (3). A particle diameter difference of the resin particles is 95 nm.

(Preparing of Cyan Colored Particle Dispersion)

C.I. Pigment Blue 15:3:50 parts
Ionic surfactant Neogen RK (Daiichi Kogyo Seiyaku Co., Ltd.): 5 parts
Ion exchange water: 192.9 parts The above components are mixed and treated with Ultimizer (manufactured by Sugino Machine Limited Co., Ltd) at 240 MPa for 10 minutes to prepare a cyan colored particle dispersion (solid content concentration: 20%).

(Preparing of Magenta Colored Particle Dispersion (1))

A magenta colored particle dispersion (1) (solid content concentration: 20%) is prepared by using the same method as that used in the case of the cyan colored particle dispersion except that the coloring agent is changed to Pigment Red 122.

(Preparing of Yellow Colored Particle Dispersion)

A yellow colored particle dispersion (solid content concentration: 20%) is prepared by using the same method as that used in the case of the cyan colored particle dispersion except that the coloring agent is changed to Pigment Yellow 74.

(Preparing of Release Agent Particle Dispersion)

Paraffin wax (HNP-9, manufactured by Nippon Seiro Co., Ltd.): 100 parts

Anionic surfactant (NEOGEN RK, manufactured by Daiichi Kogyo Seiyaku Co., Ltd.): 1 part Ion exchange water: 350 parts The above materials are mixed, heated to 100° C., dispersed by using a homogenizer (ULTRA TURRAX T50, manufactured by IKA Ltd), and then subjected to a dispersion treatment using a Manton Gaulin high pressure homogenizer (manufactured by Gaulin) to obtain a release agent particle dispersion (solid content: 20%) in which release agent particles having a volume average particle diameter of 200 nm are dispersed.

<Preparing of Magenta Toner 1>

Ion exchange water: 185 parts

Resin particle dispersion (1): 190 parts

Magenta colored particle dispersion: 35 parts

Release agent particle dispersion: 40 parts

Anionic surfactant (Daiichi Kogyo Seiyaku Co., Ltd.: 20% NEOGEN RK): 2.8 parts

The above components are put into a 3 liter reaction vessel equipped with a thermometer, a pH meter, and a stirrer, and kept at a temperature of 30° C. and a stirring rotation speed of 150 rpm for 30 minutes while controlling the temperature with a mantle heater from the outside. Thereafter, a 0.3 N nitric acid aqueous solution is added to adjust the pH in an aggregation step to 3.0.

While dispersing by using a homogenizer (ULTRA TURRAX T50, manufactured by IKA Ltd), a PAC aqueous solution in which 1.5 parts of PAC (30% powder product, manufactured by Oji Paper Co., Ltd.) has been dissolved in 15 parts of ion exchange water is added. Thereafter, with pressure reduction at 65 kPa (abs), degassing is performed while stirring at 30° C. for 1 hour, then the temperature is raised to 50° C., and the particle diameter is measured by using a Coulter Multisizer II (aperture diameter: 50 μm, manufactured by Beckman Coulter, Inc.). The volume average particle diameter is 5.0 μm. After that, 93 parts of the resin particle dispersion (1) is additionally added at an addition rate of 150 parts/min to allow the resin particles to adhere to the surface of the aggregated particles (shell structure).

Subsequently, 20 parts of a 10% NTA (nitrilotriacetic acid) metal salt aqueous solution (Chelest 70: manufactured by Chelest Corporation) is added, and the pH is adjusted to 9.0 with 1 N sodium hydroxide aqueous solution. Thereafter, the temperature is raised to 90° C. at a heating rate of 0.05° C./min, kept at 90° C. for 3 hours, cooled, and filtered to obtain coarse toner particles. The coarse toner particles are further redispersed in ion exchange water and are repeatedly filtered to perform washing until the electric conductivity of the filtrate becomes equal to or less than 20 μS/cm, followed by vacuum drying in an oven at 40° C. for 5 hours to obtain toner particles. The volume average particle diameter of the obtained toner particles is 6.1 μm.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. Thereafter, the mixture is sieved with a vibration sieve having an opening of 45 μm so as to prepare magenta toner 1.

Various parameters for the obtained toner particles and the magenta toner 1 are summarized in Table 1.

<Preparing of Magenta Toner 2>

Magenta toner 2 is prepared by using the same method as that used in the preparing of the magenta toner 1 except that the resin particle dispersion (1) is changed to resin particle dispersion (2).

Various parameters for the obtained toner particles and the magenta toner 2 are summarized in Table 1.

<Preparing of Magenta Toner 3>

Magenta toner 3 is prepared by using the same method as that used in the preparing of the magenta toner 2 except that 185 parts of ion exchange water is changed to 215 parts of ion exchange water.

Various parameters for the obtained toner particles and the magenta toner 3 are summarized in Table 1.

<Preparing of Magenta Toner 4>

Magenta toner 4 is prepared by using the same method as that used in the preparing of the magenta toner 1 except that the treatment of being kept at 90° C. for 3 hours is changed to a treatment of being kept at 90° C. for 2 hours.

Various parameters for the obtained toner particles and the magenta toner 4 are summarized in Table 1.

<Preparing of Magenta Toner 5>

Magenta toner 5 is prepared by using the same method as that used in the preparing of the magenta toner 3 except that the treatment of being kept at 90° C. for 3 hours is changed to a treatment of being kept at 90° C. for 2 hours.

Various parameters for the obtained toner particles and the magenta toner 5 are summarized in Table 1.

<Preparing of Magenta Toner 6>

Magenta toner 6 is prepared by using the same method as that used in the case of the magenta toner 1 except that the pressure reduction condition at 65 kPa (abs) after addition of the PAC aqueous solution is changed to a pressure reduction condition at 95 kPa (abs) after addition of the PAC aqueous solution in the preparing of the magenta toner 1.

Various parameters for the obtained toner particles and the magenta toner 6 are summarized in Table 1.

<Preparing of Magenta Toner 7>

Magenta toner 7 is prepared by using the same method as that used in the case of the magenta toner 1 except that 185 parts of ion exchange water is changed to 289 parts of ion exchange water in the preparing of the magenta toner 1.

Various parameters for the obtained toner particles and the magenta toner 7 are summarized in Table 1.

<Preparing of Magenta Toner 8>

Magenta toner 8 is prepared by using the same method as that used in the case of the magenta toner 1 except that using 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) with respect to 100 parts of the toner particles is changed to using 3.0 parts of hydrophobic silica (RY 50, manufactured by Nippon Aerosil Co., Ltd.) and 2.0 part of hydrophobic titanium oxide (T805, manufactured by Nippon Aerosil Co., Ltd.) with respect to 100 parts of the toner particles in the preparing of the magenta toner 1.

Various parameters for the obtained toner particles and the magenta toner 8 are summarized in Table 1.

<Preparing of Magenta Toner 9>

Magenta toner 9 is prepared by using the same method as that used in the case of the magenta toner 1 except that using 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) with respect to 100 parts of the toner particles is changed to using 0.6 parts of hydrophobic silica (RY 50, manufactured by Nippon Aerosil Co., Ltd.) and 0.4 part of hydrophobic titanium oxide (T805, manufactured by Nippon Aerosil Co., Ltd.) with respect to 100 parts of the toner particles in the preparing of the magenta toner 1.

Various parameters for the obtained toner particles and the magenta toner 9 are summarized in Table 1.

<Preparing of Magenta Toner 10>

Styrene-butyl acrylate copolymer (copolymerization ratio (weight ratio)=80:20, weight average molecular weight Mw=130000, glass transition temperature Tg=59° C.): 88 parts Magenta pigment (C.I. Pigment Red 122): 6 parts Low molecular weight polypropylene (softening temperature: 148° C.): 6 parts The above materials are mixed by using a Henschel mixer and heat-kneaded by using an extruder. After cooling, the kneaded product is coarsely pulverized and finely pulverized, the pulverized product is further classified, and stored for 20 hours under an environment of 53° C. to obtain toner particles having a volume average particle diameter of 6.2 μm.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. After that, the mixture is sieved with a vibration sieve having an opening of 45 μm so as to prepare magenta toner 10.

Various parameters for the obtained toner particles and the magenta toner 10 are summarized in Table 1.

<Preparing of Magenta Toner 11>

(Preparing of Unmodified Polyester Resin)

Bisphenol A-ethylene oxide adduct: 160 parts

Bisphenol A-propylene oxide adduct: 15 parts

Terephthalic acid: 220 parts

The monomers of the above composition are put into a 3-necked flask which has been well dried and replaced with $N_2$, heated to 180° C. while being fed with $N_2$ so as to dissolve the monomers, and sufficiently mixed. After adding 0.1 part of dibutyltin oxide, the temperature in the system is raised to 205° C., and the reaction is allowed to proceed while maintaining the same temperature. Progress of the reaction is controlled by collecting moisture under temperature regulation and reduced pressure atmosphere while collecting a small amount of sample and measuring the molecular weight thereof during the reaction, and a desired condensate is obtained.

(Preparing of Polyester Prepolymer)

Bisphenol A-ethylene oxide adduct: 182 parts

Bisphenol A-propylene oxide adduct: 21 parts

Terephthalic acid: 7 parts

Isophthalic acid: 85 parts

The above monomers are added to a 3-necked flask which has been well dried and replaced with $N_2$, heated to 180° C. while being fed with $N_2$ so as to dissolve the monomers, and sufficiently mixed. After adding 0.4 part of dibutyltin oxide, the temperature in the system is raised to 205° C. and the reaction is allowed to proceed while maintaining the same temperature. Progress of the reaction is controlled by collecting moisture under temperature regulation and reduced pressure atmosphere while collecting a small amount of sample and measuring the molecular weight thereof during the reaction, and a desired condensate is obtained. Next, after lowering the temperature to 175° C., 8 parts of phthalic anhydride is added, and the mixture is allowed to react by stirring under a reduced pressure atmosphere for 3 hours.

330 parts of the condensate obtained above, 25 parts of isophorone diisocyanate, and 410 parts of ethyl acetate are put into another 3-necked flask which has been well dried and replaced with $N_2$. The mixture is heated at 70° C. for 5 hours while being fed with $N_2$ so as to obtain a polyester prepolymer having an isocyanate group (hereinafter referred to as "isocyanate-modified polyester prepolymer").

(Preparing of Ketimine Compound)

Methyl ethyl ketone: 20 parts

Isophorone diamine: 15 parts

The above materials are put into a vessel and stirred under heating at 58° C. to obtain a ketimine compound.

(Preparing of Magenta Pigment Dispersion for Oil Phase Solution)

Magenta pigment (C.I. Pigment Red 122): 15 parts

Ethyl acetate: 65 parts

Solsperse 5000 (manufactured by Lubrizol Japan Ltd.): 1.2 parts

The above components are mixed, and dissolved and dispersed by using a sand mill to obtain a magenta pigment dispersion for oil phase solution.

(Preparing of Release Agent Dispersion for Oil Phase Solution)

Paraffin wax (melting temperature: 89° C.): 20 parts

Ethyl acetate: 220 parts

The above components are cooled to 18° C. and wet pulverized by using a microbead type dispersing machine (DCP mill) to obtain a release agent dispersion for oil phase solution.

(Preparing of Oil Phase Solution)

Magenta pigment dispersion for oil phase solution: 32 parts

Bentonite (manufactured by Wako Pure Chemical Industries, Ltd.): 8 parts

Ethyl acetate: 58 parts. The above components are put into a vessel, and sufficiently stirred and mixed. To the resulting mixed solution, Unmodified polyester resin: 140 parts; and Release agent dispersion for oil phase solution: 75 Parts, are added and sufficiently stirred to prepare an oil phase solution.

(Preparing of Styrene Acrylic Resin Particle Dispersion (1))

Styrene: 75 parts n-Butyl acrylate: 115 parts

Methacrylic acid: 75 parts

Polyoxyalkylene methacrylate sulfuric ester Na (Eleminol RS-30, manufactured by Sanyo Chemical Industries, Ltd.): 8 parts Dodecanethiol: 4 parts The above components are put into a refluxable reaction vessel, and sufficiently stirred and mixed. 800 parts of ion exchange water and 1.2 parts of ammonium persulfate are quickly added to the mixture, and the resulting mixture is dispersed and emulsified by using a homogenizer (ULTRA-TURRAX T50, manufactured by IKA Ltd) while maintaining the temperature at equal to or less than room temperature so as to obtain a white emulsion. The temperature in the system is raised to 70° C. while being fed with $N_2$, and the emulsion polymerization is continued as it is for 5 hours. Further, 18 parts of a 1% ammonium persulfate aqueous solution is slowly added dropwise, and then kept at 70° C. for 2 hours to complete the polymerization.

(Preparing of Aqueous Phase Solution)

Styrene acrylic resin particle dispersion (1): 50 parts

2% aqueous solution of CELLOGEN BS-H (CMC, Daiichi Kogyo Seiyaku Co., Ltd.): 170 parts Anionic surfactant (Dowfax 2 A1, manufactured by Dow Chemical Company): 3 parts Ion exchange water: 230 parts. The above components are sufficiently stirred and mixed to prepare an aqueous phase solution.

Oil Phase Solution: 370 Parts

Isocyanate-modified polyester prepolymer: 25 parts

Ketimine compound: 1.5 parts

The above components are put into a round bottom stainless steel flask and stirred for 2 minutes by using a homogenizer (ULTRA TURRAX, manufactured by IKA Ltd) to prepare a mixed oil phase solution. Then, 900 parts of the aqueous phase solution is added to the flask, and quickly forcible emulsification is performed for about 2 minutes by using a homogenizer (8500 rpm). Next, this emulsion is stirred by using a paddle stirrer at equal to or less than normal temperature and atmospheric pressure (1 atm) for 15 minutes so that particle formation and urea modification reaction of polyester resin is allowed to proceed. After that, together with blowing nitrogen into the suspension at a rate of 2 $m^3$/h, stirring is performed at 75° C. for 8 hours while removing the solvent under reduced pressure or normal pressure, to complete the urea modification reaction.

After cooling to normal temperature, the suspension of the generated particles is taken out, sufficiently washed with ion exchange water, and subjected to solid-liquid separation by Nutsche suction filtration. Next, the resulting product is redispersed in ion exchange water at 35° C. and washed while stirring for 15 minutes. After repeating this washing operation several times, the resulting product is subjected to solid-liquid separation by Nutsche suction filtration and freeze-dried under vacuum to obtain toner particles.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. After that, the mixture is sieved with a vibration sieve having an opening of 45 μm so as to prepare magenta toner 11.

Various parameters for the obtained toner particles and the magenta toner 11 are summarized in Table 1.

<Preparing of Magenta Toner 12>

(Preparing of Styrene Acrylic Resin Dispersion)

Styrene: 308 parts n-Butyl acrylate: 100 parts

Acrylic acid: 4 parts

Dodecanethiol: 3 parts

Propanediol diacrylate: 1.5 parts

The above components are mixed, and the dissolved mixture is added to an aqueous solution in which 4 parts of an anionic surfactant (Neogen SC, manufactured by Daiichi Kogyo Seiyaku Co., Ltd.) has been dissolved in 550 parts of ion exchange water and emulsified in a flask. Then, while mixing for 10 minutes, an aqueous solution in which 6 parts of ammonium persulfate has been dissolved in 350 parts of ion exchange water is added thereto, and after performing nitrogen replacement, the inside of the flask is heated in an oil bath while stirring until the content therein reaches 75° C. Emulsion polymerization is continued as it is for 5 hours. In this manner, a styrene acrylic resin dispersion (resin particle concentration: 40%) prepared by dispersing the resin particles having an average particle diameter of 195 nm and a weight average molecular weight (Mw) of 41000 is obtained. The glass transition temperature of the amorphous styrene acrylic resin is 52° C.

Magenta toner 12 is prepared by using the same method as that used in the case of the magenta toner 1 except that 190 parts of the resin particle dispersion (1) is changed to 190 parts of styrene acrylic resin dispersion in the preparing of the magenta toner 1.

Various parameters for the obtained toner particles and the magenta toner 12 are summarized in Table 1.

<Preparing of Magenta Toner 13>

Magenta toner 13 is prepared by using the same method as that used in the case of the magenta toner 1 except that the pressure reduction condition at 65 kPa (abs) after addition of the PAC aqueous solution is changed to a pressure reduction condition at 98 kPa (abs) after addition of the PAC aqueous solution in the preparing of the magenta toner 1.

Various parameters for the obtained toner particles and the magenta toner 13 are summarized in Table 1.

<Preparing of Magenta Toner 14>

Magenta toner 14 is prepared by using the same method as that used in the case of the magenta toner 1 except that 185 parts of ion exchange water is changed to 335 parts of ion exchange water in the preparing of the magenta toner 1.

Various parameters for the obtained toner particles and the magenta toner 14 are summarized in Table 1.

<Preparing of Magenta Toner 15>

Magenta toner 15 is prepared by using the same method as that used in the preparing of the magenta toner 1 except that the treatment of being kept at 90° C. for 3 hours is changed to a treatment of being kept at 90° C. for 1.5 hours.

Various parameters for the obtained toner particles and the magenta toner 15 are summarized in Table 1.

<Preparing of Magenta Toner 16>

Magenta toner 16 is prepared by using the same method as that used in the case of the magenta toner 3 except that the treatment of being kept at 90° C. for 3 hours is changed to a treatment of being kept at 90° C. for 1.5 hours in the preparing of the magenta toner 3.

Various parameters for the obtained toner particles and the magenta toner 16 are summarized in Table 1.

<Preparing of Magenta Toner 17>

Magenta toner 17 is prepared by using the same method as that used in the preparing of the magenta toner 6 except that using 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) with respect to 100 parts of the toner particles is changed to using 3.0 parts of hydrophobic silica (RY 50, manufactured by Nippon Aerosil Co., Ltd.) and 2.0 part of hydrophobic titanium oxide (T805, manufactured by Nippon Aerosil Co., Ltd.) with respect to 100 parts of the toner particles.

Various parameters for the obtained toner particles and the magenta toner 17 are summarized in Table 1.

<Preparing of Magenta Toner 18>

Magenta toner 18 is prepared by using the same method as that used in the preparing of the magenta toner 7 except that the treatment of being kept at 90° C. for 3 hours is changed to a treatment of being kept at 90° C. for 2 hours in the preparing of the magenta toner 7.

Various parameters for the obtained toner particles and the magenta toner 18 are summarized in Table 1.

<Preparing of Magenta Toner 19>

Magenta toner 19 is prepared by using the same method as that used in the preparing of the magenta toner 6 except that the treatment of being kept at 90° C. for 3 hours is changed to a treatment of being kept at 90° C. for 4 hours.

Various parameters for the obtained toner particles and the magenta toner 19 are summarized in Table 1.

<Preparing of Magenta Toner 20>

Magenta toner 20 is prepared by using the same method as that used in the preparing of the magenta toner 7 except that using 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) with respect to 100 parts of the toner particles is changed to using 3.0 parts of hydrophobic silica (RY 50, manufactured by Nippon Aerosil Co., Ltd.) and 2.0 part of hydrophobic titanium oxide (T805, manufactured by Nippon Aerosil Co., Ltd.) with respect to 100 parts of the toner particles.

Various parameters for the obtained toner particles and the magenta toner 20 are summarized in Table 1.

<Preparing of Magenta Toner 21>

<Preparing of Toner>

Ion exchange water: 215 parts

Resin particle dispersion (3): 190 parts

Magenta colored particle dispersion: 35 parts

Release agent particle dispersion: 40 parts

Anionic surfactant (Daiichi Kogyo Seiyaku Co., Ltd.: 20% NEOGEN RK): 2.8 parts

The above components are put into a 3 liter reaction vessel equipped with a thermometer, a pH meter, and a stirrer, and kept at a temperature of 30° C. and a stirring rotation speed of 150 rpm for 30 minutes while controlling the temperature with a mantle heater from the outside. Thereafter, a 0.3 N nitric acid aqueous solution is added to adjust the pH in an aggregation step to 3.0.

While dispersing by using a homogenizer (ULTRA TURRAX T50, manufactured by IKA Ltd), a PAC aqueous solution in which 1.5 parts of PAC (30% powder product, manufactured by Oji Paper Co., Ltd.) has been dissolved in 15 parts of ion exchange water is added. Thereafter, temperature is raised to 50° C. while stirring, and the particle diameter is measured by using a Coulter Multisizer II (aperture diameter: 50 μm, manufactured by Beckman Coulter, Inc.). The volume average particle diameter is 5.0 μm. After that, 93 parts of the resin particle dispersion (3) is additionally added at an addition rate of 70 parts/min to allow the resin particles to adhere to the surface of the aggregated particles (shell structure).

Subsequently, 20 parts of a 10% NTA (nitrilotriacetic acid) metal salt aqueous solution (Chelest 70: manufactured by Chelest Corporation) is added, and the pH is adjusted to 9.0 with 1 N sodium hydroxide aqueous solution. Thereafter, the temperature is raised to 90° C. at a heating rate of 0.05° C./min, kept at 90° C. for 2 hours, cooled, and filtered to obtain coarse toner particles. The coarse toner particles are further redispersed in ion exchange water and are repeatedly filtered to perform washing until the electric conductivity of the filtrate becomes equal to or less than 20 μS/cm, followed by vacuum drying in an oven at 40° C. for 5 hours to obtain toner particles. The volume average particle diameter of the obtained toner particles is 6.1 μm.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. After that, the mixture is sieved with a vibration sieve having an opening of 45 μm so as to prepare magenta toner 21.

Various parameters for the obtained toner particles and the magenta toner 21 are summarized in Table 1.

<Preparing of Cyan Toner 1>

Cyan toner 1 is prepared by using the same method as that used in the preparing of the magenta toner 1 except that the magenta colored particle dispersion is changed to the cyan colored particle dispersion.

Various parameters for the obtained toner particles and cyan toner 1 are summarized in Table 1.

<Preparing of Cyan Toner 2>

Cyan toner 2 is prepared by using the same method as that used in the preparing of the magenta toner 21 except that the magenta colored particle dispersion is changed to the cyan colored particle dispersion.

Various parameters for the obtained toner particles and cyan toner 2 are summarized in Table 1.

<Preparing of Yellow Toner 1>

Yellow toner 1 is prepared by using the same method as that used in the preparing of the magenta toner 1 except that the magenta colored particle dispersion is changed to the yellow colored particle dispersion.

Various parameters for the obtained toner particles and yellow toner 1 are summarized in Table 1.

<Preparing of Yellow Toner 2>

Yellow toner 2 is prepared by using the same method as that used in the preparing of the magenta toner 21 except that the magenta colored particle dispersion is changed to the yellow colored particle dispersion.

Various parameters for the obtained toner particles and yellow toner 2 are summarized in Table 1.

Each toner obtained as described above and a carrier are put into a V-type blender at a ratio of toner:carrier=8:92 (mass ratio) and stirred for 20 minutes to obtain each developer.

As the carrier, a carrier prepared as follows is used.

Ferrite particles (volume average particle diameter: 50 μm): 100 parts

Toluene: 14 parts

Styrene-methyl methacrylate copolymer: 2 parts (component ratio: 90/10, Mw=80000)

Carbon black (R330: manufactured by Cabot Corporation): 0.2 parts

First, the above components other than ferrite particles are stirred for 10 minutes by using a stirrer to prepare a dispersed coating liquid, then this coating liquid and ferrite particles are put into a vacuum deaeration type kneader and stirred at 60° C. for 30 minutes. After the stirring, the mixture is degassed by further reducing the pressure while warming, and dried to obtain a carrier.

[Evaluation]

Each of the developers obtained as described above is filled into a developing device of an image forming apparatus "DocuCentre color 400 manufactured by Fuji Xerox Co., Ltd." as shown in Table 2. By using this image forming apparatus, 10000 solid images having an image density of 100% are output under an environment of a temperature of 35° C. and a humidity of 85% RH. After that, the test chart No. 5-1 of the Society of Electrophotgraphy of Japan is output. With respect to halftone image of multicolor portions of +0.1 to +1.8 in the output image, L * values for 10 points each are obtained by using X-Rite 939 (aperture diameter of 4 mm) manufactured by X-Rite Inc. Further, the toner applied amount ($g/m^2$) in the measured halftone image of multicolor portion is obtained.

Here, the L * values are plotted with respect to the toner applied amount ($g/m^2$) and a second-order polynomial approximation expression is used to obtain R2.—Evaluation criteria—A: R2 thus obtained is from 0.99 to 1.0 B: R2 thus obtained is equal to or more than 0.98 and less than 0.99 C: R2 thus obtained is equal to or more than 0.96 and less than 0.98 (acceptable range on actual use) D: R2 thus obtained is less than 0.96, a level at which a gradation property is visually unacceptable in a halftone of multicolor.

TABLE 1

| Kind of toner | Toner particles: Volume average particle diameter (μm) | GSDv (90/50) | GSDp (50/10) | GSDv(90/50)/GSDp(50/10) | Average circularity | Aeration fluidity energy (mJ): Aeration flow rate 5 ml/min | Aeration flow rate 80 ml/min | Aeration fluidity energy ratio (5 ml/min)/(80 ml/min) |
|---|---|---|---|---|---|---|---|---|
| Magenta toner 1 | 6.1 | 1.23 | 1.23 | 1.00 | 0.98 | 152 | 42 | 3.6 |
| Magenta toner 2 | 6.1 | 1.26 | 1.26 | 1.00 | 0.98 | 182 | 41 | 4.4 |
| Magenta toner 3 | 6.1 | 1.26 | 1.28 | 0.98 | 0.98 | 222 | 38 | 5.8 |
| Magenta toner 4 | 6.1 | 1.23 | 1.23 | 1.00 | 0.95 | 174 | 38 | 4.6 |
| Magenta toner 5 | 6.1 | 1.26 | 1.28 | 0.98 | 0.95 | 249 | 36 | 6.9 |
| Magenta toner 6 | 6.1 | 1.24 | 1.23 | 1.01 | 0.98 | 114 | 37 | 3.1 |
| Magenta toner 7 | 6.1 | 1.23 | 1.28 | 0.96 | 0.98 | 272 | 36 | 7.6 |
| Magenta toner 8 | 6.1 | 1.23 | 1.23 | 1.00 | 0.98 | 125 | 32 | 3.9 |
| Magenta toner 9 | 6.1 | 1.23 | 1.23 | 1.00 | 0.98 | 291 | 38 | 7.7 |
| Magenta toner 10 | 6.2 | 1.26 | 1.27 | 0.99 | 0.95 | 265 | 52 | 5.1 |
| Magenta toner 11 | 6.0 | 1.23 | 1.24 | 0.99 | 0.98 | 167 | 40 | 4.2 |
| Magenta toner 12 | 6.1 | 1.23 | 1.23 | 1.00 | 0.97 | 157 | 40 | 3.9 |
| Magenta toner 13 | 6.1 | 1.27 | 1.23 | 1.03 | 0.98 | 107 | 36 | 3.0 |
| Magenta toner 14 | 6.1 | 1.23 | 1.3 | 0.95 | 0.98 | 295 | 39 | 7.6 |
| Magenta toner 15 | 6.1 | 1.23 | 1.23 | 1.00 | 0.94 | 197 | 35 | 5.6 |
| Magenta toner 16 | 6.1 | 1.26 | 1.28 | 0.98 | 0.94 | 283 | 38 | 7.4 |
| Magenta toner 17 | 6.1 | 1.24 | 1.23 | 1.01 | 0.98 | 97 | 30 | 3.2 |
| Magenta toner 18 | 6.1 | 1.23 | 1.28 | 0.96 | 0.95 | 312 | 40 | 7.8 |
| Magenta toner 19 | 6.1 | 1.24 | 1.23 | 1.01 | 0.99 | 113 | 42 | 2.7 |
| Magenta toner 20 | 6.1 | 1.23 | 1.28 | 0.96 | 0.98 | 251 | 31 | 8.1 |
| Magenta toner 21 | 6.1 | 1.28 | 1.35 | 0.95 | 0.94 | 331 | 39 | 8.5 |
| Cyan toner 1 | 6.1 | 1.23 | 1.23 | 1.00 | 0.98 | 165 | 45 | 3.7 |
| Cyan toner 2 | 6.1 | 1.28 | 1.35 | 0.95 | 0.94 | 342 | 42 | 8.1 |
| Yellow toner 1 | 6.1 | 1.23 | 1.23 | 1.00 | 0.98 | 141 | 38 | 3.7 |
| Yellow toner 2 | 6.1 | 1.28 | 1.35 | 0.95 | 0.94 | 320 | 39 | 8.2 |

TABLE 2

| | Toner 1 | Toner 2 | Toner 3 | Difference in aeration fluidity energy at aeration flow rate of 5 ml/min (mJ) | Gradation property |
|---|---|---|---|---|---|
| Example 1 | Magenta toner 1 | Cyan toner 1 | — | 13 | A |
| Example 2 | Magenta toner 2 | Cyan toner 1 | — | 17 | A |
| Example 3 | Magenta toner 3 | Cyan toner 1 | — | 57 | A |
| Example 4 | Magenta toner 4 | Cyan toner 1 | — | 9 | A |
| Example 5 | Magenta toner 5 | Cyan toner 1 | — | 84 | B |
| Example 6 | Magenta toner 6 | Cyan toner 1 | — | 51 | A |
| Example 7 | Magenta toner 7 | Cyan toner 1 | — | 107 | B |
| Example 8 | Magenta toner 8 | Cyan toner 1 | — | 40 | A |
| Example 9 | Magenta toner 9 | Cyan toner 1 | — | 126 | B |
| Example 10 | Magenta toner 10 | Cyan toner 1 | — | 100 | B |
| Example 11 | Magenta toner 11 | Cyan toner 1 | — | 2 | A |
| Example 12 | Magenta toner 12 | Cyan toner 1 | — | 8 | A |
| Example 13 | Magenta toner 13 | Cyan toner 1 | — | 58 | C |
| Example 14 | Magenta toner 14 | Cyan toner 1 | — | 130 | C |
| Example 15 | Magenta toner 15 | Cyan toner 1 | — | 32 | B |
| Example 16 | Magenta toner 16 | Cyan toner 1 | — | 118 | B |
| Example 17 | Magenta toner 17 | Cyan toner 1 | — | 68 | A |
| Example 18 | Magenta toner 18 | Cyan toner 1 | — | 147 | B |
| Example 19 | Magenta toner 19 | Cyan toner 1 | — | 52 | A |
| Example 20 | Magenta toner 20 | Cyan toner 1 | — | 86 | B |
| Example 21 | Magenta toner 21 | Cyan toner 1 | — | 166 | C |
| Example 22 | Magenta toner 1 | Cyan toner 2 | — | 190 | C |
| Comparative Example 1 | Magenta toner 21 | Cyan toner 2 | — | 11 | D |
| Example 23 | Magenta toner 1 | Yellow toner 1 | — | 11 | A |
| Example 24 | Magenta toner 1 | Yellow toner 2 | — | 168 | C |
| Example 25 | Magenta toner 21 | Yellow toner 1 | | 190 | C |
| Comparative Example 2 | Magenta toner 21 | Yellow toner 2 | — | 11 | D |
| Example 26 | Magenta toner 1 | Cyan toner 1 | Yellow toner 1 | 24 | A |

Example of Second Exemplary Embodiment (Preparing of Polyester Resin Dispersion)

Terephthalic acid: 30 parts by mol

Fumaric acid: 70 parts by mol

Bisphenol A ethylene oxide adduct: 5 parts by mol

Bisphenol A propylene oxide adduct: 95 parts by mol

The above materials are put into a flask having a capacity of 5 liters and equipped with a stirrer, a nitrogen introduction tube, a temperature sensor, and a rectifying column, a temperature is raised to 220° C. over 1 hour, and 1 part of titanium tetraethoxide is added with respect to 100 parts of the above materials. The temperature is raised to 230° C. over 0.5 hours while removing generated water, a dehydration condensation reaction is continued for 1 hour at that temperature, and then the reaction product is cooled. In this manner, a polyester resin having a weight average molecular weight of 18,000, an acid value of 15 mg KOH/g, and a glass transition temperature of 60° C. is synthesized.

40 parts of ethyl acetate and 25 parts of 2-butanol are put into a vessel equipped with temperature controlling unit and nitrogen replacing unit to prepare a mixed solvent, then 100 parts of a polyester resin is slowly added and dissolved, and 10% ammonia aqueous solution (in an amount equivalent in a molar ratio to 3 times the acid value of the resin) is added thereto and stirred for 30 minutes.

Next, the interior of the vessel is replaced with dry nitrogen, the temperature is kept at 40° C., 400 parts of ion exchange water is added dropwise at a rate of 2 parts/minute while stirring the mixture, and emulsification is carried out. After completion of the dropwise addition, the emulsion is returned to room temperature (20° C. to 25° C.) to obtain a resin particle dispersion in which resin particles having a volume average particle diameter of 200 nm are dispersed. Ion exchange water is added to the resin particle dispersion, and the solid content is adjusted to 20% to obtain a polyester resin dispersion.

Further, a polyester resin dispersion, a cyan colored particle dispersion, a magenta colored particle dispersion (1), a yellow colored particle dispersion, and a release agent particle dispersion are prepared by the above-described method.

The above materials are mixed, heated to 100° C., dispersed by using a homogenizer (ULTRA TURRAX T50, manufactured by IKA Ltd), and then subjected to a dispersion treatment using a Manton Gaulin high pressure homogenizer (manufactured by Gaulin) to obtain a release agent particle dispersion (solid content: 20%) in which release agent particles having a volume average particle diameter of 200 nm are dispersed.

<Preparing of Magenta Toner 2-1><Preparing of Aggregated Particle 1>

Ion exchange water: 107 parts

Polyester resin dispersion: 95 parts

Magenta colored particle dispersion (1): 2.5 parts

Release agent particle dispersion: 5 parts

Anionic surfactant (Daiichi Kogyo Seiyaku Co., Ltd.: NEOGEN RK, 20%): 1.4 parts

The above components are put into a 3 liter reaction vessel equipped with a thermometer, a pH meter, and a stirrer, and kept at a temperature of 30° C. and a stirring rotation speed of 150 rpm for 30 minutes while controlling the temperature with a mantle heater from the outside. Thereafter, a 0.3 N nitric acid aqueous solution is added to adjust the pH in an aggregation step to 3.0.

While dispersing by using a homogenizer (ULTRA TURRAX T50, manufactured by IKA Ltd), a PAC aqueous solution in which 0.35 parts of PAC (30% powder product, manufactured by Oji Paper Co., Ltd.) has been dissolved in 3.5 parts of ion exchange water is added. Thereafter, the temperature is raised to 50° C. at 0.4° C./min, and the particle diameter is measured by using a Coulter Multisizer II (aperture diameter: 50 μm, manufactured by Beckman Coulter, Inc.). The volume average particle diameter is 5.0 μm.

<Preparing of Aggregated Particle 2>

Ion exchange water: 107 parts

Polyester resin dispersion: 95 parts

Magenta colored particle dispersion (1): 2.5 parts

Release agent particle dispersion: 5 parts

Anionic surfactant (Daiichi Kogyo Seiyaku Co., Ltd.: NEOGEN RK, 20%): 1.4 parts

The above components are put into a 3 liter reaction vessel equipped with a thermometer, a pH meter, and a stirrer, and kept at a temperature of 30° C. and a stirring rotation speed of 180 rpm for 30 minutes while controlling the temperature with a mantle heater from the outside. Thereafter, a 0.3 N nitric acid aqueous solution is added to adjust the pH in an aggregation step to 3.0.

While dispersing by using a homogenizer (ULTRA TURRAX T50, manufactured by IKA Ltd), a PAC aqueous solution in which 0.35 parts of PAC (30% powder product, manufactured by Oji Paper Co., Ltd.) has been dissolved in 3.5 parts of ion exchange water is added. Thereafter, the temperature is raised to 50° C. at 0.25° C./min, and the particle diameter is measured by using a Coulter Multisizer II (aperture diameter: 50 μm, manufactured by Beckman Coulter, Inc.). The volume average particle diameter is 5.3 μm.

<Preparing of Toner>

The aggregated particle 2 is mixed with the aggregated particle 1, and then 93 parts of the polyester resin dispersion is additionally added to allow the resin particles to adhere to the surface of the aggregated particles (shell structure).

Subsequently, 20 parts of a 10% NTA (nitrilotriacetic acid) metal salt aqueous solution (Chelest 70: manufactured by Chelest Corporation) is added, and the pH is adjusted to 9.0 with 1 N sodium hydroxide aqueous solution. Thereafter, the temperature is raised to 90° C. at a heating rate of 0.05° C./min, kept at 90° C. for 3 hours, cooled, and filtered to obtain coarse toner particles. The coarse toner particles are further redispersed in ion exchange water and are repeatedly filtered to perform washing until the electric conductivity of the filtrate becomes equal to or less than 20 μS/cm, followed by vacuum drying in an oven at 40° C. for 5 hours to obtain toner particles. The volume average particle diameter of the obtained toner particles is 6.1 μm.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. After that, the mixture is sieved with a vibration sieve having an opening of 45 μm so as to prepare magenta toner 1.

Various parameters for the obtained toner particles and the magenta toner 1 are summarized in Table 1.

<Preparing of Magenta Toner 2-2>

Magenta toner 2-2 is prepared by using the same method as that used in the case of the magenta toner 2-1 except that the volume average particle diameter of the aggregated particles is changed to 5.1 μm in the preparing of the aggregated particle 2.

Various parameters for the obtained toner particles and the magenta toner 2-2 are summarized in Table 3.

<Preparing of Magenta Toner 2-3>

Magenta toner 2-3 is prepared by using the same method as that used in the case of the magenta toner 2-1 except that the stirring rotation speed is changed to 130 rpm and the temperature rise rate is changed to 0.8° C./minute in the preparing of the aggregated particle 1.

Various parameters for the obtained toner particles and the magenta toner 2-3 are summarized in Table 3.

<Preparing of Magenta Toner 2-4>

Magenta toner 2-4 is prepared by using the same method as that used in the case of the magenta toner 2-1 except that the keeping time at 90° C. is changed to 2 hours in the preparing of the toner.

Various parameters for the obtained toner particles and the magenta toner 2-4 are summarized in Table 3.

<Preparing of Magenta Toner 2-5>

Magenta toner 2-5 is prepared by using the same method as that used in the case of the magenta toner 2-1 except that the stirring rotation speed is changed to 160 rpm and the temperature rise rate is changed to 0.35° C./minute in the preparing of the aggregated particle 2.

Various parameters for the obtained toner particles and the magenta toner 2-5 are summarized in Table 3.

<Preparing of Magenta Toner 2-6>

Magenta toner 2-6 is prepared by using the same method as that used in the case of the magenta toner 2-1 except that the keeping time at 90° C. is changed to 4 hours in the preparing of the toner.

Various parameters for the obtained toner particles and the magenta toner 2-6 are summarized in Table 3.

<Preparing of Magenta Toner 2-7>

Magenta toner 2-7 is prepared by using the same method as that used in the case of the magenta toner 2-1 except that the stirring rotation speed is changed to 130 rpm and the temperature rise rate is changed to 0.8° C./minute in the preparing of the aggregated particle 1, and the keeping time at 90° C. is changed to 2.5 hours in the preparing of the toner.

Various parameters for the obtained toner particles and the magenta toner 2-7 are summarized in Table 3.

<Preparing of Magenta Toner 2-8>

Magenta toner 2-8 is prepared by using the same method as that used in the case of the magenta toner 2-1 except that the stirring rotation speed is changed to 130 rpm and the temperature rise rate is changed to 0.8° C./minute in the preparing of the aggregated particle 1; the volume average particle diameter of the aggregated particles is changed to 5.1 μm in the preparing of the aggregated particle 2; and the keeping time at 90° C. is changed to 2.5 hours in the preparing of the toner.

Various parameters for the obtained toner particles and the magenta toner 2-8 are summarized in Table 3.

<Preparing of Magenta Toner 2-9>

(Preparing of Polyester Resin)

Into a reaction vessel equipped with a stirrer, a thermometer, a condenser, and a nitrogen gas introduction tube, 72.1 parts of cyclohexane dimethanol, 67.9 parts of dimethyl terephthalate, 87.3 parts of isophthalic acid dimethyl ester, 40.0 parts of cyclohexane dicarboxylic acid dimethyl ester, and 1.0 part of titanium tetrabutoxide as a catalyst are put, and after replacing the inside of the reaction vessel with dry nitrogen gas, the mixture is heated in a mantle heater, and allowed to react by stirring at about 190° C. for about 5 hours under a nitrogen gas stream. Thereafter, the mixture is cooled to room temperature, and then 124 parts of ethylene glycol and 0.5 parts of titanium tetrabutoxide are added, and the mixture is further allowed to react by stirring at about 190° C. for about 5 hours under a nitrogen gas stream. The mixture is cooled to about 100° C. while continuing the stirring. After confirming that no acid component monomer remains by silica thin layer chromatography (TLC), the pressure inside the reaction vessel is reduced to about 0.6 mmHg, the inside temperature of the reaction vessel is raised to about 230° C. at a rate of about 10° C./5 min and allowed to react at 230° C. for about 2 hours to obtain a pale yellow transparent polyester resin.

(Preparing of Toner)

96 parts of polyester resin and 2 parts of C.I. Pigment Red 122 are melt-kneaded in a Banbury mixer type kneader, and 7 minutes after the kneading, 2 parts of paraffin wax (HNP-9, manufactured by Nippon Seiro Co., Ltd.) is added and melt-kneaded for 8 minutes. The kneaded product is formed into a plate shape having a thickness of about 1 cm by using a rolling roll, coarsely pulverized to about several millimeters by using a Fitzmill type pulverizer, and finely pulverized while being heated by using an IDS type pulverizer. Classification is further performed by using an elbow type classifier to obtain a toner.

Various parameters for the obtained toner particles and the magenta toner 2-9 are summarized in Table 3.

<Preparing of Magenta Toner 2-10>

(Preparing of Unmodified Polyester Resin (1))

Terephthalic acid: 1243 parts

Bisphenol A ethylene oxide adduct: 1830 parts

Bisphenol A propylene oxide adduct: 840 parts

After heating and mixing the above components at 180° C., 3 parts of dibutyltin oxide is added and water is removed while heating at 220° C. to obtain an unmodified polyester resin. The unmodified polyester resin thus obtained had a glass transition temperature Tg of 60° C., an acid value from 3 mg KOH/g, and a hydroxyl value of 1 mg KOH/g.

(Preparing of Polyester Prepolymer (1))

Terephthalic acid: 1243 parts

Bisphenol A ethylene oxide adduct: 1830 parts

Bisphenol A propylene oxide adduct: 840 parts

After heating and mixing the above components at 180° C., 3 parts of dibutyltin oxide is added and water is removed while heating at 220° C. to obtain a polyester. 350 parts of the obtained polyester, 50 parts of tolylene diisocyanate, and 450 parts of ethyl acetate are put into a vessel, and the mixture is heated at 130° C. for 3 hours so as to obtain a polyester prepolymer (1) having an isocyanate group (hereinafter referred to as "isocyanate-modified polyester prepolymer (1)") is obtained.

(Preparing of Ketimine Compound (1))

50 parts of methyl ethyl ketone and 150 parts of hexamethylene diamine are put into a vessel and stirred at 60° C. to obtain a ketimine compound (1).

(Preparing of Magenta Coloring Agent Dispersion (2))

C.I. Pigment Red 122: 50 parts

Ethyl acetate: 200 parts

The above components are mixed with each other, and the mixture is filtered and further mixing with 200 parts of ethyl acetate is repeated 5 times. Then, the mixture is dispersed for about 1 hour by using an emulsifying dispersing machine CABITRON (CR 1010, manufactured by Pacific Machinery & Engineering Co., Ltd), to obtain magenta coloring agent dispersion (2) (solid content concentration: 20%).

(Preparing of Release Agent Dispersion (1))

Paraffin wax (melting temperature: 89° C.): 30 parts

Ethyl acetate: 270 parts

The above components are cooled to 10° C. and wet pulverized with a microbead type dispersing machine (DCP mill) to obtain a release agent dispersion (1).

(Preparing of Oil Phase Solution (1))

Unmodified polyester resin (1): 136 parts

Magenta coloring agent dispersion (2): 500 parts

Ethyl acetate: 56 parts

After stirring and mixing the above components, 75 parts of the release agent dispersion (1) is added to the obtained mixture, and the mixture is stirred to obtain an oil phase solution (1).

(Preparing of Styrene Acrylic Resin Particle Dispersion (1))

Styrene: 2850 parts n-Butyl acrylate: 115 parts

Acrylic acid: 4 parts

Dodecanethiol: 5 parts

Carbon tetrabromide: 4 parts

The above components are mixed and the dissolved mixture is added to an aqueous solution in which 6 parts of a nonionic surfactant (Nonipol 400, manufactured by Sanyo Chemical Industries, Ltd.) and 10 parts of an anionic surfactant (Neogen SC, manufactured by Daiichi Kogyo Seiyaku Co., Ltd.) have been dissolved in 560 parts of ion exchange water and emulsified in a flask. Then, while mixing for 10 minutes, an aqueous solution in which 4 parts of ammonium persulfate has been dissolved in 50 parts of ion exchange water is added thereto, and after performing nitrogen replacement, the inside of the flask is heated in an oil bath while stirring until the content therein reaches 70° C. Emulsion polymerization is continued as it is for 5 hours. In this manner, styrene acrylic resin particle dispersion (1) (resin particle concentration: 40%) prepared by dispersing the resin particles having an average particle diameter of 180 nm and a weight average molecular weight (Mw) of 25,500 is obtained. The glass transition temperature of the styrene acrylic resin particles is 55° C.

(Preparing of Aqueous Phase Solution (1))

Styrene acrylic resin particle dispersion (1): 60 parts

2% aqueous solution of CELLOGEN BS-H (Daiichi Kogyo Seiyaku Co., Ltd.): 200 parts Ion exchange water: 200 parts The above components are stirred and mixed to obtain an aqueous phase solution (1).

(Preparing of Toner Particle (1))

Oil phase solution (1): 300 parts

Isocyanate-modified polyester prepolymer (1): 25 parts

Ketimine compound (1): 0.5 part

The above components are put into a vessel and stirred for 2 minutes by using a homogenizer (ULTRA TURRAX, manufactured by IKA Ltd) to obtain an oil phase solution (1P), then 1000 parts of the aqueous phase solution (1) is added to the vessel, and the mixture is homogenized by using a homogenizer for 10 minutes. Next, this mixed solution is stirred with a propeller type stirrer at room temperature (25° C.) and atmospheric pressure (1 atm) for 48 hours to react the isocyanate-modified polyester prepolymer (1) with the ketimine compound (1). As a result, a urea-modified polyester resin is generated, and the organic solvent is removed therefrom to form a granular product. Subsequently, the granular product is washed with water, dried, and classified to obtain toner particles. The volume average particle diameter of the toner particles is 6.1 μm.

Various parameters for the obtained toner particles and the magenta toner 2-10 are summarized in Table 3.

<Preparing of Magenta Toner 2-11>

Magenta toner 2-11 is prepared by using the same method as that used in the case of the magenta toner 2-1 except that the volume average particle diameter of the aggregated particles is changed to 5.0 μm in the preparing of the aggregated particle 2.

Various parameters for the obtained toner particles and the magenta toner 2-11 are summarized in Table 3.

<Preparing of Magenta Toner 2-12>

Magenta toner 2-12 is prepared by using the same method as that used in the case of the magenta toner 2-1 except that the stirring rotation speed is changed to 130 rpm and the temperature rise rate is changed to 1.0° C./minute in the preparing of the aggregated particle 1.

Various parameters for the obtained toner particles and the magenta toner 2-12 are summarized in Table 3.

<Preparing of Magenta Toner 2-13>

Magenta toner 2-13 is prepared by using the same method as that used in the case of the magenta toner 2-1 except that the keeping time at 90° C. is changed to 1.5 hours in the preparing of the toner.

Various parameters for the obtained toner particles and the magenta toner 2-13 are summarized in Table 3.

<Preparing of Magenta Toner 2-14>

Magenta toner 2-14 is prepared by using the same method as that used in the case of the magenta toner 2-1 except that the stirring rotation speed is changed to 150 rpm and the temperature rise rate is changed to 0.4° C./minute in the preparing of the aggregated particle 2.

Various parameters for the obtained toner particles and the magenta toner 2-14 are summarized in Table 1.

<Preparing of Magenta Toner 2-15>

Magenta toner 2-15 is prepared by using the same method as that used in the case of the magenta toner 2-1 except that the keeping time at 90° C. is changed to 4.5 hours in the preparing of the toner.

Various parameters for the obtained toner particles and the magenta toner 2-15 are summarized in Table 3.

<Preparing of Magenta Toner 2-16>

Magenta toner 2-16 is prepared by using the same method as that used in the case of the magenta toner 2-1 except that the stirring rotation speed is changed to 130 rpm and the temperature rise rate is changed to 0.8° C./minute in the preparing of the aggregated particle 1; and 90° C. is changed to 92° C. and the keeping time is changed to 2 hours in the preparing of the toner.

Various parameters for the obtained toner particles and the magenta toner 2-16 are summarized in Table 3.

<Preparing of Magenta Toner 2-17>

Magenta toner 2-17 is prepared by using the same method as that used in the case of the magenta toner 2-1 except that the stirring rotation speed is changed to 130 rpm and the temperature rise rate is changed to 0.8° C./minute in the preparing of the aggregated particle 1; the volume average particle diameter of the aggregated particles is changed to 5.8 μm in the preparing of the aggregated particle 2; and 90° C. is changed to 91° C. and the keeping time is changed to 2.5 hours in the preparing of the toner.

Various parameters for the obtained toner particles and the magenta toner 2-17 are summarized in Table 3.

<Preparing of Magenta Toner 2-18><Preparing of Toner>

Ion exchange water: 215 parts

Polyester resin dispersion: 190 parts

Magenta colored particle dispersion: 5 parts

Release agent particle dispersion: 10 parts

Anionic surfactant (Daiichi Kogyo Seiyaku Co., Ltd.: 20% NEOGEN RK): 2.8 parts

The above components are put into a 3 liter reaction vessel equipped with a thermometer, a pH meter, and a stirrer, and kept at a temperature of 30° C. and a stirring rotation speed of 130 rpm for 30 minutes while controlling the temperature with a mantle heater from the outside. Thereafter, a 0.3 N nitric acid aqueous solution is added to adjust the pH in an aggregation step to 3.0.

While dispersing by using a homogenizer (ULTRA TURRAX T50, manufactured by IKA Ltd), a PAC aqueous solution in which 0.7 parts of PAC (30% powder product, manufactured by Oji Paper Co., Ltd.) has been dissolved in 7 parts of ion exchange water is added. Thereafter, the temperature is raised to 50° C. at 1.0° C./min while stirring, and the particle diameter is measured by using a Coulter Multisizer II (aperture diameter: 50 μm, manufactured by Beckman Coulter, Inc.). The volume average particle diameter is 5.0 μm. After that, 93 parts of the polyester resin dispersion is additionally added to allow the resin particles to adhere to the surface of the aggregated particles (shell structure).

Subsequently, 20 parts of a 10% NTA (nitrilotriacetic acid) metal salt aqueous solution (Chelest 70: manufactured by Chelest Corporation) is added, and the pH is adjusted to 9.0 with 1 N sodium hydroxide aqueous solution. Thereafter, the temperature is raised to 90° C. at a heating rate of 0.05° C./min, kept at 90° C. for 1.5 hours, cooled, and filtered to obtain coarse toner particles. This is further redispersed in ion exchange water and is repeatedly filtered to perform washing until the electric conductivity of the filtrate becomes equal to or less than 20 μS/cm, followed by vacuum drying in an oven at 40° C. for 5 hours to obtain toner particles. The volume average particle diameter of the obtained toner particles is 6.1 μm.

With respect to 100 parts of the obtained toner particles, 1.5 parts of hydrophobic silica (RY 50, manufactured by Nippon Aerosil Co., Ltd.) and 1.0 part of hydrophobic titanium oxide (T805, manufactured by Nippon Aerosil Co., Ltd.) are mixed together at 10000 rpm for 30 seconds by using a sample mill. After that, the mixture is sieved with a vibration sieve having an opening of 45 μm so as to prepare magenta toner 2-18.

Various parameters for the obtained toner particles and the magenta toner 2-18 are summarized in Table 3.

<Preparing of Cyan Toner 2-1>

Cyan toner 1 is prepared by using the same method as that used in the preparing of the magenta toner 2-1 except that the magenta colored particle dispersion (1) is changed to the cyan colored particle dispersion in the preparing of the aggregated particle 1 and the preparing of the aggregated particle 2.

Various parameters for the obtained toner particles and cyan toner 2-1 are summarized in Table 3.

<Preparing of Cyan Toner 2-2>

Cyan toner 2-2 is prepared by using the same method as that used in the preparing of the magenta toner 27 except that the magenta colored particle dispersion (1) is changed to the cyan colored particle dispersion in the preparing of the toner.

Various parameters for the obtained toner particles and cyan toner 2-2 are summarized in Table 3.

<Preparing of Yellow Toner 1>

Yellow toner 2-1 is prepared by using the same method as that used in the preparing of the magenta toner 1 except that the magenta colored particle dispersion (1) is changed to the yellow colored particle dispersion in the preparing of the aggregated particle 1 and the preparing of the aggregated particle 2.

Various parameters for the obtained toner particles and yellow toner 2-1 are summarized in Table 3.

<Preparing of Yellow Toner 2-2>

Yellow toner 2-2 is prepared by using the same method as that used in the preparing of the magenta toner 27 except that the magenta colored particle dispersion (1) is changed to the yellow colored particle dispersion in the preparing of the toner.

Various parameters for the obtained toner particles and yellow toner 2-2 are summarized in Table 3.

Each toner obtained as described above and a carrier are put into a V-type blender at a ratio of toner:carrier=5:95 (mass ratio) and stirred for 20 minutes to obtain each developer.

As the carrier, a carrier prepared as follows is used.

Ferrite particles (volume average particle diameter: 50 μm): 100 parts

Toluene: 14 parts

Styrene-methyl methacrylate copolymer: 2 parts (component ratio: 90/10, Mw=80000)

Carbon black (R330: manufactured by Cabot Corporation): 0.2 parts

First, the above components other than ferrite particles are stirred for 10 minutes by using a stirrer to prepare a dispersed coating liquid, then this coating liquid and ferrite particles are put into a vacuum deaeration type kneader and stirred at 60° C. for 30 minutes. After the stirring, the mixture is degassed by further reducing the pressure while warming, and dried to obtain a carrier.

[Evaluation]

A developing device of an image forming apparatus "DocuCentre color 400 manufactured by Fuji Xerox Co., Ltd.", is filled with each of the developers obtained as described above. By using this image forming apparatus, 10000 solid images having an image density of 100% are output under an environment of a temperature of 35° C. and a humidity of 85% RH. After that, the test chart No. 5-1 of the Society of Electrophotgraphy of Japan is output. With respect to 10 points in a halftone image of multicolor portion having +0.1 of W1-BK in the output image, coordinate values (L* value, a* value, and b* value) of the CIE 1976 L*a*b* color coordinate system are obtained by using X-Rite 939 (aperture diameter of 4 mm) manufactured by X-Rite Inc. Using the obtained coordinate values, a color difference ΔΔE is calculated. Based on the obtained ΔE, an image unevenness is evaluated according to the following criteria. The evaluation results are shown in Table 2.

The color difference ΔE is defined by $\Delta E=((\Delta a)^2+(\Delta b)^2+(\Delta L)^2)^{1/2}$.—Evaluation Criteria—A: The difference between the maximum value and the minimum value of ΔE at 10 points is less than 0.5. B: The difference between the maximum value and the minimum value of ΔE at 10 points is equal to or more than 0.5 and less than 1.0. C: The difference between the maximum value and the minimum value of ΔE at 10 points is equal to more than 1.0 and less than 2.0. D: The difference between the maximum value and the minimum value of ΔE at 10 points is equal to or more than 2.0.

TABLE 3

| Kind of toner | Toner particles: Volume average particle diameter (μm) | GSDv (90/50) | GSDp (50/10) | Average circularity | GSD (50/10) | Basic fluidity energy (mJ) | Aeration fluidity energy (mJ) |
|---|---|---|---|---|---|---|---|
| Magenta toner 2-1 | 6.1 | 1.32 | 1.24 | 0.970 | 1.015 | 151 | 25 |
| Magenta toner 2-2 | 6.1 | 1.26 | 1.24 | 0.969 | 1.027 | 182 | 30 |
| Magenta toner 2-3 | 6.0 | 1.30 | 1.28 | 0.975 | 1.014 | 194 | 30 |
| Magenta toner 2-4 | 6.1 | 1.31 | 1.24 | 0.952 | 1.015 | 200 | 33 |
| Magenta toner 2-5 | 6.1 | 1.28 | 1.25 | 0.970 | 1.029 | 192 | 32 |
| Magenta toner 2-6 | 6.1 | 1.32 | 1.24 | 0.985 | 1.014 | 103 | 20 |
| Magenta toner 2-7 | 6.0 | 1.31 | 1.28 | 0.956 | 1.025 | 246 | 36 |
| Magenta toner 2-8 | 6.0 | 1.26 | 1.27 | 0.956 | 1.024 | 230 | 39 |
| Magenta toner 2-9 | 6.2 | 1.34 | 1.27 | 0.954 | 1.028 | 195 | 30 |
| Magenta toner 2-10 | 6.1 | 1.28 | 1.24 | 0.980 | 1.015 | 171 | 25 |
| Magenta toner 2-11 | 6.1 | 1.24 | 1.24 | 0.970 | 1.016 | 194 | 33 |
| Magenta toner 2-12 | 6.0 | 1.30 | 1.29 | 0.975 | 1.016 | 205 | 32 |
| Magenta toner 2-13 | 6.1 | 1.31 | 1.24 | 0.947 | 1.015 | 210 | 35 |
| Magenta toner 2-14 | 6.1 | 1.28 | 1.25 | 0.970 | 1.032 | 201 | 30 |
| Magenta toner 2-15 | 6.1 | 1.32 | 1.24 | 0.990 | 1.015 | 98 | 15 |
| Magenta toner 2-16 | 6.0 | 1.31 | 1.28 | 0.951 | 1.025 | 252 | 37 |
| Magenta toner 2-17 | 6.0 | 1.26 | 1.27 | 0.951 | 1.024 | 235 | 41 |
| Magenta toner 2-18 | 6.1 | 1.24 | 1.29 | 0.948 | 1.031 | 266 | 45 |
| Cyan toner 2-1 | 6.1 | 1.31 | 1.24 | 0.969 | 1.016 | 161 | 26 |
| Cyan toner 2-2 | 6.1 | 1.24 | 1.30 | 0.948 | 1.031 | 269 | 48 |
| Yellow toner 2-1 | 6.1 | 1.31 | 1.24 | 0.970 | 1.015 | 158 | 25 |
| Yellow toner 2-2 | 6.1 | 1.25 | 1.29 | 0.949 | 1.031 | 270 | 46 |

TABLE 4

| | Toner 1 | Toner 2 | Toner 3 | Difference in basic fluidity energy (mJ) | Image unevenness |
|---|---|---|---|---|---|
| Example 27 | Magenta toner 1 | Cyan toner 1 | — | 10 | A |
| Example 28 | Magenta toner 2 | Cyan toner 1 | — | 21 | A |
| Example 29 | Magenta toner 3 | Cyan toner 1 | — | 33 | A |
| Example 30 | Magenta toner 4 | Cyan toner 1 | — | 39 | B |
| Example 31 | Magenta toner 5 | Cyan toner 1 | — | 31 | A |
| Example 32 | Magenta toner 6 | Cyan toner 1 | — | 58 | B |
| Example 33 | Magenta toner 7 | Cyan toner 1 | — | 85 | C |
| Example 34 | Magenta toner 8 | Cyan toner 1 | — | 69 | C |
| Example 35 | Magenta toner 9 | Cyan toner 1 | — | 34 | B |
| Example 36 | Magenta toner 10 | Cyan toner 1 | — | 10 | A |
| Example 37 | Magenta toner 11 | Cyan toner 1 | — | 33 | B |
| Example 38 | Magenta toner 12 | Cyan toner 1 | — | 44 | B |
| Example 39 | Magenta toner 13 | Cyan toner 1 | — | 49 | B |
| Example 40 | Magenta toner 14 | Cyan toner 1 | — | 40 | B |
| Example 41 | Magenta toner 15 | Cyan toner 1 | — | 63 | B |
| Example 42 | Magenta toner 16 | Cyan toner 1 | — | 91 | C |
| Example 43 | Magenta toner 17 | Cyan toner 1 | — | 74 | C |
| Example 44 | Magenta toner 18 | Cyan toner 1 | — | 105 | C |
| Example 45 | Magenta toner 1 | Cyan toner 2 | — | 118 | C |
| Comparative Example 3 | Magenta toner 18 | Cyan toner 2 | — | 3 | D |
| Example 46 | Magenta toner 1 | Yellow toner 1 | — | 7 | A |
| Example 47 | Magenta toner 1 | Yellow toner 2 | — | 119 | C |
| Example 48 | Magenta toner 18 | Yellow toner 1 | — | 108 | C |
| Comparative Example 4 | Magenta toner 18 | Yellow toner 2 | — | 4 | D |
| Example 49 | Magenta toner 1 | Cyan toner 1 | Yellow toner 1 | 10 | A |

Embodiment of Third Exemplary Embodiment (Preparing of Resin Particle Dispersion)

Resin dispersion (1), magenta colored particle dispersion (1), and release agent particle dispersion are obtained by using the above-described methods.

The above materials are mixed, heated to 100° C., dispersed by using a homogenizer (ULTRA TURRAX T50, manufactured by IKA Ltd), and then subjected to a dispersion treatment using a Manton Gaulin high pressure homogenizer (manufactured by Gaulin) to obtain a release agent particle dispersion (solid content: 20%) in which release agent particles having a volume average particle diameter of 200 nm are dispersed.

<Preparing of Magenta Toner 3-1>

Resin particle dispersion: 402.5 parts

Magenta colored particle dispersion: 12.5 parts

Release agent particle dispersion: 50 parts

Anionic surfactant (Tayca Power): 2 parts

The above materials are put into a round stainless steel flask, the pH is adjusted to 3.5 by adding 0.1 N nitric acid, and then 30 parts of an aqueous nitric acid solution containing 10% of polyaluminum chloride is added thereto. Subsequently, the mixture is dispersed at 30° C. by using a homogenizer (ULTRA TURRAX T50, manufactured by IKA Ltd), then heated to 45° C. in a heating oil bath, and kept for 30 minutes. Thereafter, 100 parts of the resin particle dispersion is additionally added and kept for 1 hour, and the pH is adjusted to 8.5 by adding 0.1 N sodium hydroxide aqueous solution. Then, the mixture is heated to 85° C. while continuing the stirring and kept for 5 hours. After that, the mixture is cooled to 20° C. at a rate of 20° C./min, filtered, sufficiently washed with ion exchange water, and dried to obtain toner particle (1) having a volume average particle diameter of 6.0 μm.

Next, 100 parts of the toner particle (1), 15 parts of an anionic surfactant, and 200 parts of ion exchange water are mixed, dispersed for 20 minutes by using an ultrasonic dispersing machine, and the mixture is separated by using a centrifuge (Himac CR22G, manufactured by Hitachi Koki Co., Ltd.) with a gravity acceleration of 5.5×104 G for 60 minutes. The resulting product is kept for 40 minutes, and 30% by volume of a supernatant with respect to the entire toner dispersion is collected to prepare a toner dispersion. The toner dispersion is filtered, the residue is sufficiently washed with ion exchange water, and dried to obtain toner particle (2).

70 parts of the toner particle (1), 30 parts of the toner particle (2), and 2.5 parts of hydrophobic silica particles (RY 50, manufactured by Nippon Aerosil Co., Ltd.) are mixed by using a Henschel mixer to obtain magenta toner 3-1.

Various parameters for the mixture of the toner particle (1) and the toner particle (2), and magenta toner 3-1 are summarized in Table 5.

<Preparing of Magenta Toner 3-2>

Magenta toner 3-2 is prepared by using the same formulation as that used in the case of the magenta toner 3-1 except that the keeping time after adding 100 parts of the resin particle dispersion is changed to 2 hours in the magenta toner 3-1.

Various parameters for the mixture of the obtained toner particles, and the magenta toner 3-2 are summarized in Table 5.

<Preparing of Magenta Toner 3-3>

Magenta toner 3-3 is prepared by using the same formulation as that used in the case of the magenta toner 3-1 except that the pH at which the 0.1 N aqueous solution of sodium hydroxide is added is changed to 7.8 in the magenta toner 3-1.

Various parameters for the mixture of the obtained toner particles, and the magenta toner 3-3 are summarized in Table 5.

<Preparing of Magenta Toner 3-4>

Magenta toner 3-4 is prepared by using the same method as that used in the case of the magenta toner 3-1 except that the mixing amount of the toner particle (1) and the toner particle (2) is changed to 80 parts of the toner particle (1) and 20 parts of the toner particle (2) in the magenta toner 3-1.

Various parameters for the mixture of the obtained toner particles, and the magenta toner 3-4 are summarized in Table 5.

<Preparing of Magenta Toner 3-5>

In the centrifugation of the toner particle (1) in the magenta toner 3-1, a toner dispersion is prepared by adding 30% by volume of supernatant and 30% by volume of sedimented portion. Subsequent steps are the same as those used in the case of the magenta toner 3-1 to obtain magenta toner 3-5.

Various parameters for the mixture of the obtained toner particles, and the magenta toner 3-5 are summarized in Table 5.

<Preparing of Magenta Toner 3-6>

Magenta toner 3-6 is prepared by using the same method as that used in the case of the magenta toner 3-1 except that the treatment of being heated to 85° C. and kept for 5 hours is changed to a treatment of being heated to 84° C. and kept for 4 hours in the magenta toner 3-1.

Various parameters for the mixture of the obtained toner particles, and the magenta toner 3-6 are summarized in Table 5.

<Preparing of Magenta Toner 3-7>

Magenta toner 3-7 is prepared by using the same method as that used in the case of the magenta toner 3-1 except that the amount of the hydrophobic silica particles is changed to 5.0 parts in the magenta toner 3-1.

Various parameters for the mixture of the obtained toner particles, and the magenta toner 3-7 are summarized in Table 5.

<Preparing of Magenta Toner 3-8>

Magenta toner 3-8 is prepared by using the same method as that used in the case of the magenta toner 3-1 except that the amount of the hydrophobic silica particles is changed to 0.8 parts in the magenta toner 3-1.

Various parameters for the mixture of the obtained toner particles, and the magenta toner 3-8 are summarized in Table 5.

<Preparing of Magenta Toner 3-9>

Magenta toner 3-9 is prepared by using the same method as that used in the case of the magenta toner 3-1 except that terephthalic acid is changed to trimellitic acid in the magenta toner 3-1.

Various parameters for the mixture of the obtained toner particles, and the magenta toner 3-9 are summarized in Table 5.

<Preparing of Magenta Toner 3-10>

Magenta toner 3-10 is prepared by using the same method as that used in the case of the magenta toner 3-1 except that terephthalic acid is changed to dodecenyl succinic acid in the magenta toner 3-1.

Various parameters for the mixture of the obtained toner particles, and the magenta toner 3-10 are summarized in Table 5.

<Preparing of Magenta Toner 3-11>

(Preparing of Toner Particle (11))

Polyester resin: 176 parts

C.I. Pigment Red 122: 10 parts

Paraffin wax (HNP-9, manufactured by Nippon Seiro Co., Ltd.): 14 parts

The above components are mixed by using a Henschel mixer, and then kneaded by using a continuous kneader (twin-screw extruder) having a screw configuration shown in FIG. 1 under the following conditions. The rotation speed of the screw is 500 rpm.

Feed unit (blocks 12 A and 12 B) set temperature: 20° C.

Kneading unit 1 kneading set temperature (block 12C to 12E): 100° C.

Kneading part 2 kneading set temperature (Block 12F to 12J): 110° C.

Addition amount of aqueous medium (distilled water) (with respect to 100 parts of raw material supply amount): 1.5 parts At this time, the temperature of the kneaded product at the discharge port (discharge port 18) is 120° C.

This kneaded product is rapidly cooled by using a rolling roll the inside of which brine at −5° C. flows and a slab-inserted cooling belt that is cooled with cold water at 2° C., and after being cooled, pulverized by using a hammer mill. The speed of the cooling belt is changed to check the rapid cooling rate. The average temperature lowering rate is 10° C./sec.

Thereafter, the product is pulverized by using a pulverizer (AFG 400) having a coarse particle classifier therein to obtain pulverized particles. After that, classification treatment is performed at cut points of 4.5 μm and 7.4 μm by using an inertial classifier to remove fine particles and coarse particles, and toner particle (11) having a volume average particle diameter of 6.8 μm are obtained.

Magenta toner 3-11 is prepared in the same method as that used in the case of the magenta toner 3-1 except that the toner particle (11) is used.

Various parameters for the obtained toner particles and the magenta toner 3-11 are summarized in Table 5.

<Preparing of Magenta Toner 3-12>

(Preparing of Unmodified Polyester Resin (1))

Terephthalic acid: 124 parts

Fumaric acid: 110 parts

Bisphenol A ethylene oxide adduct: 183 parts

Bisphenol A propylene oxide adduct: 84 parts

After heating and mixing the above components at 180° C., 0.3 parts of dibutyltin oxide is added and water is removed while heating at 220° C. to obtain an unmodified polyester resin. The unmodified polyester resin thus obtained had a glass transition temperature Tg of 60° C., an acid value from 3 mg KOH/g, and a hydroxyl value of 1 mg KOH/g.

(Preparing of Polyester Prepolymer (1))

Terephthalic acid: 125 parts

Fumaric acid: 150 parts

Bisphenol A ethylene oxide adduct: 84 parts

Bisphenol A propylene oxide adduct: 184 parts

After heating and mixing the above components at 180° C., 0.3 parts of dibutyltin oxide is added and water is removed while heating at 220° C. to obtain a polyester. 35 parts of the obtained polyester, 5 parts of tolylene diisocyanate, and 50 parts of ethyl acetate are put into a vessel, and the mixture is heated at 130° C. for 3 hours to obtain a polyester prepolymer (1) having an isocyanate group (hereinafter referred to as "isocyanate-modified polyester prepolymer (1)").

(Preparing of Ketimine Compound (1))

50 parts of methyl ethyl ketone and 150 parts of hexamethylene diamine are put into a vessel and stirred at 60° C. to obtain a ketimine compound (1).

(Preparing of magenta coloring agent dispersion (2))

C.I. Pigment Red 122: 50 parts

Ethyl acetate: 200 parts

The above components are mixed with each other, and the mixture is filtered and further mixing with 200 parts of ethyl acetate is repeated 5 times. Then, the mixture is dispersed for about 1 hour by using an emulsifying dispersing machine CABITRON (CR 1010, manufactured by Pacific Machinery & Engineering Co., Ltd), to obtain magenta coloring agent dispersion (2) (solid content concentration: 20%).

(Preparing of Release Agent Dispersion (1))

Paraffin wax (HNP-9, manufactured by Nippon Seiro Co., Ltd.): 30 parts

Ethyl acetate: 270 parts

The above components are cooled to 10° C. and wet pulverized with a microbead type dispersing machine (DCP mill) to obtain a release agent dispersion (1).

(Preparing of Oil Phase Solution (1))

Unmodified polyester resin (1): 30 parts

Magenta coloring agent dispersion (2): 50 parts

Ethyl acetate: 10 parts

After stirring and mixing the above components, 10 parts of the release agent dispersion (1) is added to the obtained mixture, and the mixture is stirred to obtain an oil phase solution (1).

(Preparing of Styrene Acrylic Resin Particle Dispersion (1))

Styrene: 283 parts n-Butyl acrylate: 170 parts

Acrylic acid: 4 parts

Dodecanethiol: 14 parts

Carbon tetrabromide: 4 parts

The above components are mixed and the dissolved mixture is added to an aqueous solution in which 4 parts of a nonionic surfactant (Nonipol 400, manufactured by Sanyo Chemical Industries, Ltd.) and 10 parts of an anionic surfactant (Neogen SC, manufactured by Daiichi Kogyo Seiyaku Co., Ltd.) have been dissolved in 560 parts of ion exchange water and emulsified in a flask. Then, while mixing for 10 minutes, an aqueous solution in which 4 parts of ammonium persulfate has been dissolved in 10 parts of ion exchange water is added thereto, and after performing nitrogen replacement, the inside of the flask is heated in an oil bath while stirring until the content therein reaches 70° C. Emulsion polymerization is continued as it is for 5 hours. In this manner, styrene acrylic resin particle dispersion (1) (resin particle concentration: 40%) prepared by dispersing the resin particles having an average particle diameter of 180 nm and a weight average molecular weight (Mw) of 32,500 is obtained. The glass transition temperature of the styrene acrylic resin particles is 57° C.

(Preparing of Aqueous Phase Solution (1))

Styrene acrylic resin particle dispersion (1): 30 parts

2% aqueous solution of CELLOGEN BS-H (Daiichi Kogyo Seiyaku Co., Ltd.): 100 parts Ion exchange water: 100 parts The above components are stirred and mixed to obtain an aqueous phase solution (1).

(Preparing of Toner Particle (1))

Oil phase solution (1): 300 parts

Isocyanate-modified polyester prepolymer (1): 25 parts

Ketimine compound (1): 0.5 part

The above components are put into a vessel and stirred for 2 minutes by using a homogenizer (ULTRA TURRAX, manufactured by IKA Ltd) to obtain an oil phase solution (1P), then 1000 parts of the aqueous phase solution (1) is added to the vessel, and the mixture is homogenized by using a homogenizer for 10 minutes. Next, this mixed solution is stirred with a propeller type stirrer at room temperature (25° C.) and atmospheric pressure (1 atm) for 48 hours to react the isocyanate-modified polyester prepolymer (1) with the ketimine compound (1). As a result, a urea-modified polyester resin is generated, and the organic solvent is removed therefrom to form a granular product. Subsequently, the granular product is washed with water, dried, and classified to obtain toner particles. In the subsequent centrifugation step, magenta toner 3-12 is prepared in the same conditions as those used in case of the magenta toner 3-1.

Various parameters for the obtained toner particles and the magenta toner 3-12 are summarized in Table 5.

<Preparing of Magenta Toner 3-13>[Preparing of Resin Particle Dispersion (X)]

Styrene: 300 parts n-Butyl acrylate: 90 parts

Acrylic acid: 0.2 parts

10-Dodecanethiol: 2.0 parts

The above components are mixed and dissolved, and the mixture is added to 550 parts of ion exchange water in which 6 parts of a nonionic surfactant (Nonipol 400, manufactured by Sanyo Chemical Industries, Ltd.) and 10 parts of an anionic surfactant (Neogen SC, manufactured by Daiichi Kogyo Seiyaku Co., Ltd.) have been dissolved, and emulsified and dispersed in a flask. Then, while gently mixing for 10 minutes, 50 parts of ion exchange water in which 4 parts of ammonium persulfate has been dissolved is added thereto. After performing nitrogen replacement, the inside of the flask is heated in an oil bath while stirring until the content therein reaches 70° C. Emulsion polymerization is continued for 5 hours. As a result, a resin dispersion in which styrene acrylic resin particles having a volume average particle diameter D50v=104 nm, a glass transition temperature Tg=59° C., and a weight average molecular weight Mw=55,000 is obtained.

[Preparing of Toner 3-13]

Toner particles are prepared by using the same method as that used in Example 1 except that the amount of the resin particle dispersion is changed to 300 parts and further 60 parts of the styrene acrylic resin particle dispersion (X) is added, and toner (13) is obtained.

Various parameters for the obtained toner particles and the magenta toner 3-13 are summarized in Table 5.

<Preparing of Magenta Toner 3-14>

Magenta toner 3-14 is prepared by using the same method as that used in the case of the magenta toner 3-1 except that a treatment of adding 100 parts of the resin particle dispersion and being kept for 1 hour is repeated four times instead of the treatment of adding 100 parts of the resin particle dispersion in the magenta toner 3-1.

Various parameters for the mixture of the obtained toner particles, and the magenta toner 3-14 are summarized in Table 5.

<Preparing of Magenta Toner 3-15>

Magenta toner 3-15 is prepared by using the same formulation as that used in the case of the magenta toner 3-1 except that the pH at which the 0.1 N sodium hydroxide aqueous solution is added is changed to 7.0 in the magenta toner 3-1.

Various parameters for the mixture of the obtained toner particles, and the magenta toner 3-15 are summarized in Table 5.

<Preparing of Magenta Toner 3-16>

Magenta toner 3-16 is prepared by using the same method as that used in the case of the magenta toner 3-1 except that the mixing amount of the toner particle (1) and the toner particle (2) is changed to 95 parts of the toner particle (1) and 5 parts of the toner particle (2) in the magenta toner 3-1.

Various parameters for the mixture of the obtained toner particles, and the magenta toner 3-16 are summarized in Table 5.

<Preparing of Magenta Toner 3-17>

In the centrifugation step of the toner particle (2) in the magenta toner 3-1, a toner dispersion is prepared by adding 40% of sedimented portion. Subsequent steps are the same as those of magenta toner 3-1, so that magenta toner 3-17 is prepared.

Various parameters for the obtained toner particle mixture and the magenta toner 3-17 are summarized in Table 5.

<Preparing of Magenta Toner 3-18>

Magenta toner 3-18 is prepared by using the same method as that used in the case of the magenta toner 3-1 except that the treatment of being heated to 85° C. and kept for 5 hours is changed to a treatment of being heated to 82° C. and kept for 2 hours in the magenta toner 3-1.

Various parameters for the obtained toner particle mixture and the magenta toner 3-18 are summarized in Table 5.

<Preparing of Magenta Toner 3-19>

Magenta toner 3-18 is prepared by using the same method as that used in the case of the magenta toner 3-1 except that 2.5 parts of hydrophobic silica particles (RY 50) and 1.5 parts of titanium oxide (JMT 2000, manufactured by Tayca Corporation) are added at the time of external addition in the magenta toner 3-1.

Various parameters for the obtained toner particle mixture and magenta toner 3-19 are summarized in Table 5.

<Preparing of Magenta Toner 3-20>

In the magenta toner 3-1, after external addition, the toner is seasoned for 24 hours under the condition of 40° C. and 50%.

Except for the above, magenta toner 3-20 is prepared by using the same method as that used in the case of the magenta toner 3-1.

Various parameters for the obtained toner particle mixture and magenta toner 3-20 are summarized in Table 5.

<Preparing of Magenta Toner 3-21>

In the magenta toner 3-1, 2.5 parts of hydrophobic silica particles (RY 50) and 1.5 parts of titanium oxide (JMT 2000, manufactured by Tayca Corporation) are added at the time of external addition, and then the toner is seasoned for 24 hours under the condition of 40° C. and 50%. Except for the above, magenta toner 3-21 is prepared by using the same method as that used in the case of the magenta toner 3-1.

Various parameters for the mixture of the obtained toner particles and the magenta toner 3-21 are summarized in Table 5.

<Preparing of Magenta Toner 3-22>

In the magenta toner 3-1, 2.5 parts of hydrophobic silica particles (RY 50), 1.5 parts of titanium oxide (JMT 2000, manufactured by Tayca Corporation), and 2.5 parts of sol-gel silica particles (X24, manufacture by Shin-Etsu Chemical Co., Ltd.) are added at the time of external addition. Except for the above, magenta toner 3-22 is prepared by using the same method as that used in the case of the magenta toner 3-1.

Various parameters for the mixture of the obtained toner particles and the magenta toner 3-22 are summarized in Table 5.

<Preparing of Magenta Toner 3-23>

In the same manner as in the case of the magenta toner 3-1, the materials are dispersed, and then heated to 50° C. in a heating oil bath and kept for 60 minutes. Thereafter, 100 parts of the resin particle dispersion is additionally added and kept for 1 hour, and the pH is adjusted to 8.5 by adding 0.1 N sodium hydroxide aqueous solution. Then, the mixture is heated to 85° C. while continuing the stirring and kept for 5 hours. After that, the mixture is cooled to 20° C. at a rate of 20° C./min, filtered, and sufficiently washed with ion exchange water to obtain toner particle (A). Next, 100 parts of the toner particle (A), 15 parts of an anionic surfactant, and 200 parts of ion exchange water are mixed, dispersed for 20 minutes by using an ultrasonic dispersing machine, and the mixture is separated by using a centrifuge (Himac CR22G, manufactured by Hitachi Koki Co., Ltd.) with a gravity acceleration of 5.5×104 G for 60 minutes. The resulting product is kept for 40 minutes, and 10% by volume of a supernatant and 10% by volume of a sedimented portion with respect to the entire toner dispersion are removed. The remaining toner dispersion is filtered, sufficiently washed with ion exchange water, and dried to obtain toner particle (B). Magenta toner 3-23 is obtained by using the same method as that used in the case of the magenta toner 3-1 except that the toner particle (B) is used instead of the toner particle (1) and the toner particle (2).

Various parameters for the obtained toner particles and the magenta toner 3-23 are summarized in Table 5.

Each toner obtained as described above and a carrier are put into a V-type blender at a ratio of toner:carrier=5:95 (mass ratio) and stirred for 20 minutes to obtain each developer.

As the carrier, a carrier prepared as follows is used.

Ferrite particles (volume average particle diameter: 50 μm): 100 parts

Toluene: 14 parts

Styrene-methyl methacrylate copolymer: 2 parts (component ratio: 90/10, Mw=80000)

Carbon black (R330: manufactured by Cabot Corporation): 0.2 parts

First, the above components other than ferrite particles are stirred for 10 minutes by using a stirrer to prepare a dispersed coating liquid, then this coating liquid and ferrite particles are put into a vacuum deaeration type kneader and stirred at 60° C. for 30 minutes. After the stirring, the mixture is degassed by further reducing the pressure while warming, and dried to obtain a carrier.

[Evaluation]

[Evaluation of Scattering of Halftone Under Low Temperature and Low Humidity]

The following operations and image formation are carried out in an environment of a temperature of 10° C. and a relative humidity of 10%.

A copying machine Versant 3100 Press, manufactured by Fuji Xerox Co., Ltd., is filled with a developer and a toner cartridge, and with respect to a fine paper (J paper, manufactured by Fuji Xerox Co., Ltd., basis weight: 82 g/m$^2$), the toner weight on the paper is adjusted to be 6.0 mg/cm$^2$ when the image density is 100%. Then, 100 solid images of magenta color having an image density of 100% are continuously outputted. The process speed at this time is 445 mm/sec. Thereafter, 10 monochrome images with an image density of 50% (dot charts) are output. For the 10th output image, a grade (G1 to G4) is assigned to the scattering of the toner by using a graduated loupe of ×100 magnifications.

[Evaluation of Scattering of Halftone Under High Temperature and High Humidity]

The following operations and image formation are carried out in an environment of a temperature of 30° C. and a relative humidity of 85%.

A copying machine Versant 3100 Press, manufactured by Fuji Xerox Co., Ltd., is filled with a developer and a toner cartridge, and conditioned for 72 hours. Thereafter, on a coated paper (OS coated paper W having a basis weight of 127 g/m$^2$, manufactured by Fuji Xerox Co., Ltd.), the toner weight on the paper is adjusted to be 6.0 mg/cm$^2$ when the image density is 100%. Then, 100 solid images of magenta color having an image density of 100% are continuously outputted. The process speed at this time is 445 mm/sec. Thereafter, 10 monochrome images with an image density of 50% (dot charts) are output. For the 10th output image, a grade (G1 to G4) is assigned to the scattering of the toner by using a graduated loupe of ×100 magnifications.

—Evaluation Criteria—

G1: Toner scattering cannot be recognized.

G2: Toner scattering can be slightly recognized.

G3: Although there is toner scattering, there is no problem in practical use.

G4: There is toner scattering, which may cause problems in practical use.

G5: There is toner scattering, which causes problems in practical use.

TABLE 5

| | Toner particles | | | | Toner | | | |
|---|---|---|---|---|---|---|---|---|
| | Volume average particle diameter (μm) | GSDv (90/50) | GSDp (50/10) | GSDv(90/50)/GSDp(50/10) | Average circularity (total) | Average circularity (side of smallest diameter) | Basic fluidity energy (mJ) | Aeration index |
| Magenta toner 3-1 | 6.0 | 1.31 | 1.46 | 0.90 | 0.96 | 0.98 | 300 | 60 |
| Magenta toner 3-2 | 5.9 | 1.20 | 1.34 | 0.90 | 0.96 | 0.97 | 380 | 49 |
| Magenta toner 3-3 | 6.3 | 1.39 | 1.51 | 0.92 | 0.95 | 0.96 | 410 | 52 |
| Magenta toner 3-4 | 6.2 | 1.21 | 1.31 | 0.92 | 0.95 | 0.95 | 400 | 47 |
| Magenta toner 3-5 | 6.1 | 1.35 | 1.45 | 0.93 | 0.95 | 0.97 | 360 | 52 |
| Magenta toner 3-6 | 6.1 | 1.30 | 1.45 | 0.90 | 0.94 | 0.95 | 320 | 48 |
| Magenta toner 3-7 | 6.0 | 1.31 | 1.46 | 0.90 | 0.96 | 0.98 | 160 | 45 |
| Magenta toner 3-8 | 6.0 | 1.31 | 1.46 | 0.90 | 0.96 | 0.98 | 480 | 70 |
| Magenta toner 3-9 | 6.2 | 1.35 | 1.45 | 0.93 | 0.97 | 0.97 | 200 | 25 |
| Magenta toner 3-10 | 6.4 | 1.35 | 1.45 | 0.93 | 0.96 | 0.96 | 460 | 79 |
| Magenta toner 3-11 | 6.8 | 1.29 | 1.45 | 0.89 | 0.97 | 0.97 | 300 | 62 |
| Magenta toner 3-12 | 7.0 | 1.30 | 1.47 | 0.88 | 0.96 | 0.97 | 295 | 61 |
| Magenta toner 3-13 | 6.5 | 1.31 | 1.49 | 0.88 | 0.96 | 0.98 | 290 | 59 |
| Magenta toner 3-14 | 8.0 | 1.15 | 1.25 | 0.92 | 0.94 | 0.94 | 400 | 25 |
| Magenta toner 3-15 | 7.0 | 1.43 | 1.55 | 0.92 | 0.95 | 0.95 | 420 | 27 |
| Magenta toner 3-16 | 6.2 | 1.19 | 1.28 | 0.93 | 0.95 | 0.96 | 440 | 27 |
| Magenta toner 3-17 | 6.4 | 1.30 | 1.35 | 0.96 | 0.94 | 0.94 | 450 | 26 |
| Magenta toner 3-18 | 6.1 | 1.31 | 1.46 | 0.90 | 0.91 | 0.92 | 450 | 29 |
| Magenta toner 3-19 | 6.0 | 1.31 | 1.46 | 0.90 | 0.96 | 0.98 | 120 | 28 |
| Magenta toner 3-20 | 6.0 | 1.31 | 1.46 | 0.90 | 0.96 | 0.98 | 600 | 72 |

TABLE 5-continued

| | Toner particles | | | | Toner | | | |
|---|---|---|---|---|---|---|---|---|
| | Volume average particle diameter (μm) | GSDv (90/50) | GSDp (50/10) | GSDv(90/50)/ GSDp(50/10) | Average circularity (total) | Average circularity (side of smallest diameter) | Basic fluidity energy (mJ) | Aeration index |
| Magenta toner 3-21 | 6.0 | 1.31 | 1.46 | 0.90 | 0.96 | 0.98 | 200 | 22 |
| Magenta toner 3-22 | 6.0 | 1.31 | 1.46 | 0.90 | 0.96 | 0.98 | 490 | 95 |
| Magenta toner 3-23 | 8.5 | 1.18 | 1.22 | 0.97 | 0.91 | 0.93 | 630 | 20 |

TABLE 6

| | Toner | Scattering (low temperature and low humidity) | Scattering (high temperature and high humidity) |
|---|---|---|---|
| Example 50 | Magenta toner 1 | G1 | G1 |
| Example 51 | Magenta toner 2 | G2 | G2 |
| Example 52 | Magenta toner 3 | G2 | G2 |
| Example 53 | Magenta toner 4 | G2 | G2 |
| Example 54 | Magenta toner 5 | G2 | G2 |
| Example 55 | Magenta toner 6 | G1 | G2 |
| Example 56 | Magenta toner 7 | G2 | G2 |
| Example 57 | Magenta toner 8 | G2 | G2 |
| Example 58 | Magenta toner 9 | G2 | G2 |
| Example 59 | Magenta toner 10 | G2 | G2 |
| Example 60 | Magenta toner 11 | G1 | G1 |
| Example 61 | Magenta toner 12 | G1 | G1 |
| Example 62 | Magenta toner 13 | G1 | G1 |
| Comparative Example 5 | Magenta toner 14 | G2 | G5 |
| Comparative Example 6 | Magenta toner 15 | G2 | G5 |
| Comparative Example 7 | Magenta toner 16 | G2 | G5 |
| Comparative Example 8 | Magenta toner 17 | G2 | G5 |
| Comparative Example 9 | Magenta toner 18 | G3 | G5 |
| Example 63 | Magenta toner 19 | G4 | G3 |
| Example 64 | Magenta toner 20 | G4 | G3 |
| Example 65 | Magenta toner 21 | G3 | G4 |
| Example 66 | Magenta toner 22 | G3 | G4 |
| Comparative Example 10 | Magenta toner 23 | G4 | G5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner set having n kinds of toners that exhibit different colors from each other, wherein n is an integer of equal to or more than 2, wherein all of the toners comprise toner particles having:

a volume particle diameter distribution index on a side of the largest diameter (GSDv (90/50)) of 1.26 or less;

a number particle diameter distribution index on a side of the smallest diameter (GSDp (50/10)) of 1.28 or less;

GSDv (90/50)/GSDp (50/10) of from 0.98 to 1.01; and an average circularity from 0.95 to 1.00, wherein at least one toner of the toner set has an average aeration fluidity energy in a range of from 100 mJ to 300 mJ, the aeration fluidity energy being measured by using a powder rheometer under a condition that a tip speed of a rotary blade is 100 mm/sec, an entrance angle of the rotary blade is −5°, and an aeration flow rate is 5 ml/min, wherein the measurement using the powder rheometer comprises:

storing the toner to be measured for equal to or more than 8 hours at a temperature of 25° C. and a humidity of 45% RH;

performing a conditioning operation that comprises:

stirring a propeller-type rotary blade in an inside of a vessel that contains the stored toner from a height of 70 mm from a bottom of the vessel to a height of 2 mm from the bottom at a tip speed of a rotary blade of 40 mm/sec and at an entrance angle of 5°; and repeating the conditioning four times; and then performing an energy measurement operation that comprises:

measuring a rotational torque and a vertical load in a case where the entrance angle is moved to −5° while rotating the rotary blade at a tip speed of 100 mm/sec in the inside of the vessel from a height of 55 mm from the bottom to a height of 2 mm from the bottom while flowing air at the aeration flow rate is 5 ml/min with the powder rheometer, then obtaining an energy gradient from the measured rotational torque and the vertical load, and obtaining the aeration fluidity energy by integrating a section of the energy gradient from a height of 2 mm from the bottom to a height of 55 mm from the bottom;

repeating the conditioning and energy measurement operations five times; and averaging the obtained aeration fluidity energy to obtain the average aeration fluidity energy.

2. The toner set according to claim 1, wherein at least one toner of the toner set has a ratio of the average aeration fluidity energy at an aeration flow rate of 5 ml/min to an average aeration fluidity energy at an aeration flow rate of 80 ml/min, is from 3 to 8, wherein the aeration fluidity energy being measured by using a powder rheometer under a condition that a tip speed of a rotary blade is 100 mm/sec, an entrance angle of the rotary blade is −5°, wherein the measurement using the powder rheometer comprises:

storing the toner to be measured for equal to or more than 8 hours at a temperature of 25° C. and a humidity of 45% RH;

performing a conditioning operation that comprises:

stirring a propeller-type rotary blade in an inside of a vessel that contains the stored toner from a height of 70 mm from a bottom of the vessel to a height of 2 mm from the bottom at a tip speed of a rotary blade of 40 mm/sec and at an entrance angle of 5°; and repeating the conditioning four times; and then performing an energy measurement operation that comprises:

measuring a rotational torque and a vertical load in a case where the entrance angle is moved to −5° while rotating the rotary blade at a tip speed of 100 mm/sec in the inside of the vessel from a height of 55 mm from the bottom to a height of 2 mm from the bottom while flowing air at the aeration flow rate is 5 ml/min with the powder rheometer, then obtaining an energy gradient from the measured rotational torque and the vertical load, and obtaining the aeration fluidity energy by integrating a section of the energy gradient from a height of 2 mm from the bottom to a height of 55 mm from the bottom;

repeating the conditioning and energy measurement operations five times; and averaging the obtained aeration fluidity energy to obtain the average aeration fluidity energy.

3. The toner set according to claim 1, wherein at least one toner of the toner set is a magenta toner containing a magenta coloring agent, and wherein the magenta coloring agent includes at least one selected from a group consisting of C.I. Pigment Red 122, C.I. Pigment Red 185, and C.I. Pigment Red 238.

4. The toner set according to claim 1, wherein at least one toner of the toner set is a cyan toner containing a cyan coloring agent, wherein the cyan coloring agent includes at least one selected from a group consisting of C.I. Pigment Blue 15:1 and C.I. Pigment Blue 15:3.

5. A toner set having n kinds of toners, wherein n is an integer of equal to or more than 2, the toners exhibiting different colors from each other and all of the toners comprise toner particles having:

a volume particle diameter distribution index on a side of the largest diameter (GSDv (90/50)) of 1.26 or less;

a number particle diameter distribution index on a side of the smallest diameter (GSDp (50/10)) of 1.28 or less;

GSDv (90/50)/GSDp (50/10) of from 0.98 to 1.01;

an average circularity from 0.95 to 1.00; and a circularity distribution index on a side of the irregular shape (GSD (50/10)) of equal to or less than 1.03, wherein at least one toner of the toner set has an average aeration fluidity energy in a range of from 100 mJ to 300 mJ, the aeration fluidity energy being measured by using a powder rheometer under a condition that a tip speed of a rotary blade is 100 mm/sec, an entrance angle of the rotary blade is −5°, and an aeration flow rate is 5 ml/min, wherein the measurement using the powder rheometer comprises:

storing the toner to be measured for equal to or more than 8 hours at a temperature of 25° C. and a humidity of 45% RH;

performing a conditioning operation that comprises:

stirring a propeller-type rotary blade in an inside of a vessel that contains the stored toner from a height of 70 mm from a bottom of the vessel to a height of 2 mm from the bottom at a tip speed of a rotary blade of 40 mm/sec and at an entrance angle of 5°; and repeating the conditioning four times; and then performing an energy measurement operation that comprises:

measuring a rotational torque and a vertical load in a case where the entrance angle is moved to −5° while rotating the rotary blade at a tip speed of 100 mm/sec in the inside of the vessel from a height of 55 mm from the bottom to a height of 2 mm from the bottom while flowing air at the aeration flow rate is 5 ml/min with the powder rheometer, then obtaining an energy gradient from the measured rotational torque and the vertical load, and obtaining the aeration fluidity energy by integrating a section of the energy gradient from a height of 2 mm from the bottom to a height of 55 mm from the bottom;

repeating the conditioning and energy measurement operations five times; and averaging the obtained aeration fluidity energy to obtain the average aeration fluidity energy.

* * * * *